US010403261B1

(12) United States Patent
Enamito et al.

(10) Patent No.: US 10,403,261 B1
(45) Date of Patent: Sep. 3, 2019

(54) NOISE REDUCTION APPARATUS

(71) Applicant: KABUSHIKI KAISHA TOSHIBA, Tokyo (JP)

(72) Inventors: Akihiko Enamito, Kawasaki Kanagawa (JP); Tatsuhiko Goto, Kawasaki Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 16/112,298

(22) Filed: Aug. 24, 2018

(30) Foreign Application Priority Data

Mar. 20, 2018 (JP) ..... 2018-052157

(51) Int. Cl.
*G10K 11/178* (2006.01)

(52) U.S. Cl.
CPC .. *G10K 11/17823* (2018.01); *G10K 11/17853* (2018.01); *G10K 2210/121* (2013.01); *G10K 2210/3028* (2013.01); *G10K 2210/3044* (2013.01)

(58) Field of Classification Search
USPC ... 381/13, 71.1, 71.6, 73.1, 94.1, 94.5, 94.7, 381/94.8, 317
See application file for complete search history.

(56) References Cited

U.S. PATENT DOCUMENTS

2012/0314882 A1 12/2012 Sibbald

FOREIGN PATENT DOCUMENTS

| | | | | |
|---|---|---|---|---|
| EP | 2 602 566 | * | 4/2010 | ..... F24F 11/04 |
| EP | 2 518 414 | * | 5/2010 | ..... F24F 1/100 |
| EP | 2518414 | A1 | 10/2012 | |
| EP | 2602566 | A1 | 6/2013 | |
| JP | H10-149172 | A | 6/1998 | |
| JP | 4302074 | B2 | 7/2009 | |

(Continued)

OTHER PUBLICATIONS

Enamito, A. et al. A Study on Active Noise Control for Minimizing Total Acoustic Power (Acoustic Power Minimization on Zero Control Power Output), Transactions of the Japan Society of Mechanical Engineers (Part C), vol. 73, No. 729 (May 2007), pp. 1376-1383 (with machine translation).

(Continued)

*Primary Examiner* — Yosef K Laekemariam
(74) *Attorney, Agent, or Firm* — Kim & Stewart LLP

(57) ABSTRACT

According to one embodiment, a noise reduction apparatus includes a first control sound source, a first current detection unit, a second control sound source, a second current detection unit, and an adjustment unit. The first control sound source generates a first control sound for reducing noise from a noise source. The first current detection unit detects a first current flowing from the first control sound source upon receiving the noise from the noise source. The second control sound source is provided at a position different from a position of the first control sound source and generates a second control sound for reducing the noise from the noise source. The second current detection unit detects a second current flowing from the second control sound source upon receiving the noise from the noise source. The adjustment unit adjusts the first control sound and the second control sound so as to make the first current and the second current satisfy a predetermined condition.

14 Claims, 69 Drawing Sheets

(56) References Cited

FOREIGN PATENT DOCUMENTS

| | | |
|---|---|---|
| JP | 2011-137560 A | 7/2011 |
| WO | 2012/017575 A1 | 2/2012 |

OTHER PUBLICATIONS

Kobayashi, K. et al. "Minimization of the Acoustic Power Radiated from a Vibrating Panel Using Both Active Noise Control and Active Vibration Control", Transactions of the Japan Society of Mechanical Engineers (Part C), 68 vol. 669 (May 2002), pp. 1420-1427 (with machine translation).

* cited by examiner

NOISE REDUCTION APPARATUS

CROSS-REFERENCE TO RELATED APPLICATIONS

This application is based upon and claims the benefit of priority from the prior Japanese Patent Application No. 2018-052157, filed Mar. 20, 2018 the entire contents of which are incorporated herein by reference.

FIELD

Embodiments described herein relate generally to a noise reduction apparatus.

BACKGROUND

Noise reduction control targeted to a three-dimensional space is based on the assumption that both a noise source and a control sound source can be approximated to point sound source groups. With regard to non-rotating system noise in industrial equipment, power generating facilities, and the like, noise reduction target sounds can be approximated by a low sound range. This has also been demonstrated in actual equipment. Consider, however, rotor blade noise accompanying rotation represented by large-engine noise. In this case, depending on a driving situation, a sound source is not always a non-directional point sound source. When a noise source having such an unknown directivity characteristic is approximated by a non-directional point sound source, the effect of noise reduction control is reduced.

DETAILED DESCRIPTION

In general, according to one embodiment, a noise reduction apparatus includes a first control sound source, a first current detection unit, a second control sound source, a second current detection unit, and an adjustment unit. The first control sound source generates a first control sound for reducing noise from a noise source. The first current detection unit detects a first current flowing from the first control sound source upon receiving the noise from the noise source. The second control sound source is provided at a position different from a position of the first control sound source and generates a second control sound for reducing the noise from the noise source. The second current detection unit detects a second current flowing from the second control sound source upon receiving the noise from the noise source. The adjustment unit adjusts the first control sound and the second control sound so as to make the first current and the second current satisfy a predetermined condition.

A noise reduction apparatus according to this embodiment will be described below with reference to the accompanying drawings.

First Embodiment

Figure 1:
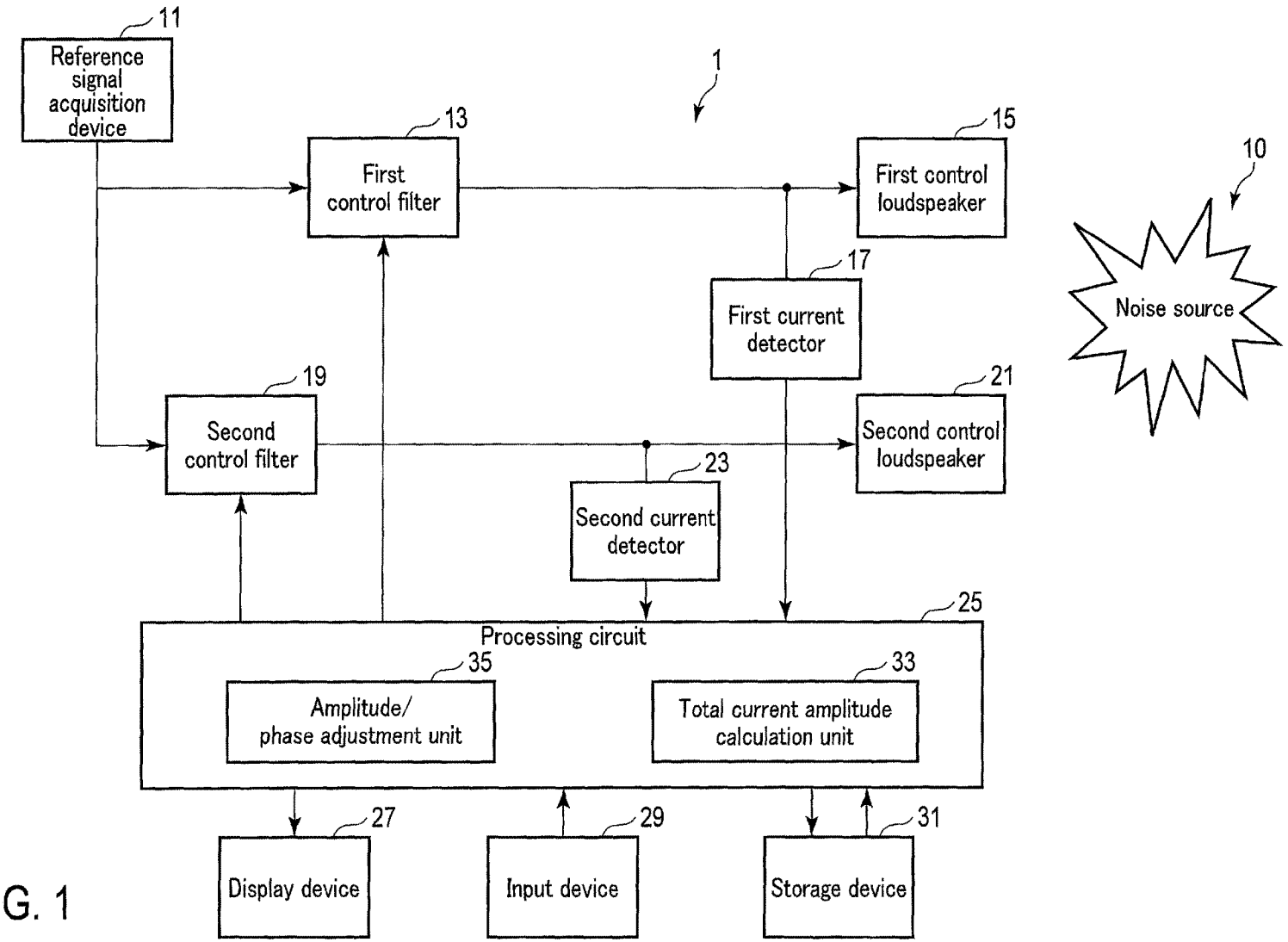
FIG. 1 is a block diagram showing the arrangement of a noise reduction apparatus according to the first embodiment.

FIG. 1 is a block diagram showing the arrangement of a noise reduction apparatus 1 according to the first embodiment. The noise reduction apparatus 1 is an apparatus that reduces noise generated from a noise source 10. The noise reduction apparatus 1 can be applied to both the noise source 10 of a rotating system that generates noise accompanying the rotation of a rotor blade and the noise source 10 of a non-rotating system having no rotor blade. The noise reduction apparatus 1 can be applied to both non-directional noise and directional noise.

As shown in FIG. 1, the noise reduction apparatus 1 includes a reference signal acquisition device 11, a first control filter 13, a first control loudspeaker 15, a first current detector 17, a second control filter 19, a second control loudspeaker 21, a second current detector 23, a processing circuit 25, a display device 27, an input device 29, and a storage device 31. As described above, the noise reduction apparatus 1 includes a first control loudspeaker system constituted by the first control filter 13, the first control loudspeaker 15, and the first current detector 17 and a second control loudspeaker system constituted by the second control filter 19, the second control loudspeaker 21, and the second current detector 23. Having the two loudspeaker systems enables the noise reduction apparatus 1 to generate a control sound having directivity adapting to the directivity of even noise whose directivity is unknown.

The reference signal acquisition device 11 acquires a signal correlating with noise generated from the noise source 10. A signal acquired by the reference signal acquisition device 11 will be referred to as a reference signal hereinafter. When the noise source 10 is of a rotating system, a rotational speed detector such as an encoder provided for the driving system of the noise source 10 is appropriate as the reference signal acquisition device 11. The rotational speed detector detects the rotational speed of a rotor blade as the noise source 10 or a physical quantity dependent on the rotational speed such as a rotational frequency, and converts the detected physical quantity into a reference signal that is an electrical signal. Note that the reference signal acquisition device 11 may be, for example, a microphone. The microphone converts noise generated from the noise source 10 into a reference signal that is an electrical signal. The reference signal is supplied to the first control filter 13 and the second control filter 19.

The first control filter 13 is a filter that adjusts at least one of the amplitude and phase of a reference signal. The reference signal after adjustment by the first control filter 13 is called the first control signal. The first control signal is a control signal for driving the first control loudspeaker 15. The first control signal is supplied to the first control loudspeaker 15.

The first control loudspeaker 15 is a control sound source that generates the first control sound for reducing noise generated from the noise source 10. The first control loudspeaker 15 is also called the first control sound source. When the first control loudspeaker 15 receives the first control signal, the first control loudspeaker 15 is driven to generate the first control sound corresponding to the first control signal. In addition, the first control loudspeaker 15 generates a back electromotive force upon receiving noise from the noise source 10. When a back electromotive force is generated, a current flows in the first control loudspeaker. A current flowing in the first control loudspeaker 15 upon generation of a back electromotive force will be referred to as the first back electromotive current hereinafter.

The first current detector 17 is a current detector that detects the first current flowing in the first control loudspeaker 15. For example, the first current detector 17 detects the first back electromotive current flowing in the first control loudspeaker, and generates an electrical signal corresponding to the detected first back electromotive current. An electrical signal corresponding to the back electromotive current detected by the first current detector will be referred to as the first current detection signal hereinafter. The first current detection signal is supplied to the processing circuit 25.

The second control filter 19 is a filter that adjusts at least one of the amplitude and phase of a reference signal. A reference signal after adjustment by second control filter 19 will be referred to as the second control signal. The second control signal is a control signal for driving the second control loudspeaker 21. The second control signal is supplied to the second control loudspeaker 21.

The second control loudspeaker 21 is a control sound source that generates the second control sound for reducing noise generated from the noise source 10. The second control loudspeaker 21 is also called the second control sound source. The second control loudspeaker 21 is provided at a position different from that of the first control loudspeaker 15. When the second control loudspeaker 21 receives the second control signal, the second control loudspeaker 21 is driven to generate the second control sound corresponding to the second control signal. In addition, the second control loudspeaker 21 generates a back electromotive force upon receiving noise from the noise source 10. When a back electromotive force is generated, a current flows in the second control loudspeaker 21. A current flowing in the second control loudspeaker upon generation of a back electromotive force will be referred to as the second back electromotive current hereinafter.

The second current detector 23 is a current detector that detects the second current flowing in the second control loudspeaker 21. For example, the second current detector 23 detects the second back electromotive current flowing in the second control loudspeaker 21, and generates an electrical signal corresponding to the detected second back electromotive current. An electrical signal corresponding to a back electromotive current detected by the second current detector 23 will be referred as the second current detection signal. The second current detection signal is supplied to the processing circuit 25.

The processing circuit 25 adjusts the first control sound and the second control sound such that the first current detected by the first current detector 17 and the second current detected by the second current detector 23 satisfy predetermined conditions. The processing circuit 25 includes, as hardware components, a processor such as a CPU (Central Processing Unit) and a memory such as a RAM (Random Access Memory). The processing circuit 25 executes programs stored in the storage device 31 to implement a total current amplitude calculation unit 33 and an amplitude/phase adjustment unit 35. Note that the hardware implementation of the processing circuit 25 is not limited to above aspect. For example, the processing circuit 25 may be implemented by a circuit such as an ASIC (Application Specific Integrated Circuit) that implements the total current amplitude calculation unit 33 and the amplitude/phase adjustment unit 35. The total current amplitude calculation unit 33 and the amplitude/phase adjustment unit 35 may be mounted on a single integrated circuit or may be separately mounted on a plurality of integrated circuits.

The total current amplitude calculation unit 33 weights and adds the amplitude of the first current detected by the first current detector 17 and the amplitude of the second current detected by the second current detector 23 in accordance with weighting coefficients. A current amplitude after weighted addition will be referred to as a total current amplitude.

The amplitude/phase adjustment unit 35 adjusts at least one of the amplitude and phase of the first control sound and at least one of the amplitude and phase of the second control sound so as to make the total current amplitude satisfy predetermined conditions. A predetermined condition according to the first embodiment is defined as causing a total current amplitude to take an almost maximum value. The predetermined condition will be referred to as a maximization condition hereinafter. In this case, the amplitude/phase adjustment unit 35 adjusts at least one of the amplitude and phase of the first control sound and at least one of the amplitude and phase of the second control sound so as to make a total current amplitude take almost the maximum value. In other words, the first control filter 13 and the second control filter 19 are adjusted to make a total current amplitude take almost the maximum value. When the first control filter 13 and the second control filter 19 are adjusted, the directivity of the composite sound of the first control sound generated from the first control loudspeaker 15 and the second control sound generated from the second control loudspeaker 21 becomes adaptive to the directivity of noise. Using such control signals will minimize acoustic power propagating in a noise reduction target space. This reduces noise propagating in the space. Note that the almost maximum value according to this embodiment may be set to the maximum value of several calculated total current amplitudes or may be set to an allowable value designated via the input device 29 or the like.

The display device 27 displays various types of information. As the display device 27, it is possible to use, as appropriate, for example, a CRT (Cathode-Ray Tube) display, liquid crystal display, organic EL (Electro Luminescence) display, LED (Light-Emitting Diode) display, plasma display, or another arbitrary display known in this technical field.

The input device 29 inputs various types of commands from the user. As the input device 29, it is possible to use, for example, a keyboard, mouse, various types of switches, touch pad, touch panel display, and the like. An output signal from the input device 29 is supplied to the processing circuit 25. Note that the input device 29 may be a computer connected to the processing circuit 25 wiredly or wirelessly.

The storage device 31 includes a ROM (Read Only Memory), HDD (Hard Disk Drive), SSD (Solid State Drive), and integrated circuit storage device. The storage device 31 stores various types of arithmetic processing results obtained by the processing circuit 25 and various types of programs to be executed by the processing circuit 25.

The operation of the noise reduction apparatus 1 according to the first embodiment will be described below.

The noise reduction apparatus 1 uses a control sound source zero-power phenomenon that occurs when the acoustic power is minimum. A total acoustic power Pwt as the sum of a noise source and a control sound source is defined by equation (1), and a radiation acoustic power Ps of the control sound source is defined by equation (2). H represents conjugate transposition. When the total acoustic power is minimum, the radiation acoustic power Ps of the control sound source becomes 0.

$$P_{wt}=q_S^H A q_S+b^H q_S+q_S^H c+q_p^H D q_p \tag{1}$$

$$P_S=q_S^H A q_S+b^H q_S \tag{2}$$

The first term of equation (1) corresponds to the acoustic power at the time of sounding only the control sound source, the fourth term corresponds to the acoustic power at the time of sounding only the noise source, and the second and third terms correspond to the acoustic power generated by the interference between the control sound source and the noise source. In this case, $q_s$ represents the complex amplitude (volume velocity) vector of the control sound source, $q_p$ represents the complex amplitude (volume velocity) vector of the noise source, and b and c represent complex vectors in the same manner. Note that $q_s$, b, and c are respectively written as equations (3), (4), and (5).

$$q_S^T=(q_{S1}q_{S2}\ldots q_{Sn}) \tag{3}$$

$$b^T=(b_1 b_2\ldots b_n) \tag{4}$$

$$c^T=(c_1 c_2\ldots c_n) \tag{5}$$

An element $a_{ij}$ of a matrix A, an element $b_i$ of a vector b, an element $c_i$ of a vector c, and an element $d_{ij}$ of a matrix D in equations (1) and (2) can be written as in equations (6), (7), (8), and (9). Re represents a complex real part.

$$\begin{aligned} a_{ij} &= \frac{1}{2}\mathrm{Re}\left[\frac{j\omega\rho}{4\pi r_{SiSj}}e^{-jkr_{SiSj}}\right] \\ &= \frac{\omega\rho k}{8\pi}\cdot\frac{\sin(kr_{SiSj})}{kr_{SiSj}} \end{aligned} \tag{6}$$

-continued $$b_i = \frac{1}{2}\mathrm{Re}\left[\sum_{j=1}^{m} q_{Pj}\frac{j\omega\rho}{4\pi r_{Pj}}e^{-jkr_{Pj}}\right] = \frac{\omega\rho k}{8\pi}\sum_{j=1}^{m} q_{Pj}\cdot\sin(kr_{PjSi}) \quad (7)$$

$$c_i = b_i \quad (8)$$

$$d_{ij} = \frac{1}{2}\mathrm{Re}\left[\frac{j\omega\rho}{4\pi r_{PiPj}}e^{-jkr_{PiPj}}\right] = \frac{\omega\rho k}{8\pi}\cdot\frac{\sin(kr_{PiPj})}{kr_{PiPj}} \quad (9)$$

where $r_{SiSj}$ is the distance between the ith control sound source and the jth control sound source, $r_{PjSi}$ is the distance between the jth main sound source and the ith control sound source, $r_{PiPj}$ is the distance between the ith main sound source and the jth main sound source, j is a pure imaginary number, ω is an angular frequency, ρ is an air density, and k is a wave number.

Attention is paid to the radiation powers of the control sound sources, and the total acoustic power is minimized. Paying attention to the energy balance of the control loudspeakers with reference to the zero power of the control sound sources enables acoustic power minimization by controlling the currents of the control sound sources, which is conventionally achieved by reducing sound pressures using microphones.

Figure 2:
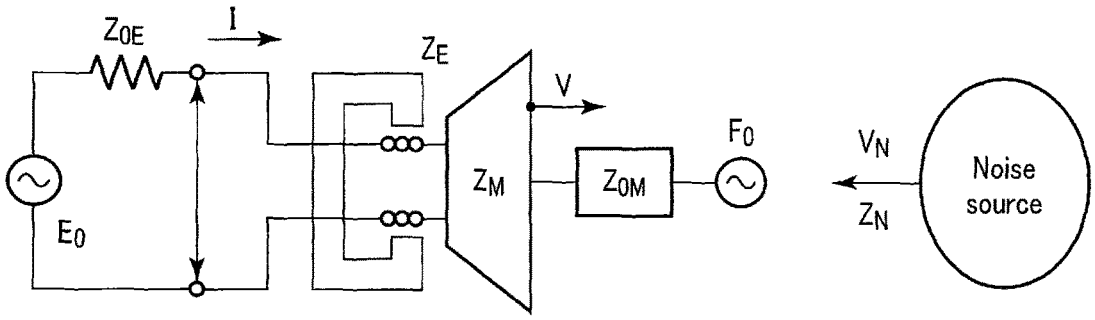
FIG. 2 is a circuit diagram showing the mechanism of a conductive loudspeaker having a cone-shaped diaphragm.

FIG. 2 is a circuit diagram showing the mechanism of a conductive loudspeaker having a cone-shaped diaphragm. Assuming that a voltage E is applied to the coil, a current I flows, and a force F acts on the diaphragm to cause it to move at a velocity V, equations (10) and (11) hold:

$$E=Z_E\cdot I+A_S\cdot V \quad (10)$$

$$F=-A_S\cdot I+Z_M\cdot V \quad (11)$$

where $Z_E$ is an electrical input impedance when the diaphragm is fixed, $Z_M$ is a mechanical impedance when the loudspeaker is regarded as a spring-mass system, and $A_S$ is a force coefficient (=B1, magnetic flux density×active coil length). In addition, assuming that the power supply has a voltage $E_O$ and an external force is supplied with an excitation force $F_O$ produced by an external sound field, equations (12) and (13) given below hold:

$$E=E_0-Z_{0E}\cdot I \quad (12)$$

$$F=F_0-Z_{0M}\cdot V \quad (13)$$

where $Z_{OE}$ is an electrical internal impedance, and $Z_{OM}$ is a mechanical impedance (acoustic self-radiation impedance) when the sound field is viewed from the mechanical system. Accordingly, equations (10) and (11) can be expressed by equations (14) and (15) by using equations (12) and (13):

$$E_0=(Z_{0E}+Z_E)\cdot I+A\cdot V \quad (14)$$

$$F_0=-A\cdot I+(Z_{0M}+Z_M)\cdot V \quad (15)$$

Because the loudspeaker receives no force from the external sound field, $F_O$ of the left side of equation (15) becomes 0. This is the driving mechanism of the loudspeaker. The first control loudspeaker 15 and the second control loudspeaker 21 in the noise reduction apparatus 1 are conditioned to be arranged near the noise source 10 for acoustic power minimization. Accordingly, the first control loudspeaker 15 and the second control loudspeaker 21 receive external forces produced by acoustic radiation from the noise source 10. In this case, $F_O$ is expressed by equation (16):

$$F_0=Z_N\cdot V_N \quad (16)$$

where $Z_N$ is an acoustic mutual radiation impedance, $V_N$ is the vibration velocity of the noise source. The possibility of total acoustic power minimization by control sound source zero-power control will be verified by paying attention to the external force $F_O$ generated by only closely spacing of the noise source and the control sound source and considering the relationship between the external force and control sound source zero-power control and the effects of changes in external force on electrical, mechanical, and acoustic systems.

Figure 3:
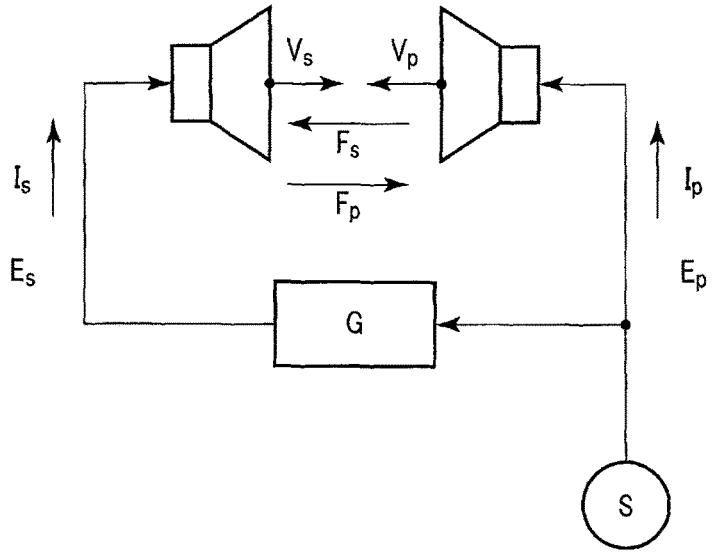
FIG. 3 is a view showing a loudspeaker arrangement for the possibility verification of total acoustic power minimization by control sound source zero-power control.

FIG. 3 is a graph showing a loudspeaker arrangement for the verification of the possibility of total acoustic power minimization by control sound source zero-power control. As shown in FIG. 3, for the sake of simplicity, identical loudspeakers are closely arranged as a noise source and a control sound source so as to face each other. This possibility is studied while the noise source and the control sound source simultaneously generate sounds.

Assuming that a voltage EP is applied to the coil on the noise source side, a current $I_P$ flows, and the diaphragm moves at a velocity $V_P$, equations (17) and (18) hold:

$$E_P=(Z_{0E,P}+Z_{E,P})\cdot I_P+A_P\cdot V_P \quad (17)$$

$$F_P=-A_P I_P+(Z_{0M,P}+Z_{M,P})V_P \quad (18)$$

At the same time, assuming that a voltage Es is applied to the coil on the control sound source side, a current Is flows, and the diaphragm moves at a velocity Vs, equations (19) and (20) hold:

$$E_S=(Z_{0E,S}+Z_{E,S})\cdot I_S+A_S\cdot V_S \quad (19)$$

$$F_S=-A_S I_S+(Z_{0M,S}+Z_{M,S})V_S \quad (20)$$

where $Z_{OE,P}$ is the electrical internal impedance of the noise source, $Z_{OE,S}$ is the electrical internal impedance of the control sound source, $Z_{E,P}$ is the electrical impedance of the noise source, $Z_{E,S}$ is the electrical impedance of the control sound source, and Ap and As each are a force coefficient (=B1, magnetic flux density×active coil length). In this assumption, because identical loudspeakers are used, Ap=As, and $Z_{OE,P}=Z_{OE,S}$. $Z_{OM,P}$ is the acoustic self-radiation impedance of the noise source, that is, a mechanical impedance when the sound field is viewed from the vibration system, $Z_{OM,S}$ is the acoustic self-radiation impedance of the control sound source, that is, the mechanical impedance when an acoustic field is viewed from the vibrating system, $Z_{M,P}$ is the mechanical impedance of the noise source when the loudspeaker is regarded as a spring-mass system, and $Z_{M,S}$ is the mechanical impedance of the control sound source when the loudspeaker is regarded as a spring-mass system.

An external force $F_P$ on the noise source side satisfies equation (21), and an external force $F_S$ on the control sound source side satisfies equation (22):

$$F_P=Z_{SP}\cdot V_S \quad (21)$$

$$F_S=Z_{PS}\cdot V_P \quad (22)$$

In this case, according to the reciprocity theorem, $Z_{SP}=Z_{PS}$.

Accordingly, when the vibration velocity Vs of the control sound source is eliminated from each of equations (19) and

(20) and a current is obtained according to equations (17) and (18), equation (23) given below holds:

$$I_S = \frac{E_S - AZ_{PS}|V_P|\cos\theta}{Z_{0E} + Z_{E,S} + \frac{A^2}{Z_{M,S} + Z_{SS}}} \quad (23)$$

As indicated by equation (23), the current value Is flowing in the control sound source is a function of the phase of the control sound source with respect to the noise source, and becomes maximum at an opposite phase. When the acoustic power becomes 0, a current flows more easily as the acoustic resistance disappears.

Figure 4:
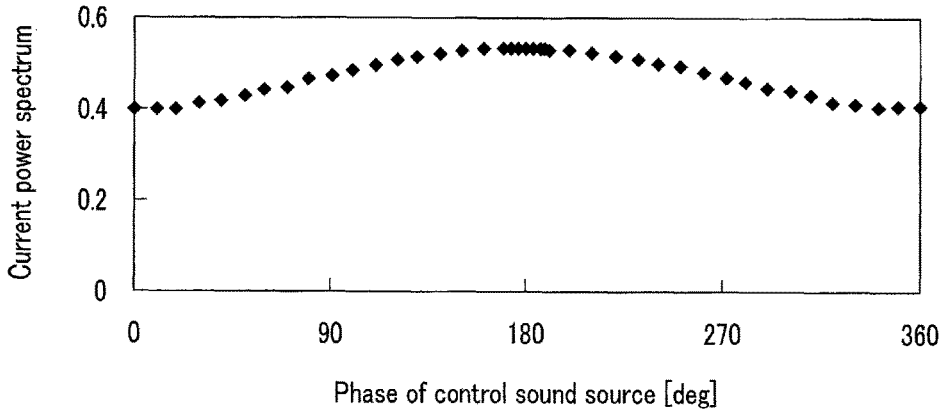
FIG. 4 is a graph showing the relationship between control sound source phase and current.
Figure 5:
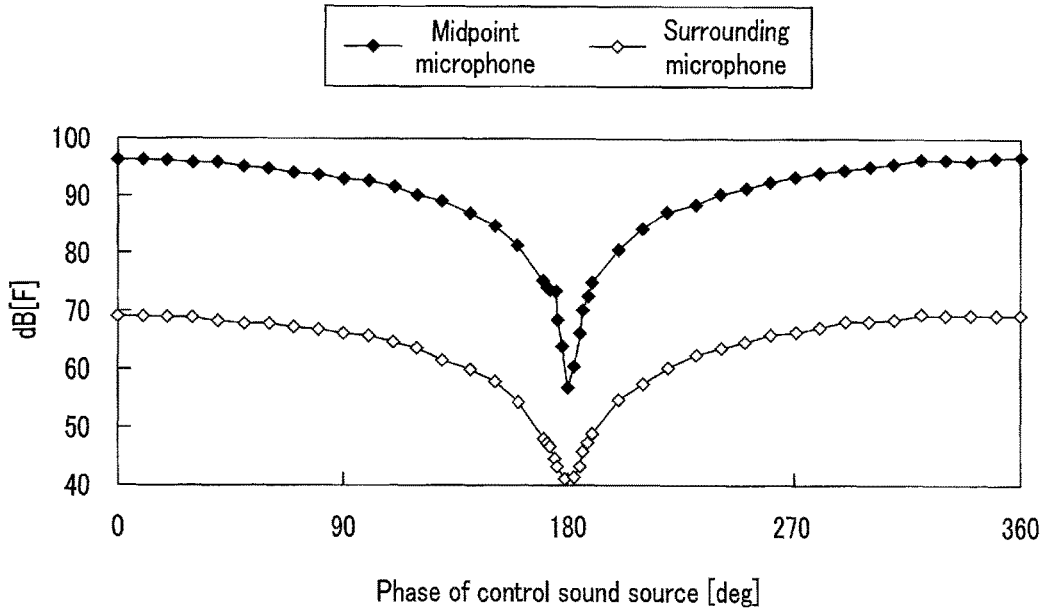
FIG. 5 is a graph showing the relationship between control sound source phase and the sound pressure levels of a midpoint microphone and surrounding microphone.

FIG. 4 is a graph showing the relationship between the phase of a control sound source and current power spectrum. FIG. 5 is a graph showing the relationship between control sound source phase and the sound pressure levels of a midpoint microphone and surrounding microphone. The abscissa and ordinate of FIG. 4 are respectively defined as the phase [deg] of the control sound source and a current power spectrum I·I*. The abscissa and ordinate of FIG. 5 are respectively defined as the phase [deg] of the control sound source and a sound pressure level dB [F]. The midpoint microphone is a microphone provided at the midpoint between the noise source loudspeaker and the control sound source loudspeaker. The surrounding microphone is a microphone provided around the noise source loudspeaker and the control sound source loudspeaker. As shown in FIGS. 4 and 5, at an opposite phase, the current becomes maximum, and the sound pressure becomes minimum.

The noise reduction apparatus 1 can minimize the acoustic power using the composite sound of a control sound from the first control loudspeaker 15 and a control sound from the second control loudspeaker 21 by adjusting the first control filter 13 and the second control filter 19 so as to make the total current amplitude have the maximum value. In this case, using the first control loudspeaker 15 and the second control loudspeaker 21 can generate a composite sound having directivity adapting to the directivity of noise from the noise source 10, thereby performing suitable noise reduction control corresponding to the directivity of noise from the noise source as compared with the case using a single loudspeaker.

Adjustment processing for the amplitudes and phases of the first and second control sounds by the noise reduction apparatus 1 according to the first embodiment will be described next.

Figure 6:
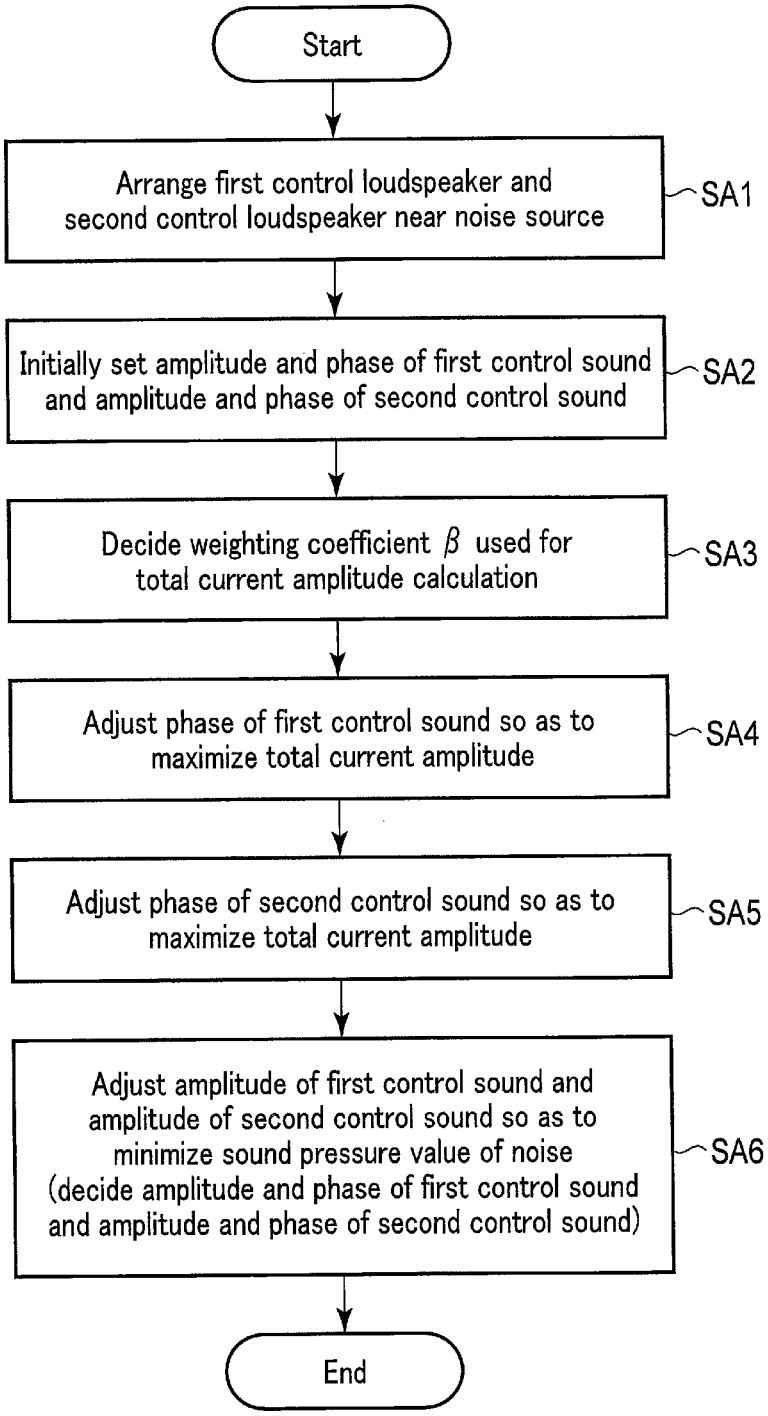
FIG. 6 is a flowchart showing a typical procedure for adjustment processing for the amplitudes and phases of first and second control sounds by the noise reduction apparatus according to the first embodiment.

FIG. 6 is a flowchart showing a typical procedure for adjustment processing for the amplitudes and phases of the first and second control sounds by the noise reduction apparatus 1 according to the first embodiment. As shown in FIG. 6, first of all, the first control loudspeaker 15 and the second control loudspeaker 21 are arranged near the noise source 10 (step SA1). More specifically, the first control loudspeaker 15 and the second control loudspeaker 21 are arranged at a distance that allows the generation of a back electromotive current originating from noise generated from the noise source 10.

When step SA1 is performed, the amplitude/phase adjustment unit 35 initially sets the amplitudes and phases of the first and second control sounds (step SA2). In step SA2, the amplitude/phase adjustment unit 35 adjusts the amplitude characteristics of the first and second control filters 13 and 19 so as to make the amplitude of the first control sound and the amplitude of the second control sound almost coincide with the amplitude of noise from the noise source 10. For example, noise meters are respectively arranged at the noise source 10, the first control loudspeaker 15, and the second control loudspeaker 21, and the amplitude change amount of the first control filter 13 and the amplitude change amount of the second control filter 19 are adjusted such that noise pressure values measured by the respective noise meters almost coincide with each other. When a noise pressure value is known, the amplitude change amount of the first control filter 13 and the amplitude change amount of the second control filter 19 may be adjusted to the known value. Note that because the amplitudes of the first and second control sounds are strictly adjusted in and after step SA3, the amplitudes may be set in step SA2 to such a degree that the sound pressures of control sounds interfere with the sound pressure of noise.

In step SA2, the amplitude/phase adjustment unit 35 adjusts the phase characteristics of the first and second control filters 13 and 19 so as to set the phases of the first and second control sounds to arbitrary initial values. Although each initial phase value is not specifically limited, the value may be set to, for example, 0°.

When step SA2 is performed, the total current amplitude calculation unit 33 decides a weighting coefficient β used to calculate a total current amplitude (step SA3). A total current amplitude is an index for evaluating electromotive currents from the first and second control loudspeakers 15 and 21 which originate from noise from the noise source 10. As indicated by equation (24), a total current amplitude J is calculated by weighted addition using the weighting coefficient (3 with an amplitude I1 of the first current detection signal concerning an electromotive current from the first control loudspeaker 15 and an amplitude 12 of the second current detection signal concerning an electromotive current from the second control loudspeaker 21. The weighting coefficient β has a value corresponding to the frequency of noise generated from the noise source 10, the position of the noise source 10, and the distance between the first control loudspeaker 15 and the second control loudspeaker 21.

$$J = I1 \times \beta(\alpha) + I2 \times (1 - \beta(\alpha)) \quad (24)$$

When step SA3 is performed, the amplitude/phase adjustment unit 35 adjusts the phase of the first control sound so as to maximize a total current amplitude (step SA4). In step SA4, the amplitude/phase adjustment unit 35 adjusts the phase of the first control sound based on a reference signal from the reference signal acquisition device 11. A reference signal from the reference signal acquisition device 11 is, for example, a signal concerning the rotational speed of the rotating blade unit mounted on the noise source 10 of the rotating system, which is detected by a rotational speed detector.

Noise contains, for example, a main component (for example, 100 Hz), based on a rotational speed, and its harmonic component (for example, 200 Hz). A phase is adjusted for each component of a noise reduction target. When, for example, the main component is a noise reduction target, the phase of the first control loudspeaker 15 is adjusted with respect to the frequency of the main component. More specifically, first of all, the amplitude/phase adjustment unit 35 adjusts the phase change amount (phase shift amount) of the first control filter 13 so as to change the phase of the first control sound from 0° to 360°. On the other hand, the total current amplitude calculation unit 33 calculates a total current amplitude by using the weighting coefficient β decided in step SA3, for each predetermined phase, based on the first current detection signal from the first current detector 17 and the second current detection signal from the second current detector 23 according to equation (24). The total current amplitude calculation unit 33 compares a total current amplitude for each predetermined phase and searches for a phase in which the total current amplitude has the maximum value. Subsequently, the amplitude/phase adjustment unit 35 adjusts the phase change amount of the first control filter 13 so as to make a specific phase coincide with the phase of the first control sound. The phase change amount of the first control filter 13 is fixed to this phase change amount.

When step SA4 is performed, the amplitude/phase adjustment unit 35 adjusts the phase of the second control sound so as to maximize the total current amplitude (step SA5). In step SA5, the amplitude/phase adjustment unit 35 adjusts the phase of the second control sound by performing the same processing as that in step SA4. More specifically, the amplitude/phase adjustment unit 35 adjusts the phase change amount (phase shift amount) of the second control filter 19 so as to change the phase of the second control sound from 0° to 360°. In this case, the phase of the first control sound is fixed to the phase specified in step SA4. The total current amplitude calculation unit 33 calculates a total current amplitude by using the weighting coefficient β decided in step SA3, for each predetermined phase, based on the first current detection signal from the first current detector 17 and the second current detection signal from the second current detector 23 according to equation (24). The total current amplitude calculation unit 33 compares a total current amplitude for each predetermined phase and specifies a phase in which the total current amplitude has the maximum value. Subsequently, the amplitude/phase adjustment unit 35 adjusts the phase change amount of the second control filter 19 so as to make the phase of the second control sound coincide with a specific phase. The phase change amount of the second control filter 19 is fixed to this phase change amount.

When step SA5 is performed, the amplitude/phase adjustment unit 35 adjusts the amplitudes of the first and second control sounds so as to minimize the sound pressure value of noise (step SA6). In step SA6, the amplitude/phase adjustment unit 35 individually adjusts the amplitude change amount of the first control filter 13 and the amplitude change amount of the second control filter 19 so as to minimize the sound pressure value measured by the noise meter while the phases of the first and second control sounds are fixed. The amplitude/phase adjustment unit 35 specifies the combination of the amplitude change amount of the first control filter 13 and the amplitude change amount of the second control filter 19 so as to minimize the sound pressure value measured by the noise meter. The amplitude change amount of the first control filter 13 and the amplitude change amount of the second control filter 19 are fixed to the above amplitude change amounts. Performing the processing in step SA1 to step SA6 decides the amplitude and phase of the first control sound and the amplitude and phase of the second control sound.

When step SA6 is performed, the noise reduction apparatus 1 according to the first embodiment finishes adjusting the amplitudes and phases of the first and second control sounds.

Note that the above adjustment processing can be variously changed. For example, in steps SA4 and SA5, the reference signal acquisition device 11 may detect a driving current signal as a reference signal other than the rotational speed or rotational frequency of the rotating blade unit of the noise source 10 of the rotating system. It is possible to adjust the phases of the first and second control sounds with respect to the initial phase of the driving current signal.

The reference signal acquisition device 11 may detect a sound pressure signal from the noise meter as a reference signal. It is possible to adjust the phases of the first and second control sounds with respect to the initial phase of the sound pressure signal.

Figure 7:
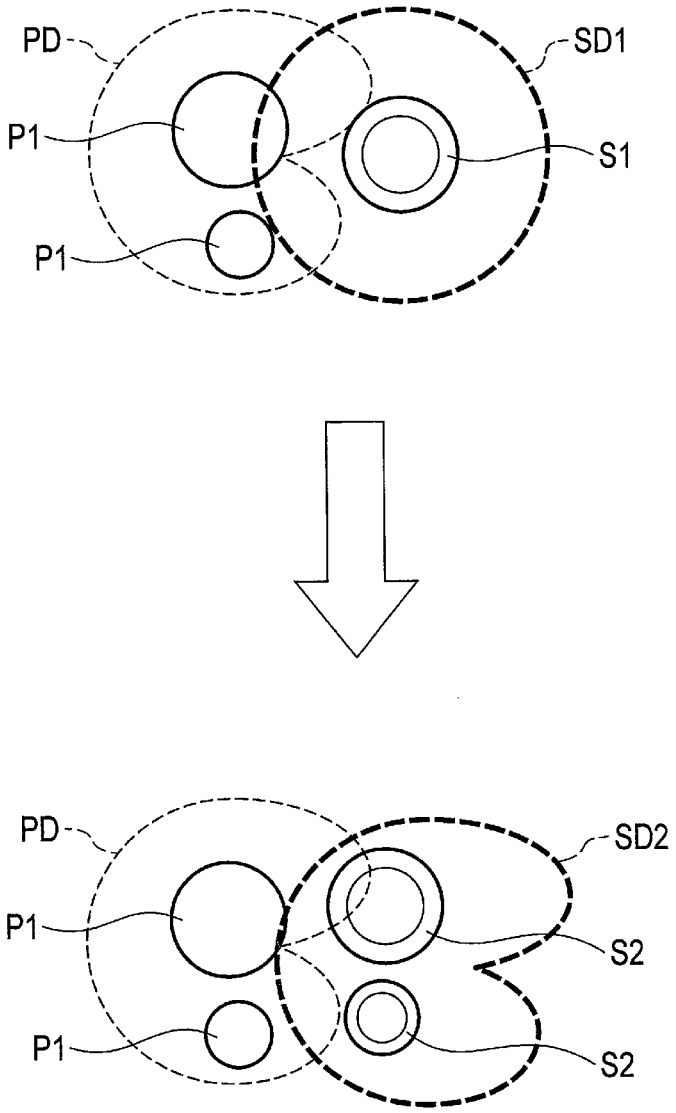
FIG. 7 is a view schematically showing the effect of the noise reduction apparatus according to the first embodiment.

FIG. 7 schematically shows the effect obtained by the noise reduction apparatus 1 according to the first embodiment. The upper view of FIG. 7 shows a directivity PD of noise before adjustment and a directivity SD1 of a control sound. The lower view of FIG. 7 shows the directivity PD of the noise after adjustment and a directivity SD2 of a control sound.

As described above, the noise reduction apparatus according to the first embodiment includes the first control loudspeaker 15, the first current detector 17, the second control loudspeaker 21, the second current detector 23, and the processing circuit 25. The first control loudspeaker 15 generates the first control sound for reducing noise from the noise source. The first current detector 17 detects the first current flowing from the first control loudspeaker 15 upon reception of noise from the noise source. The second control loudspeaker 21 is provided at a position different from that of the first control loudspeaker 15, and generates the second control sound for reducing noise from the noise source. The second current detector 23 detects the second current flowing from the second control loudspeaker 21 upon reception of noise from the noise source. The processing circuit 25 adjusts the first and second control sounds so as to make the first and second currents satisfy predetermined conditions. More specifically, the total current amplitude calculation unit 33 of the processing circuit 25 calculates a total current amplitude by weighted addition of the amplitudes of the first and second currents in accordance with the weighting coefficient β. The amplitude/phase adjustment unit 35 of the processing circuit 25 adjusts at least one of the amplitude and phase of the first control sound and at least one of the amplitude and phase of the second control sound so as to make the total current amplitude take the maximum value.

According to the above arrangement, the noise reduction apparatus 1 includes the two loudspeaker systems and hence can add directivity to the composite control sound of the first control sound from the first control loudspeaker 15 and the second control sound from the second control loudspeaker 21. Having the two loudspeaker systems allows the noise reduction apparatus 1 to make the directivity SD2 of the composite control sound follow the directivity PD of noise from a noise source P1, as shown in FIG. 7, even if the directivity PD is unknown, by adjusting the amplitudes and phases of the first and second control sounds using back electromotive currents. This minimizes the acoustic power in a noise reduction space, and hence can improve the effect of noise reduction control as compared with a noise reduction apparatus using a single control loudspeaker.

When there are a plurality of sound sources with complex amplitudes, a general noise reduction method for an overall space using a sound source group is performed in the following procedure. First of all, the radiation characteristics of noise sources in a noise reduction space are adjusted by using microphones. The optimal positions of loudspeakers are then derived based on the sound pressures measured by the microphones. The acoustic power of noise in the noise reduction space is simultaneously reduced by placing the loudspeakers at the derived positions. This requires an engineering skill and takes time and effort. In particular, some type of noise initially has a form of opposite phase radiation. If a control sound source is installed in this state, noise increases. This also indicates the necessity to perform a check by analysis in advance.

As described above, the noise reduction apparatus 1 according to this embodiment adjusts the amplitudes and phases of the first and second control sounds based on back electromotive currents from the first and second control loudspeakers 15 and 21. That is, the noise reduction apparatus 1 according to the embodiment does not always require a microphone for collecting noise from the noise source 10. The above arrangement allows the noise reduction apparatus 1 to reduce acoustic power stepwise by sequentially adding (sequentially updating a control rule) control sound sources.

Figure 8:
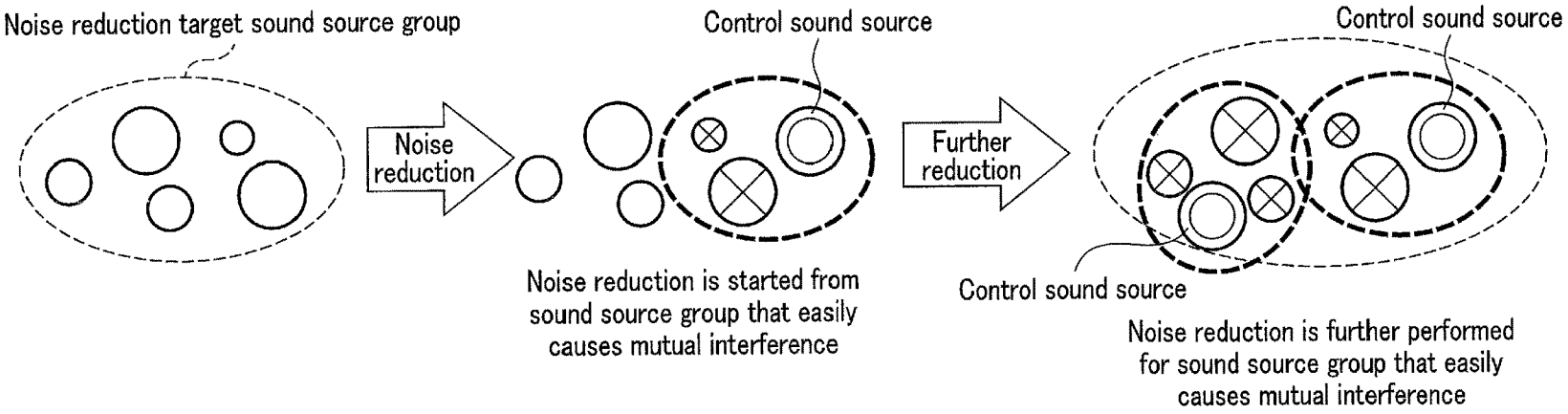
FIG. 8 is a view schematically showing noise reduction control by sequentially adding control sound sources.

FIG. 8 schematically shows noise reduction control by sequential addition of control sound sources. Consider a case in which there are a plurality of noise reduction target sound sources with complex amplitudes, as indicated by the left view of FIG. 8. As indicated by the intermediate view of FIG. 8, in the case of acoustic power minimization control according to this embodiment, a plurality of control sound sources are not placed in advance, but one control sound source is arranged. This control sound source partially reduces the acoustic power of noise from a noise source, of a noise source group, which can cause acoustic interference. As indicated by the right view of FIG. 8, other control sound sources are sequentially added near noise sources, whose noise has not been reduced, to gradually reduce the acoustic power of noise in a noise reduction target space. This operation is allowed because an amplitude to be provided by acoustic power control is always optimal in the corresponding state. Because control sound sources can be sequentially added, the noise reduction apparatus according to this embodiment can be added to a noise reduction system after it is constructed. This makes it possible to perform intuitive space design with future prospects.

The control effect of noise reduction control by the noise reduction apparatus 1 according to the first embodiment is verified by predictive calculation.

Figure 9:
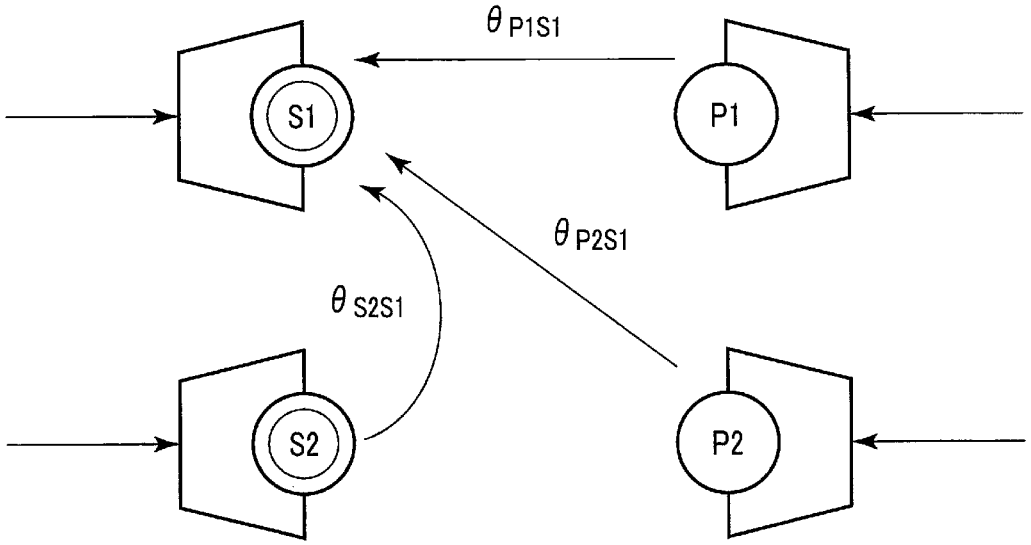
FIG. 9 is a view showing the placement of dipole noise sources P1 and P2 and control sound sources S1 and S2.

FIG. 9 shows the placement of dipole noise sources P1 and P2 and control sound sources S1 and S2. A voltage $E_{P1}$ of the first noise source P1 is written as equation (25), and an external force $F_{P1}$ is written as equation (26):

$$E_{P1}=(Z_{0E,P1}+Z_{E,P1})\cdot I_{P1}+A_{P1}\cdot V_{P1} \tag{25}$$

$$F_{P1}=-A_{P1}I_{P1}+(Z_{0M,P1}+Z_{M,P1})V_{P1} \tag{26}$$

A voltage $E_{S1}$ of the first control sound source S1 is written by equation (27), and an external force $F_{S1}$ is written by equation (28):

$$E_{S1}=(Z_{0E,S1}+Z_{E,S1})\cdot I_{S1}+A_{S1}\cdot V_{S1} \tag{27}$$

$$F_{S1}=-A_{S1}I_{S1}+(Z_{0M,S1}+Z_{M,S1})V_{S1} \tag{28}$$

A crosstalk term is introduced for external force $F_{S1}$=acoustic excitation, as indicated by equation (29):

$$F_{S1}=Z_{P1S1}\cdot V_{P1}+Z_{P2S1}\cdot V_{P2}+Z_{S2S1}\cdot V_{S2} \tag{29}$$

When a vibration velocity $V_{S1}$ of the first control loudspeaker is eliminated, a current $I_{S1}$ of the first control sound source is written as equation (30) given below:

$$\begin{aligned} I_{S1} &= \frac{A_{S1}}{A_{S1}^2+(Z_{0E,S1}+Z_{E,S1})(Z_{0M,S1}+Z_{M,S1})}(E_{S1}-F_{S1}) \\ &= \gamma_1(E_{S1}-(Z_{P1S1}\cdot V_{P1}+Z_{P2S1}\cdot V_{P2}+Z_{S2S1}\cdot V_{S2})) \\ &= \gamma_1(E_{S1}-Z_{P1S1}|V_{P1}|\cos\theta_{P1S1}-Z_{P2S1}|V_{P2}|\cos\theta_{P2S1}- \\ &\quad Z_{S2S1}|V_{S2}|\cos\theta_{S2S1}) \end{aligned} \tag{30}$$

-continued $$\gamma_1=\frac{A_{S1}}{A_{S1}^2+(Z_{0E,S1}+Z_{E,S1})(Z_{0M,S1}+Z_{M,S1})}$$

$$Z_{P1S1}=\frac{\rho j\omega}{4\pi r_{P1S1}}e^{-jkr_{P1S1}},\ Z_{P2S1}=\frac{\rho j\omega}{4\pi r_{P2P1}}e^{-jkr_{P2S1}}$$

where cos $\theta_{P1,S1}$ is the phase difference of the noise source P1 with respect to the first control loudspeaker S1, cos $\theta_{P2S1}$ is the phase difference of the noise source P2 with respect to the first control loudspeaker S1, and cos $\theta_{P2,S1}$ is the phase difference of the second control loudspeaker S2 with respect to the first control loudspeaker S1.

Figure 10:
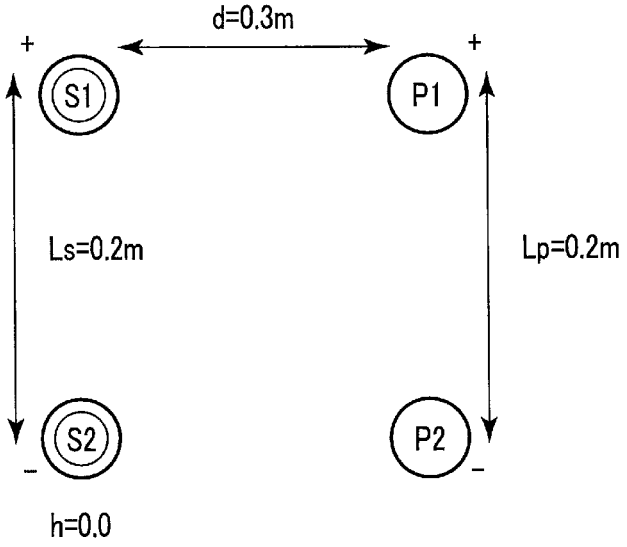
FIG. 10 is a view showing the relationship between control sound sources and noise sources concerning the (1-1)th predictive calculation conditions.

The following are predictive calculation examples based on several calculation conditions. FIG. 10 shows the relationship between control sound sources and noise sources concerning the (1-1)th predictive calculation conditions. As shown in FIG. 10, the dipole noise sources P1 and P2 each have frequency=200 Hz, the noise sources P1 and P2 have interval Lp=0.2 m, the control loudspeakers S1 and S2 have interval Ls=0.2 m, the noise sources P1 and P2 and the control loudspeakers S1 and S2 have interval d=0.3 m, the noise source P1 has phase=0°, and the noise source P2 has phase=180°. In addition, assume that vibration velocity Vp1=Vp2=Vs1=Vs2. A current power spectrum I*I' was calculated under the first predictive calculation conditions.

Figure 11:
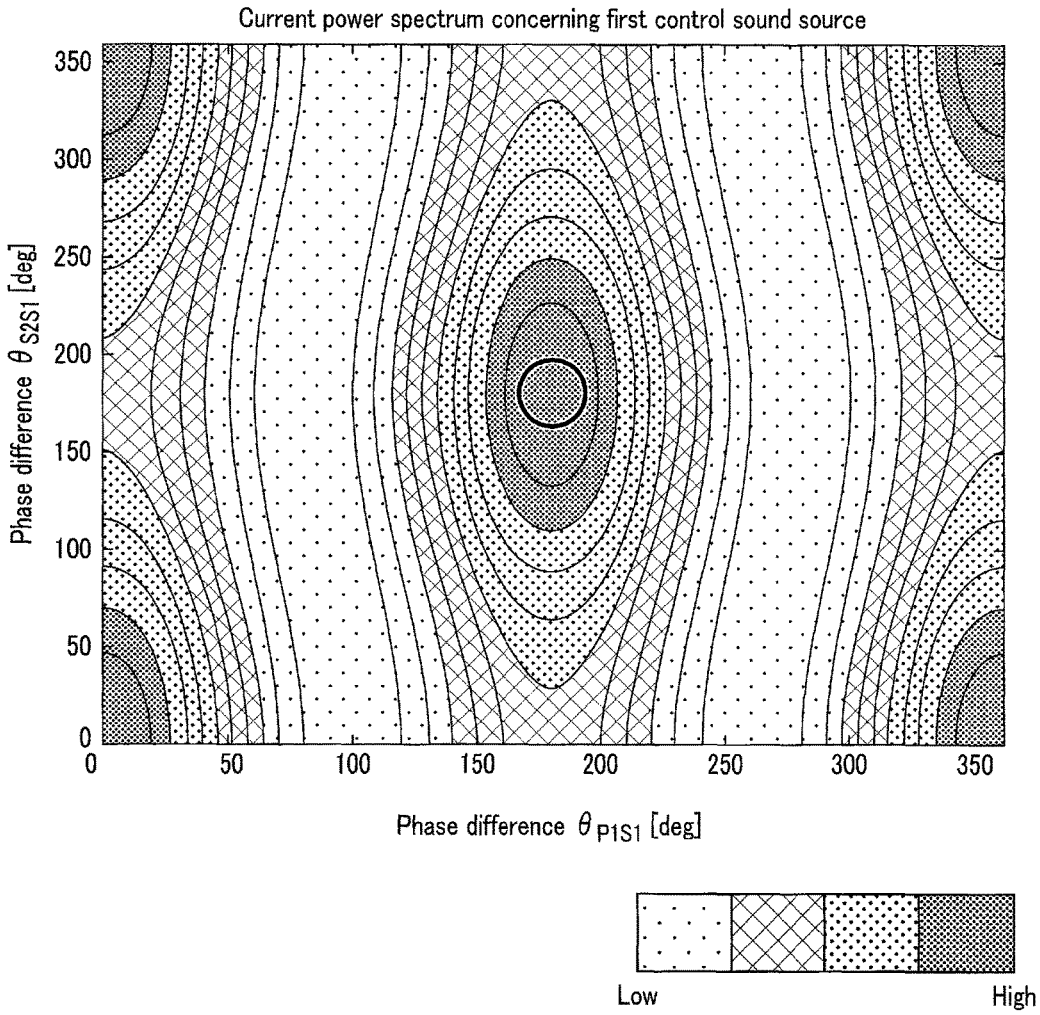
FIG. 11 is a graph showing a current power spectrum distribution concerning the first control sound source S1 calculated under the (1-1)th predictive calculation conditions shown in FIG. 10.

FIG. 11 is a graph showing a current power spectrum distribution concerning the first control sound source S1 calculated under the (1-1)th predictive calculation conditions shown in FIG. 10. The abscissa and ordinate of FIG. 11 are respectively defined as a phase difference $\theta_{P1S1}$ [deg] between the noise source P1 and the control sound source S1, and a phase difference $\theta_{S2S1}$ [deg] between the first control sound source S1 and the control sound source S2. FIG. 11 obviously indicates that when both the phase difference between the noise source P1 and the control sound source S1 and the phase difference between the control sound source S1 and the control sound source S2 become opposite phases, the maximum current appears.

Figure 12:
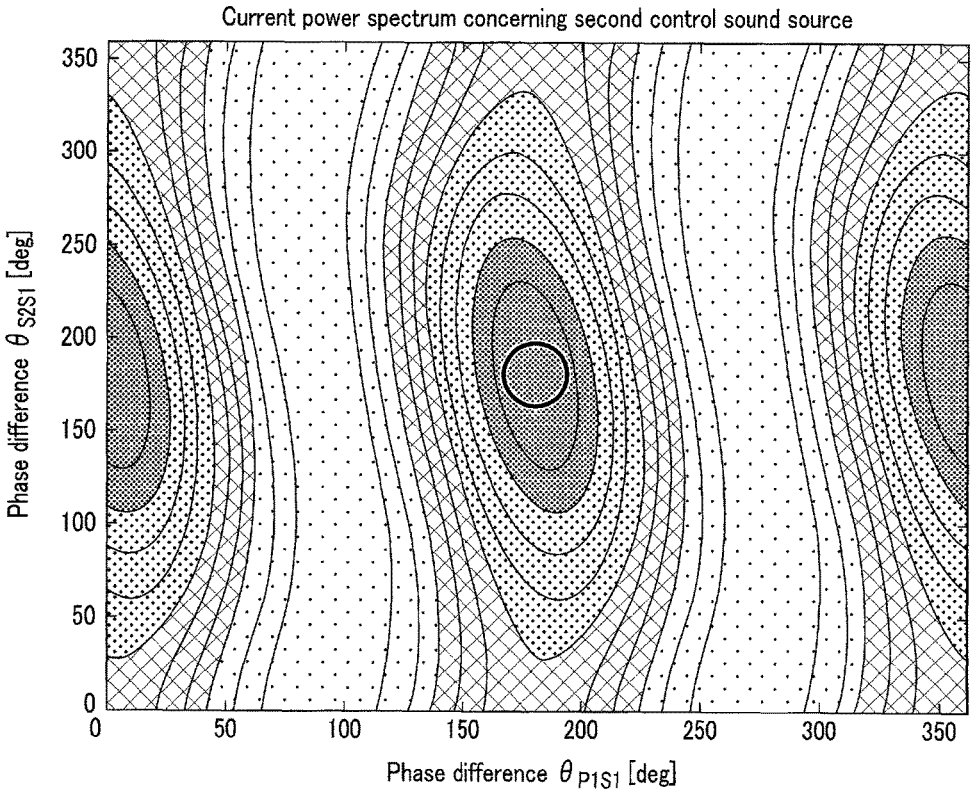
FIG. 12 is a graph showing a current power spectrum distribution concerning the second control sound source calculated under the (1-1)th predictive calculation conditions shown in FIG. 10.

FIG. 12 is a graph showing a current power spectrum distribution concerning the second control sound source S2 calculated under the (1-1)th predictive calculation conditions shown in FIG. 10. Like FIG. 11, FIG. 12 indicates that when both the phase difference between the noise source P1 and the control sound source S1 and the phase difference between the control sound source S1 and the control sound source S2 become opposite phases, the maximum current appears. This also indicates that because when dipole sound sources are formed, acoustic powers are minimized, it is preferable to implement current maximization.

Figure 13:
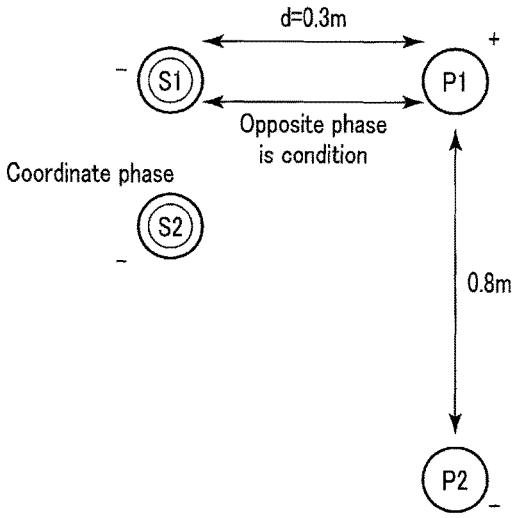
FIG. 13 is a view showing the relationship between control sound sources and noise sources concerning the (1-2)th predictive calculation conditions.

FIG. 13 shows the relationship between control sound sources and noise sources concerning the (1-2)th predictive calculation conditions. As shown in FIG. 13, the dipole noise sources P1 and P2 each have frequency=200 Hz, the noise sources P1 and P2 have interval Lp=0.8 m, the control loudspeakers S1 and S2 have interval Ls=0.2 m, the noise sources P1 and P2 and the control loudspeakers S1 and S2 have interval d=0.3 m, the noise source P1 has phase=0°, and the noise source P2 has phase=180°. In addition, assume that vibration velocity Vp1=Vp2=Vs1=Vs2. A current power spectrum I*I' was calculated under the second predictive calculation conditions. The second predictive calculation conditions differ in only Lp from the first predictive calculation conditions.

Figure 14:
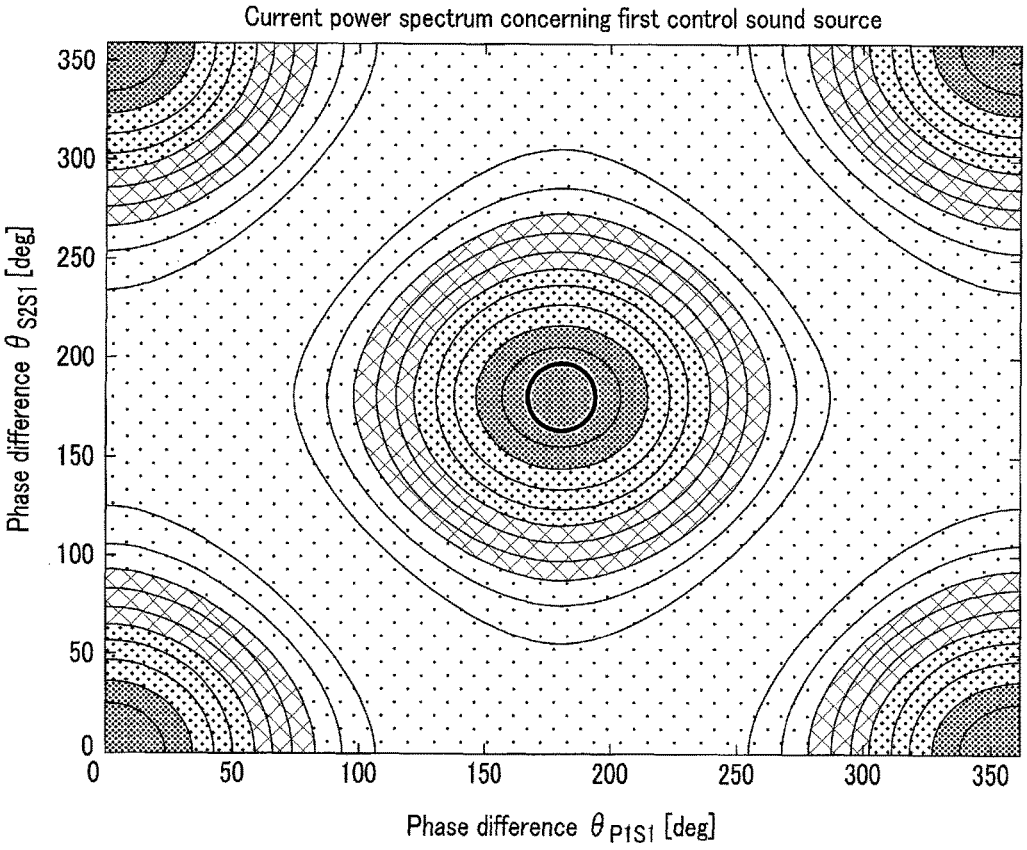
FIG. 14 is a graph showing a current power spectrum distribution concerning the first control sound source calculated under the (1-2)th predictive calculation conditions shown in FIG. 13.
Figure 15:
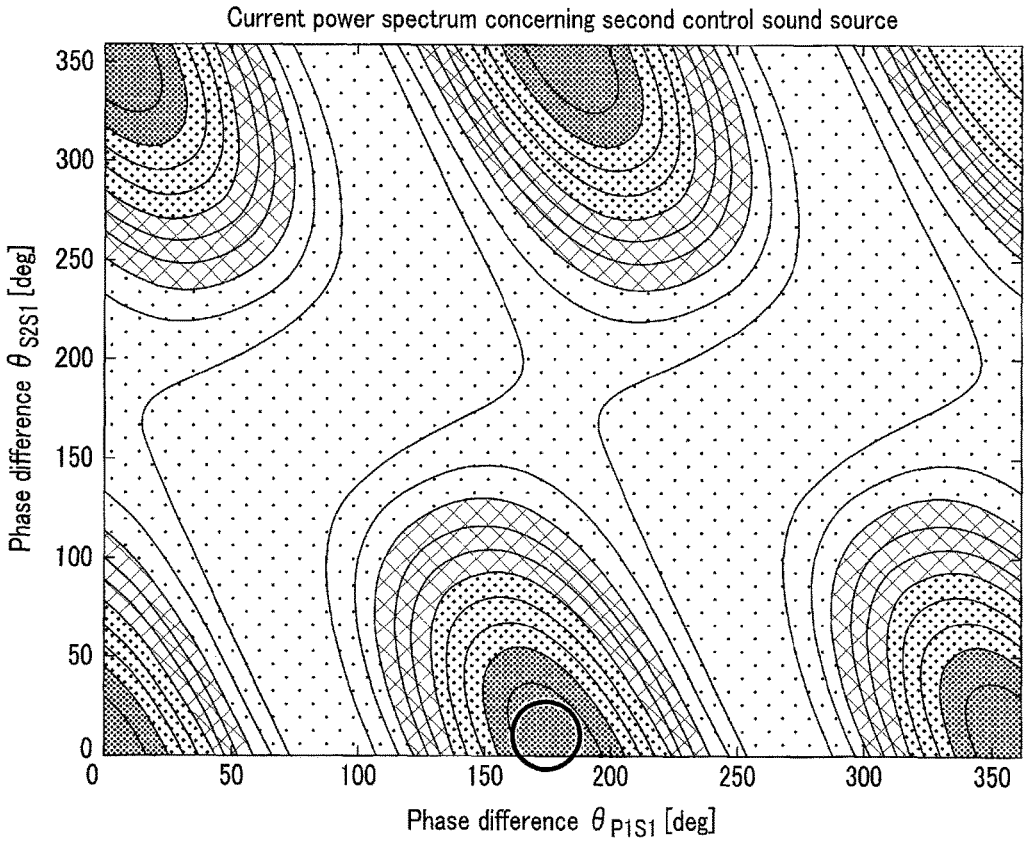
FIG. 15 is a graph showing a current power spectrum distribution concerning the second control sound source calculated under the (1-2)th predictive calculation conditions shown in FIG. 13.

FIG. 14 is a graph showing a current power spectrum distribution concerning the first control sound source S1 calculated under the (1-2)th predictive calculation conditions shown in FIG. 13. Obviously, when both the phase difference between the noise source P1 and the control sound source S1 and the phase difference between the control sound source S1 and the control sound source S2 become opposite phases, the maximum current appears. FIG. 15 is a graph showing a current power spectrum distribution concerning the second control sound source S2 calculated under the (1-2)th predictive calculation conditions shown in FIG. 13. When the phase difference between the noise source P1 and the control sound source S1 remains an opposite phase and the phase difference between the control sound source S1 and the control sound source S2 is a coordinate phase, the maximum current appears.

This is also a characteristic of the acoustic power control described with reference to FIG. 8. Because the noise source P2 is distant from the two control sound sources S1 and S2, the interference effect weakens. As a result, the two control sound sources S1 and S2 serve to control only nearby noise source P1. Accordingly, the reduction effect is higher when both the two control sound sources S1 and S2 have opposite phases with respect to the phase (0°) of the noise source P1, that is, the control sound sources S1 and S2 are in phase, than when they are in opposite phase. The above predictive calculation indicates that the noise reduction apparatus 1 automatically execute current control.

Figure 16:
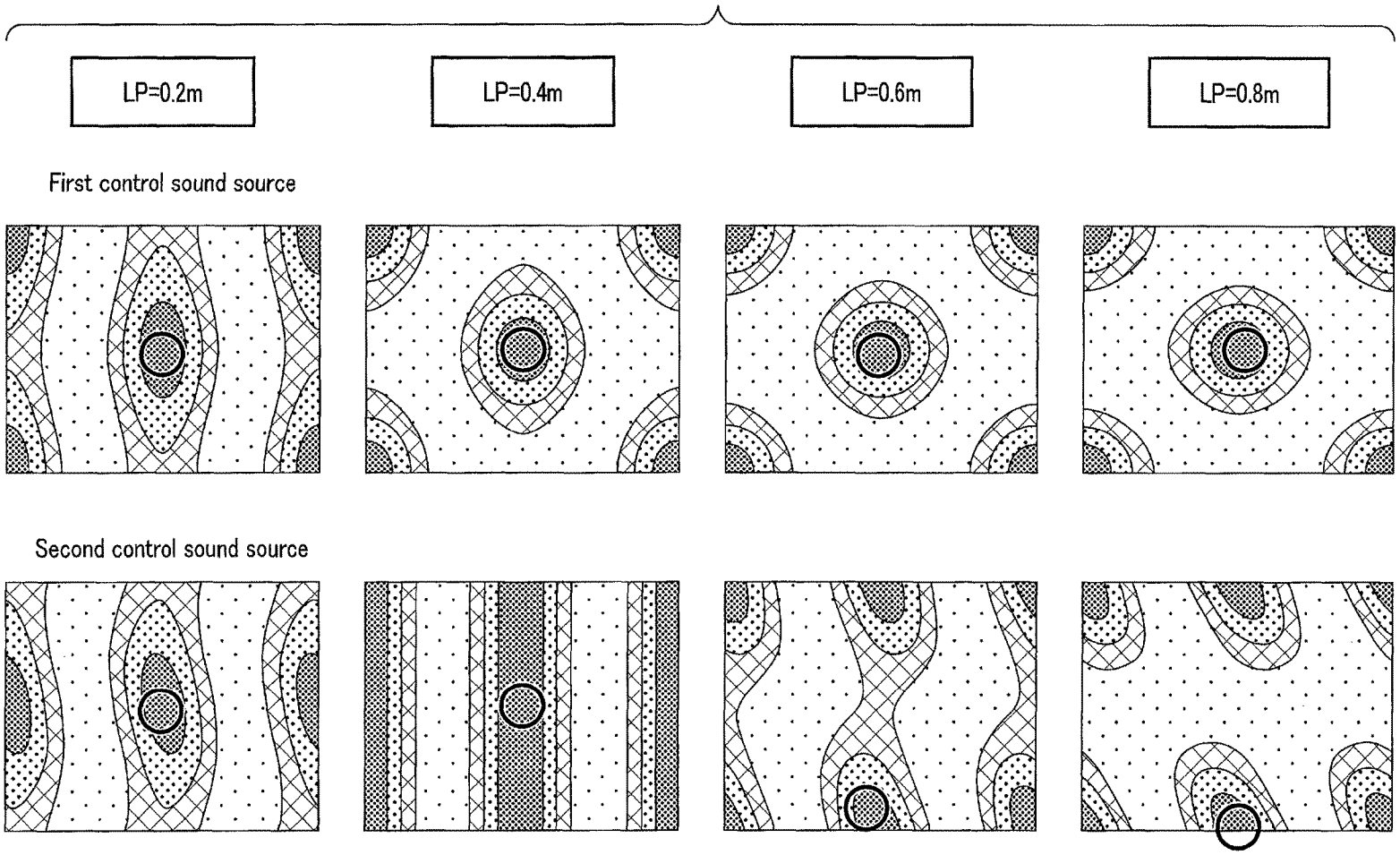
FIG. 16 is a view showing the transition of current power spectrum distributions when only the interval between two noise sources is changed.
Figure 17:
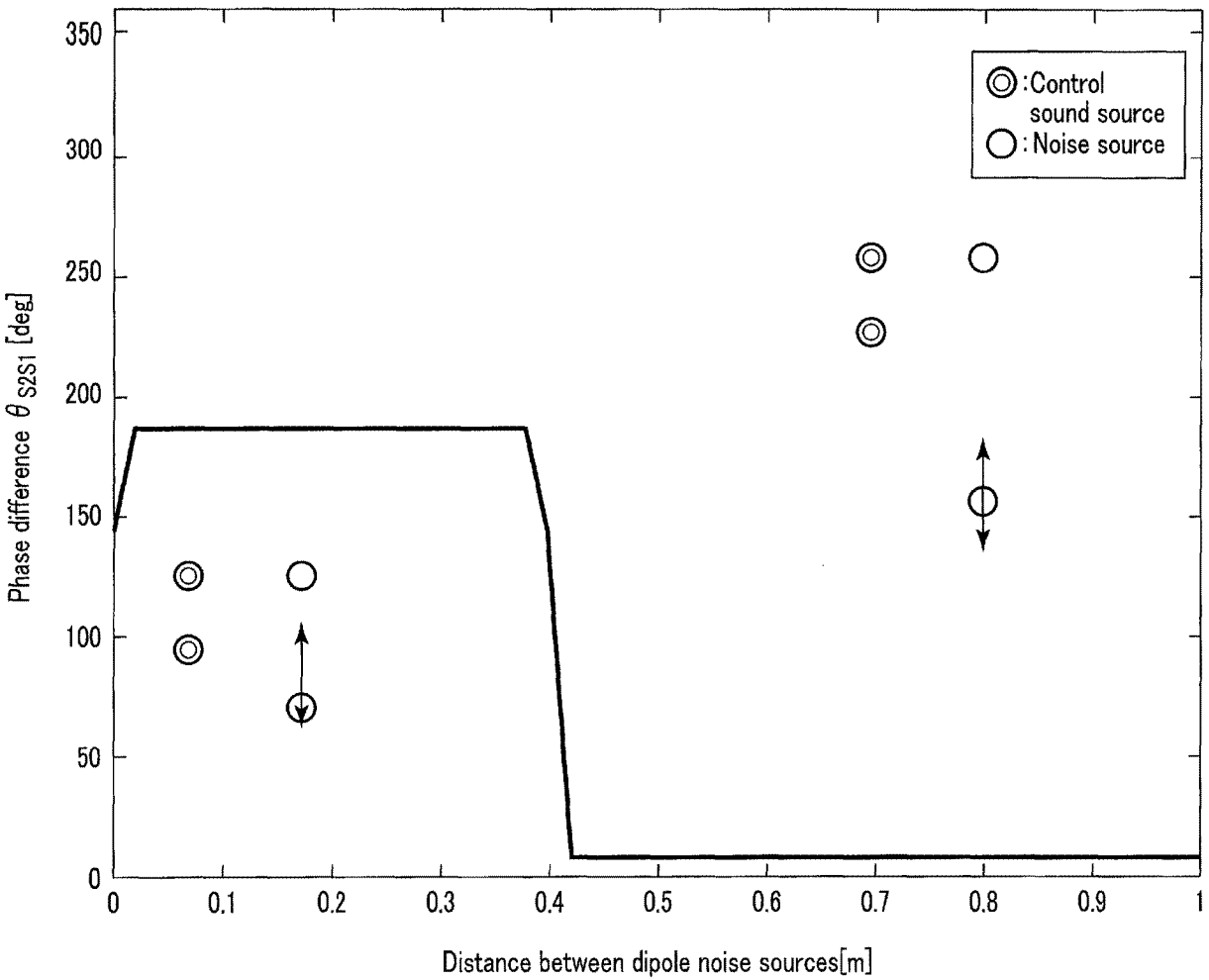
FIG. 17 is a graph showing a change in phase difference $\theta_{S2S1}$ with a change in the distance between dipole noise sources.

FIG. 16 is a view showing the transition of current power spectrum distributions when only an interval Lp between the two noise sources P1 and P2 is changed. The upper views of FIG. 16 show current power spectrum distributions concerning the first control sound source S1. The lower views of FIG. 16 show current power spectrum distributions concerning the second control sound source S2. The ordinate and abscissa of each current power spectrum distribution are respectively defined as the phase difference $\theta_{S2S1}$ [deg] of the second control sound source S2 with respect to the first control sound source S1 and the phase difference $\theta_{P1S1}$ [deg] of the noise source P1 with respect to the first control sound source S1. FIG. 17 is a graph showing a change in the phase difference $\theta_{S2S1}$ of the second control sound source S2 with respect to the first control sound source S1 accompanying a change in the distance between the dipole noise sources (the distance between the first noise source P1 and the second noise source P2). Referring to FIG. 17, the abscissa is defined as the interval Lp between the noise sources, and the ordinate is defined as the phase difference $\theta_{S2S1}$ when the maximum current flows in the second control sound source. As shown in FIGS. 16 and 17, the opposite phase changes to the coordinate phase at Lp=0.4 m.

Figure 18:
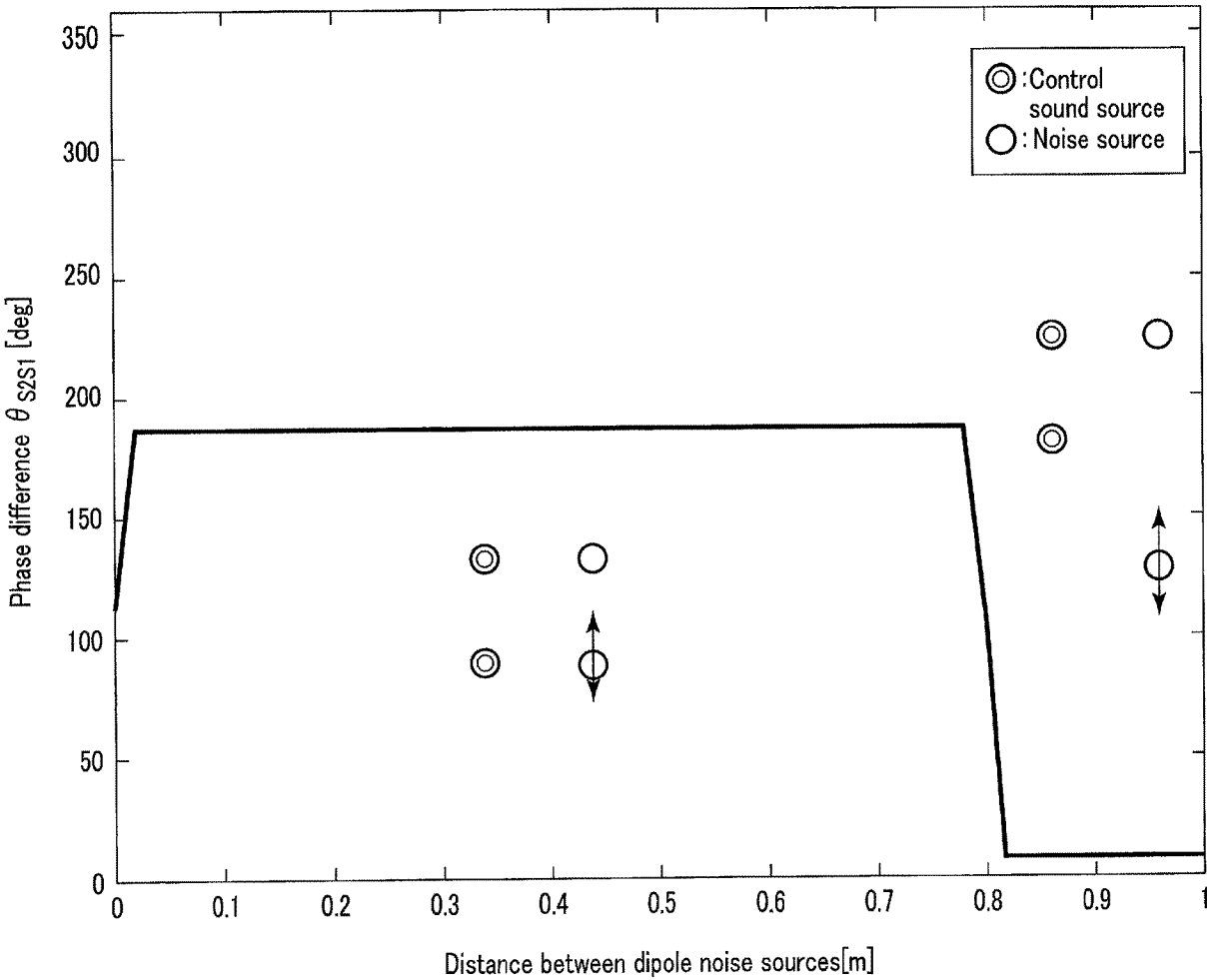
FIG. 18 is another graph showing a change in phase difference $\theta_{S2S1}$ with a change in the distance between dipole noise sources.

FIG. 18 is a graph showing a change in the phase difference $\theta_{S2S1}$ of the second control sound source S2 with respect to the first control sound source S1 with a change in the distance between the dipole noise sources (the distance between the first noise source P1 and the second noise source P2) when the interval between the two control sound sources S1 and S2 is changed from Ls=0.2 m to 0.4 m. FIG. 18 obviously indicates that when the second control sound source S2 approaches the second noise source P2, the threshold for phase inversion increases from Lp=0.4 m to 0.8 m.

Figure 19:
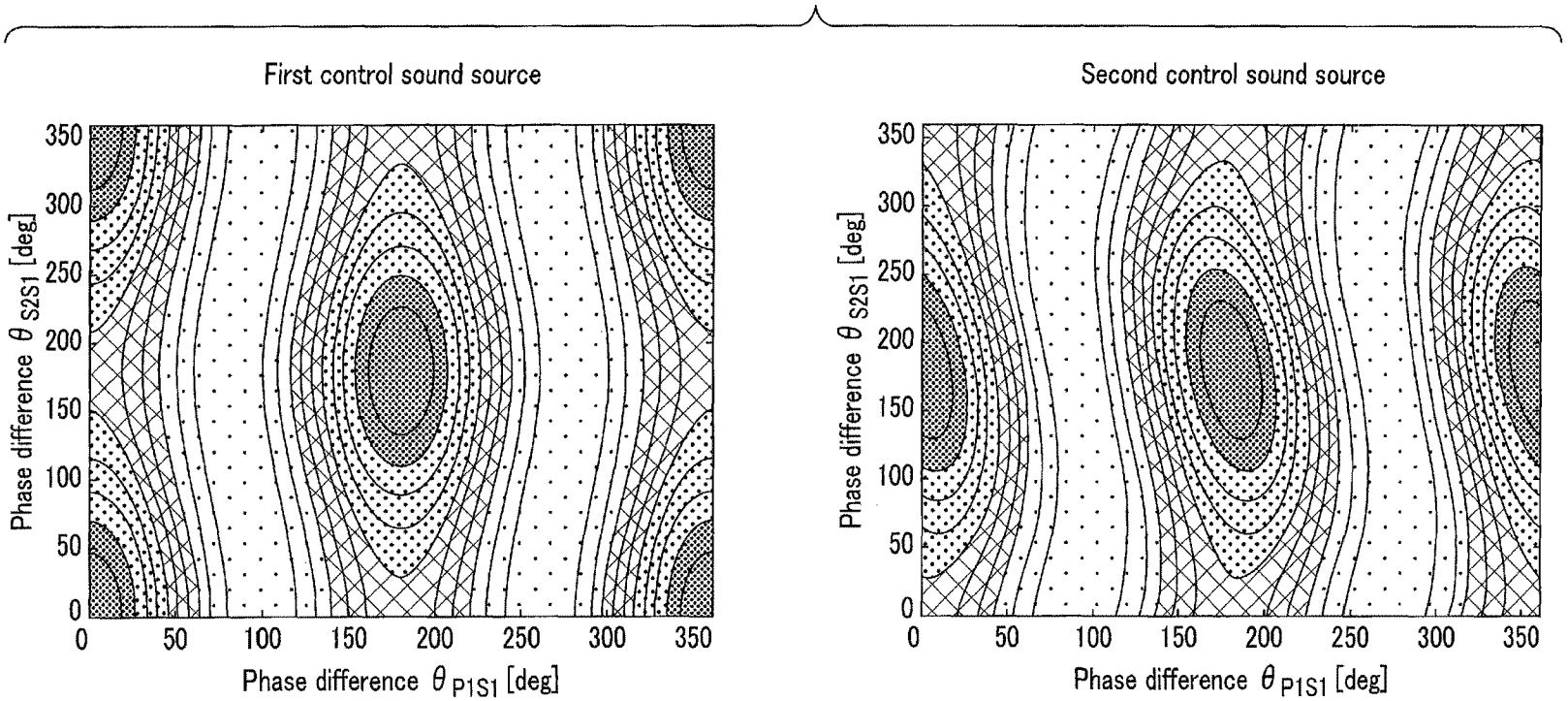
FIG. 19 shows graphs showing current power spectrum distributions concerning first and second control sound sources which are predictively calculated under the noise source phase conditions shown in FIGS. 11 and 12.

The noise source phase conditions shown in FIGS. 11 and 12 are first noise source=0° and second noise source=180°. FIG. 19 shows graphs showing current power spectrum distributions concerning first and second control sound sources which are predictively calculated under the noise source phase conditions shown in FIGS. 11 and 12. FIG. 19 shows the phases of the first and second control sound sources when the current power spectra concerning the first and second control sound sources are maximum.

Figure 20:
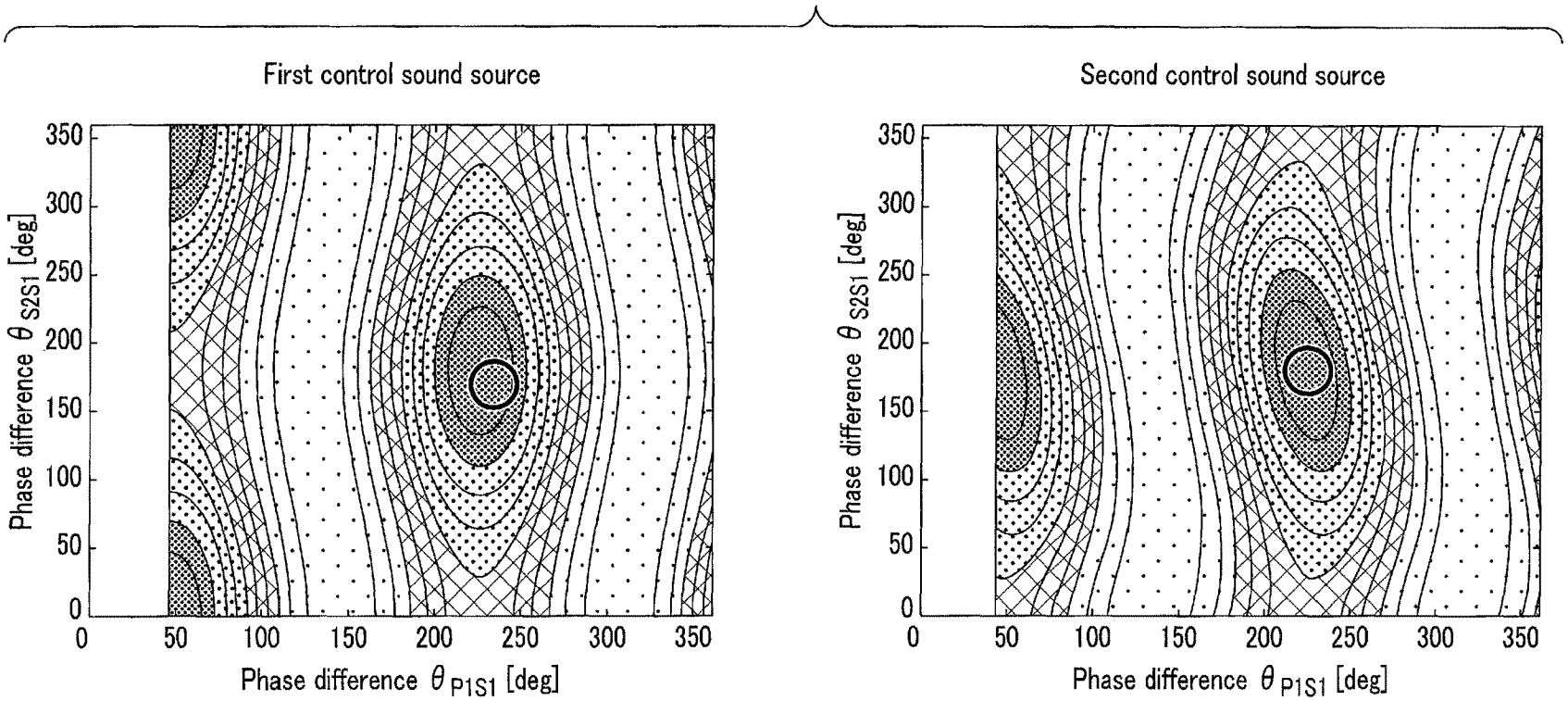
FIG. 20 shows graphs showing current power spectrum distributions concerning first and second control sound sources which are predictively calculated under the noise source phase conditions different from those in FIG. 19.

Referring to FIG. 19, the first noise source and the second control sound source have phase difference=180°, and the first control sound source and the second control sound source have phase difference=180° (first control sound source=180° and second noise source=0°). FIG. 20 shows the results obtained when noise source phase conditions are set as first noise source=45° and second noise source=225°. When the current power spectra concerning the first control sound source and the second control sound source are maximum, the initial phase changes at phase difference=180° between the first noise source and the first control sound source and phase difference=180° between the first control sound source and the second control sound source (first control sound source=225° and second noise source=45°). With regard to actual noise, because the initial phase is unknown, the noise reduction control according to this embodiment is effective.

The placement of the first control loudspeaker 15, the second control loudspeaker 21, and the noise source 10 will be described next.

Figure 21:
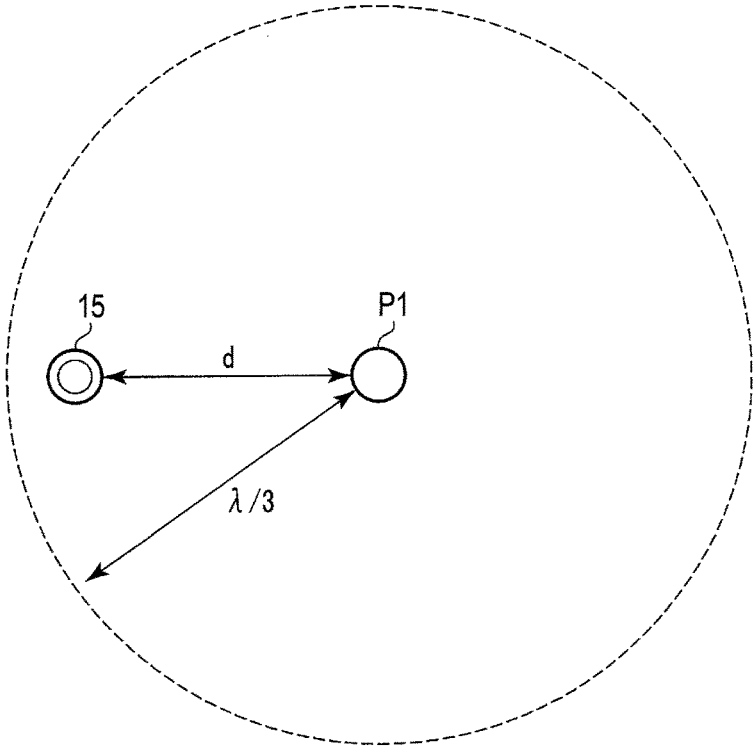
FIG. 21 is a view showing an example of the placement of a first control loudspeaker and a noise source.

FIG. 21 shows an example of the placement of the first control loudspeaker 15 and the noise source P1. As shown in FIG. 21, when λ represents the wavelength of noise generated from the noise source 10, the first control loudspeaker 15 is preferably arranged within λ/3 from the noise source P1. That is, letting d be the distance between the first control loudspeaker 15 and the noise source P1, $d<\lambda/3$. Control sound from the first control loudspeaker 15 interferes with noise from the noise source P1 to reduce acoustic power in the noise reduction target space. Note that the second control loudspeaker 21 that is not shown in FIG. 21 may be or may not be arranged within X13 from the noise source 10.

Figure 22:
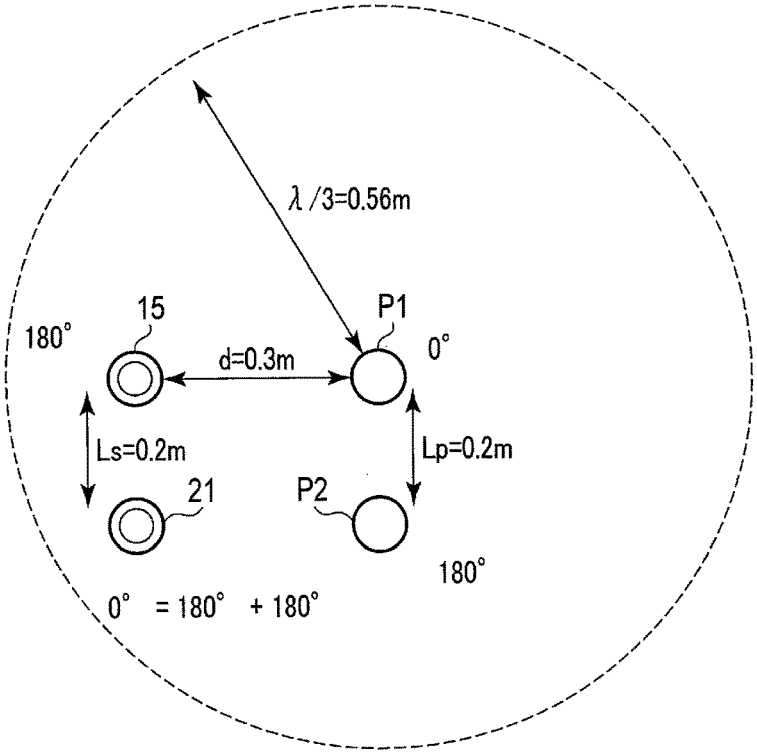
FIG. 22 is a view showing an example of the placement of the first control loudspeaker, a second control loudspeaker, a first noise source, and a second noise source.

FIG. 22 shows an example of the placement of the first control loudspeaker 15, the second control loudspeaker 21, the first noise source P1, and the second noise source P2. As shown in FIG. 22, the first control loudspeaker 15, the second control loudspeaker 21, the first noise source P1, and the second noise source P2 are arranged. Assume that the distance d between the first noise source P1 and the first control loudspeaker 15 is 0.3 m, the distance Ls between the first control loudspeaker 15 and the second control loudspeaker 21 is 0.2 m, and the distance Lp between the first noise source P1 and the second noise source P2 is 0.2 m. In addition, assume that the initial phase of the first noise source P1 is 0°, and the initial phase of the second noise source P2 is 180°. When the frequency of noise generated from the first noise source P1 and the second noise source P2 is 200 Hz under these conditions, λ/3=0.56. In the placement shown in FIG. 22, all the first control loudspeaker 15, the second control loudspeaker 21, and the second noise source P2 are arranged within λ/3 from the first noise source P1. This placement causes control sounds from the first control loudspeaker 15 and the second control loudspeaker 21 to interfere with noise from the first noise source P1 and the second noise source P2, thereby reducing acoustic power in the noise reduction target space.

Figure 23:
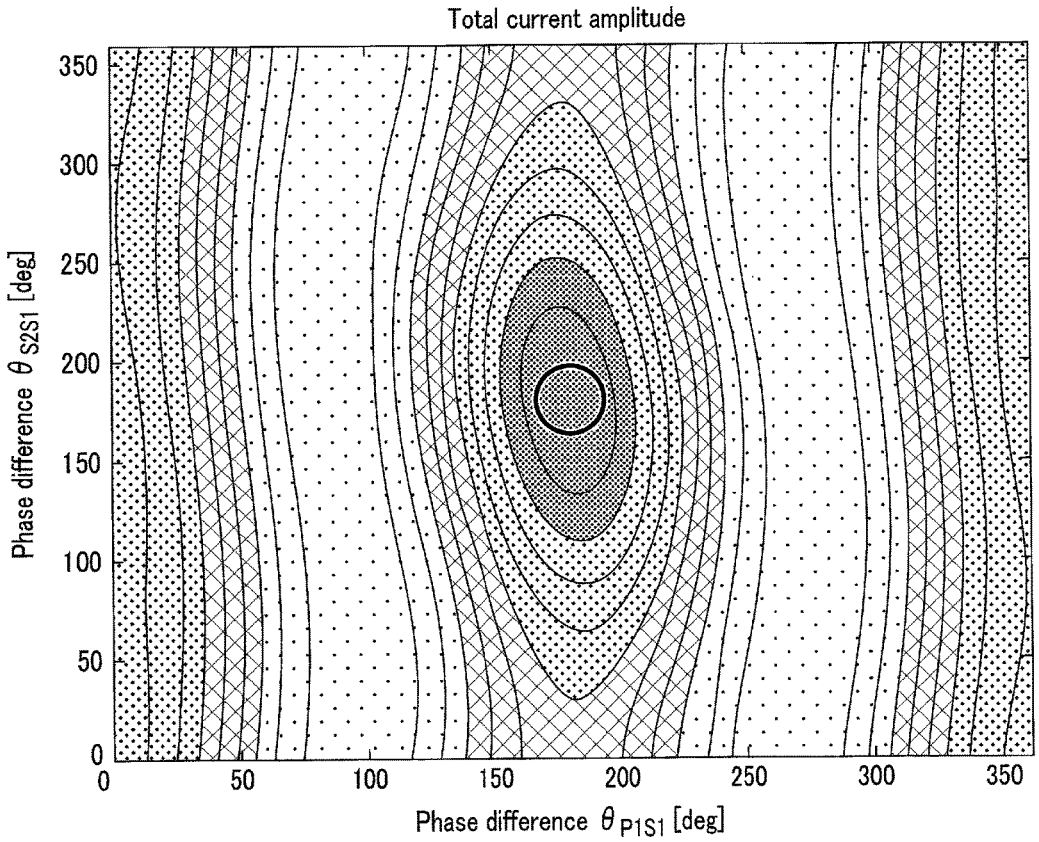
FIG. 23 is a graph showing a total current amplitude distribution in the placement in FIG. 22.

FIG. 23 is a graph showing a total current amplitude distribution in the placement in FIG. 22. The ordinate and abscissa of FIG. 23 are respectively defined as the phase difference [deg] of the second control loudspeaker 21 with respect to the first control loudspeaker 15 and the phase difference [deg] of the first control loudspeaker 15 with respect to the first noise source P1. Note that the weighting coefficient β of a total current amplitude is set to 0.5. As shown in FIG. 23, the phase difference of the first control loudspeaker 15 with respect to the first noise source P1 is decided to be 180° (abscissa), and the phase difference of the second control loudspeaker 21 with respect to the first control loudspeaker 15 is decided to be 180° (ordinate). Accordingly, the phase difference of the first control loudspeaker 15 with respect to the first noise source P1 is decided to be 180° (abscissa)+180° (ordinate)=0°.

Figure 24:
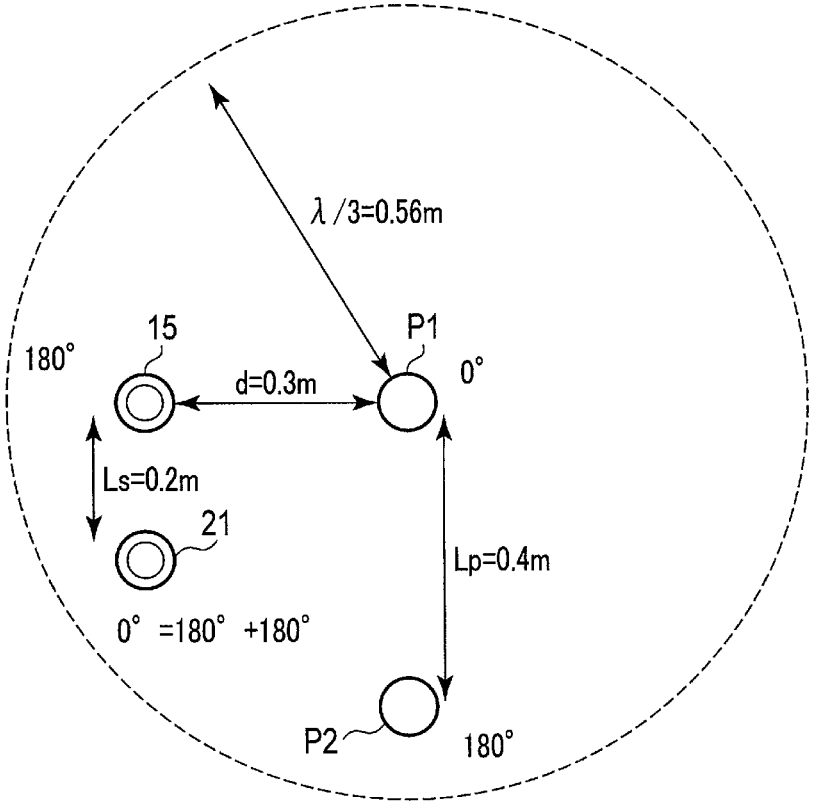
FIG. 24 is a view showing another example of the placement of the first control loudspeaker, the second control loudspeaker, the first noise source, and the second noise source.

FIG. 24 shows another example of the placement of the first control loudspeaker 15, the second control loudspeaker 21, the first noise source P1, and the second noise source P2. As shown in FIG. 24, assume that the distance d is 0.3 m, the distance Ls is 0.2 m, the distance Lp is 0.4 m, the initial phase of the first noise source P1 is 0°, and the initial phase of the second noise source P2 is 180°. When the frequency of noise is 200 Hz under these conditions, $\lambda/3=0.56$. In the placement shown in FIG. 24, all the first control loudspeaker 15, the second control loudspeaker 21, and the second noise source P2 are arranged within $\lambda/3$ from the first noise source P1. This placement causes control sounds from the first control loudspeaker 15 and the second control loudspeaker 21 to interfere with noise from the first noise source P1 and the second noise source P2, thereby reducing acoustic power in the noise reduction target space.

Figure 25:
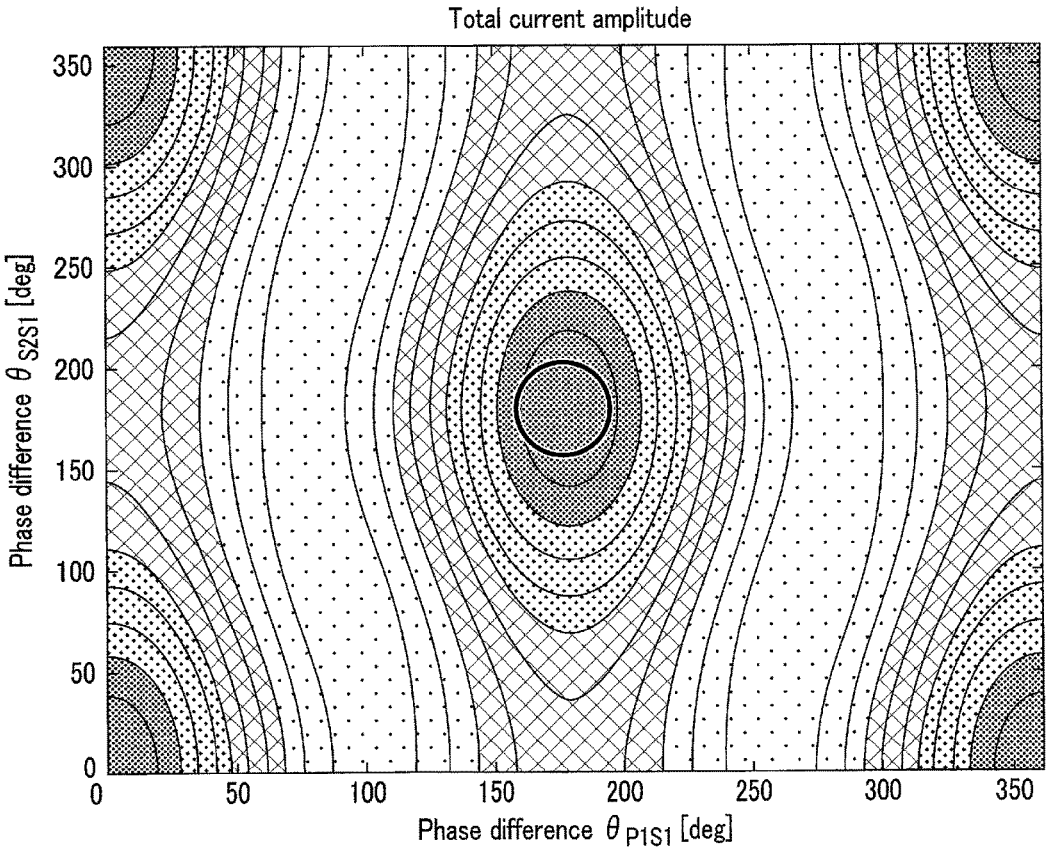
FIG. 25 is a graph showing a total current amplitude distribution in the placement in FIG. 24.

FIG. 25 is a graph showing a total current amplitude distribution in the placement in FIG. 24. The weighting coefficient $\beta$ of a total current amplitude is set to 0.5. As shown in FIG. 25, the phase difference of the first control loudspeaker 15 with respect to the first noise source P1 is decided to be 180° (abscissa), and the phase difference of the second control loudspeaker 21 with respect to the first control loudspeaker 15 is decided to be 180° (ordinate). Accordingly, the phase difference of the first control loudspeaker 15 with respect to the first noise source P1 is decided to be 180° (abscissa)+180° (ordinate)=0°.

Figure 26:
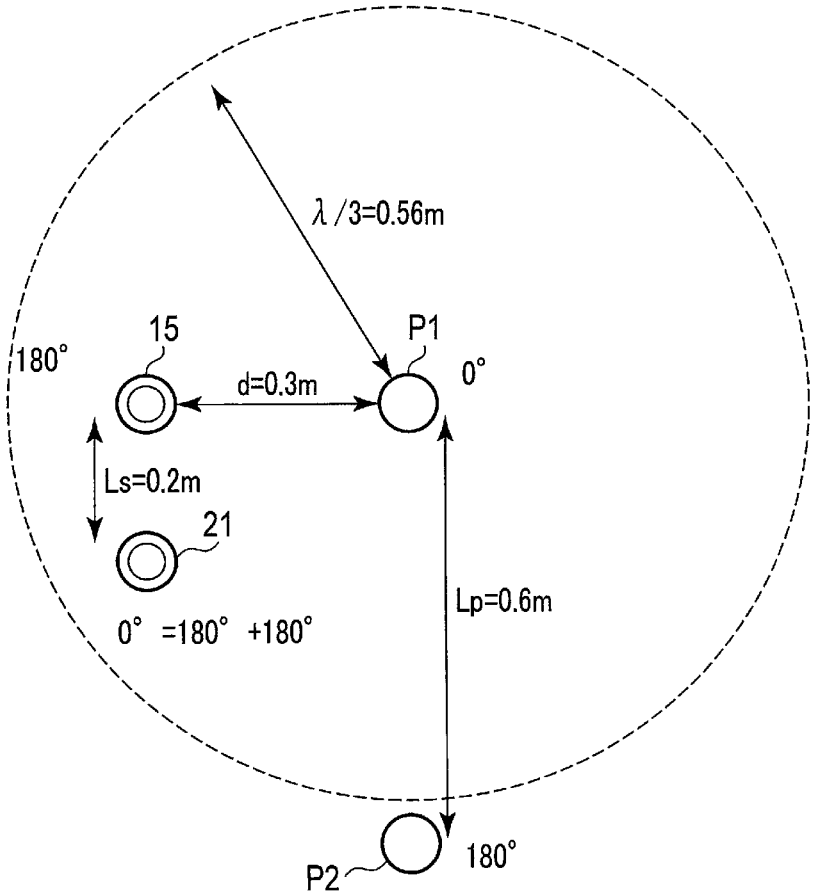
FIG. 26 is a view showing still another example of the placement of the first control loudspeaker, the second control loudspeaker, the first noise source, and the second noise source.

FIG. 26 shows another example of the placement of the first control loudspeaker 15, the second control loudspeaker 21, the first noise source P1, and the second noise source P2. A difference from the conditions shown in FIG. 24 is that the distance Lp is 0.6 m. In the placement shown in FIG. 26, the first control loudspeaker 15 and the second control loudspeaker 21 are arranged within $\lambda/3$ from the first noise source P1, but the second noise source P2 is arranged outside $\lambda/3$ from the first noise source P1.

Figure 27:
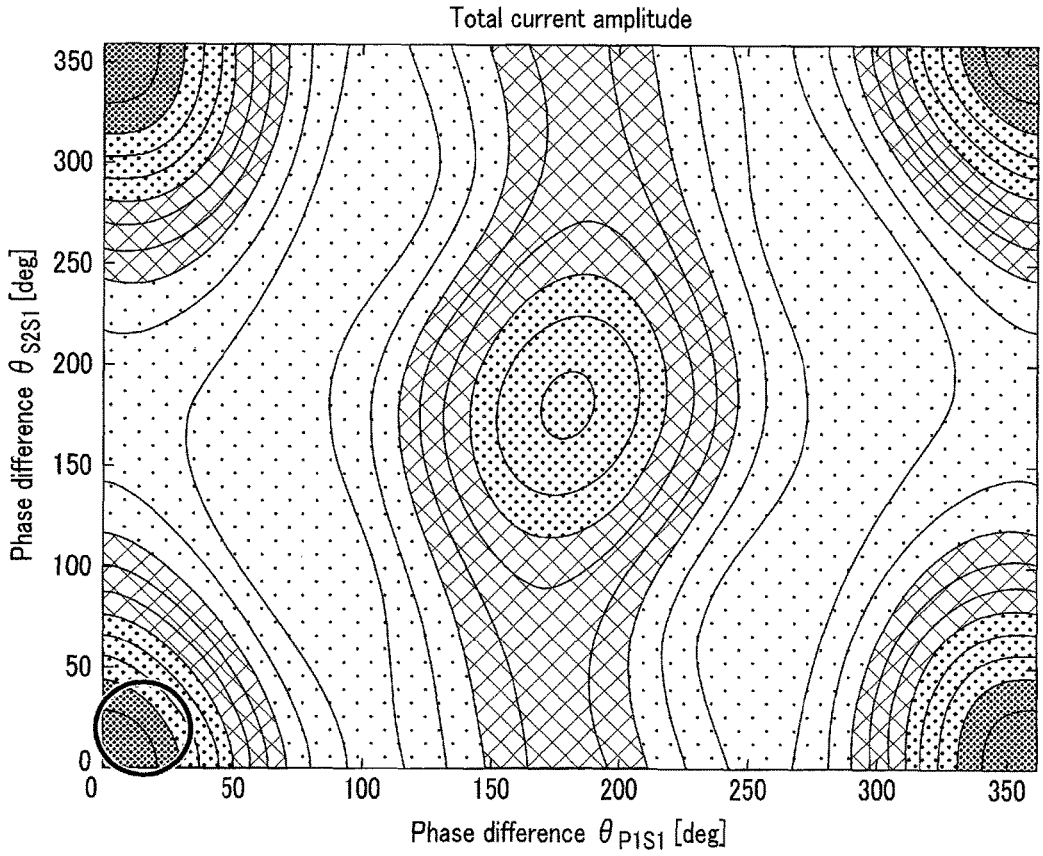
FIG. 27 is a graph showing a total current amplitude distribution in the placement in FIG. 26.

FIG. 27 is a graph showing a total current amplitude distribution in the placement in FIG. 26. The weighting coefficient $\beta$ of a total current amplitude is set to 0.5. As shown in FIG. 27, the phase difference of the first control loudspeaker 15 with respect to the first noise source P1 is decided to be 0° (abscissa), and the phase difference of the second control loudspeaker 21 with respect to the first control loudspeaker 15 is decided to be 0° (ordinate). Accordingly, the phase difference of the first control loudspeaker 15 with respect to the first noise source P1 is decided to be 0° (abscissa)+0° (ordinate)=0°. However, according to an adjustment method exemplified by the second embodiment (to be described later), in the placement shown in FIG. 26, the correct phase difference of the second control loudspeaker 21 is 180°. Accordingly, this indicates that when the second noise source P2 is arranged outside $\lambda/3$ from the first noise source P1, $\beta=0.5$ cannot be set.

Figure 28:
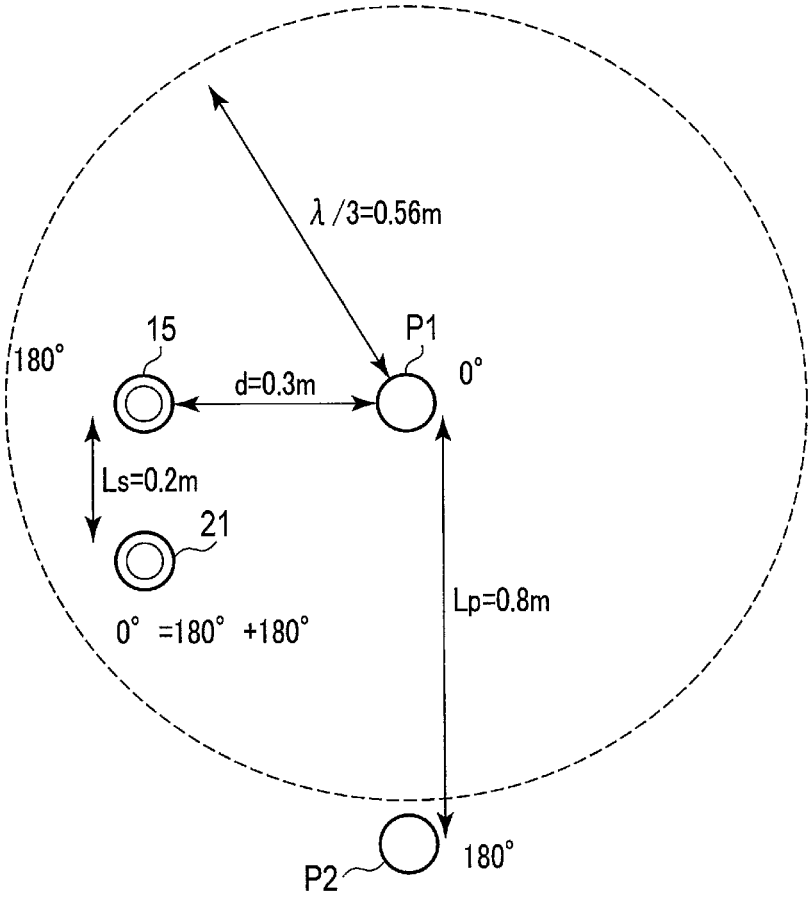
FIG. 28 is a view showing still another example of the placement of the first control loudspeaker, the second control loudspeaker, the first noise source, and the second noise source.

FIG. 28 shows still another example of the placement of the first control loudspeaker 15, the second control loudspeaker 21, the first noise source P1, and the second noise source P2. A difference from the conditions shown in FIG. 26 is that the distance Lp is 0.8 m. In the placement shown in FIG. 28, the first control loudspeaker 15 and the second control loudspeaker 21 are arranged within $\lambda/3$ from the first noise source P1, but the second noise source P2 is arranged outside $\lambda/3$ from the first noise source P1.

Figure 29:
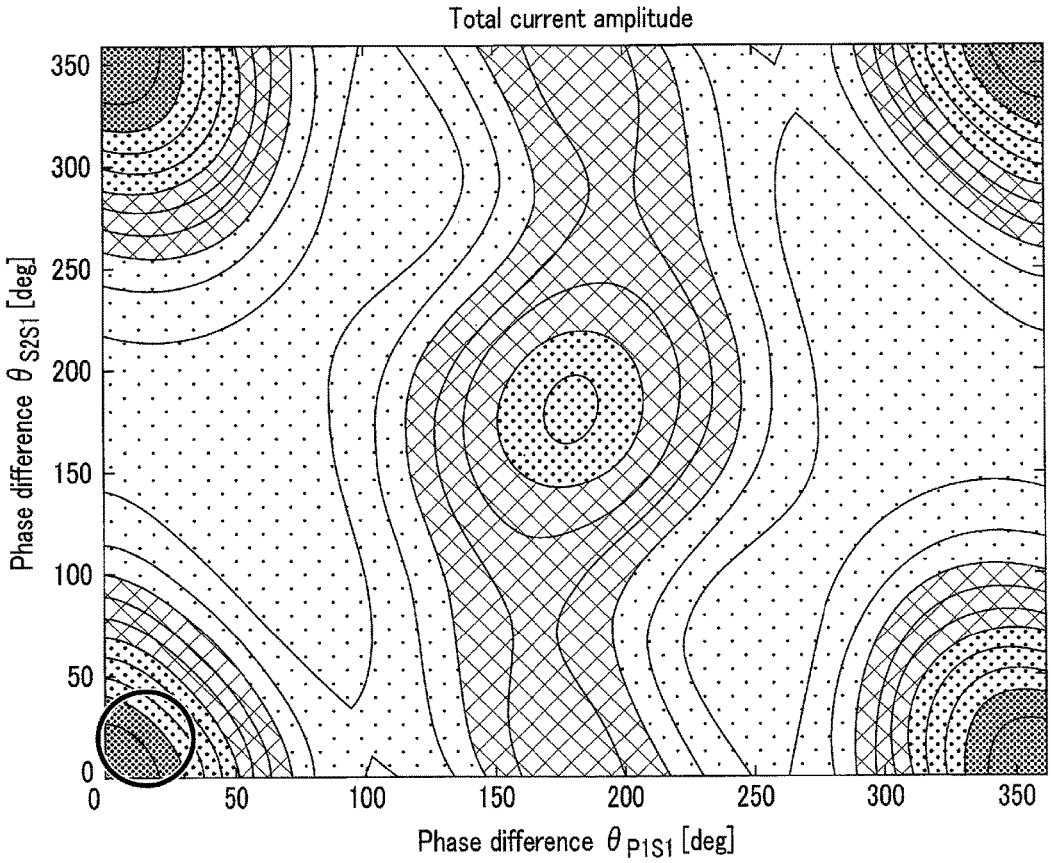
FIG. 29 is a graph showing a total current amplitude distribution in the placement in FIG. 28.
Figure 47:
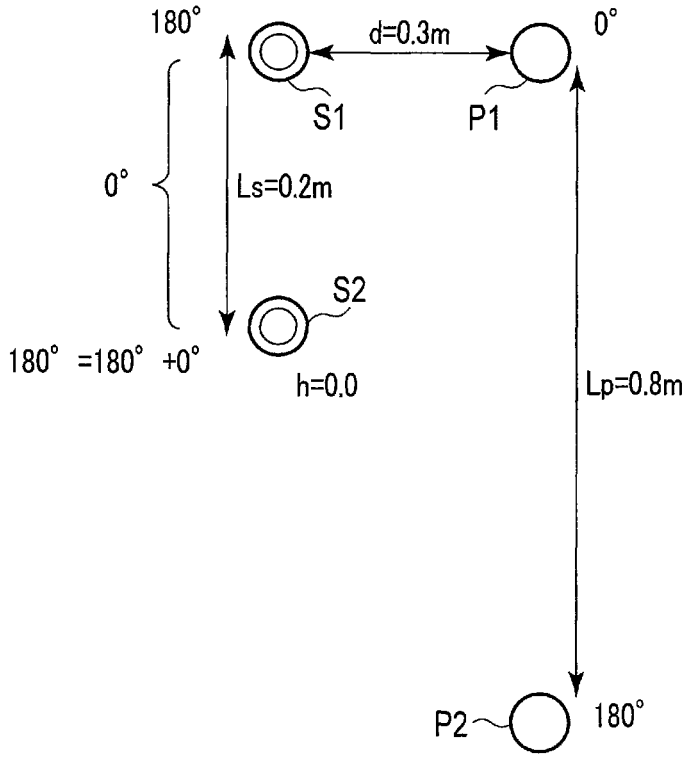
FIG. 47 is a view showing the (2-1-2)th predictive calculation conditions.
Figure 48:
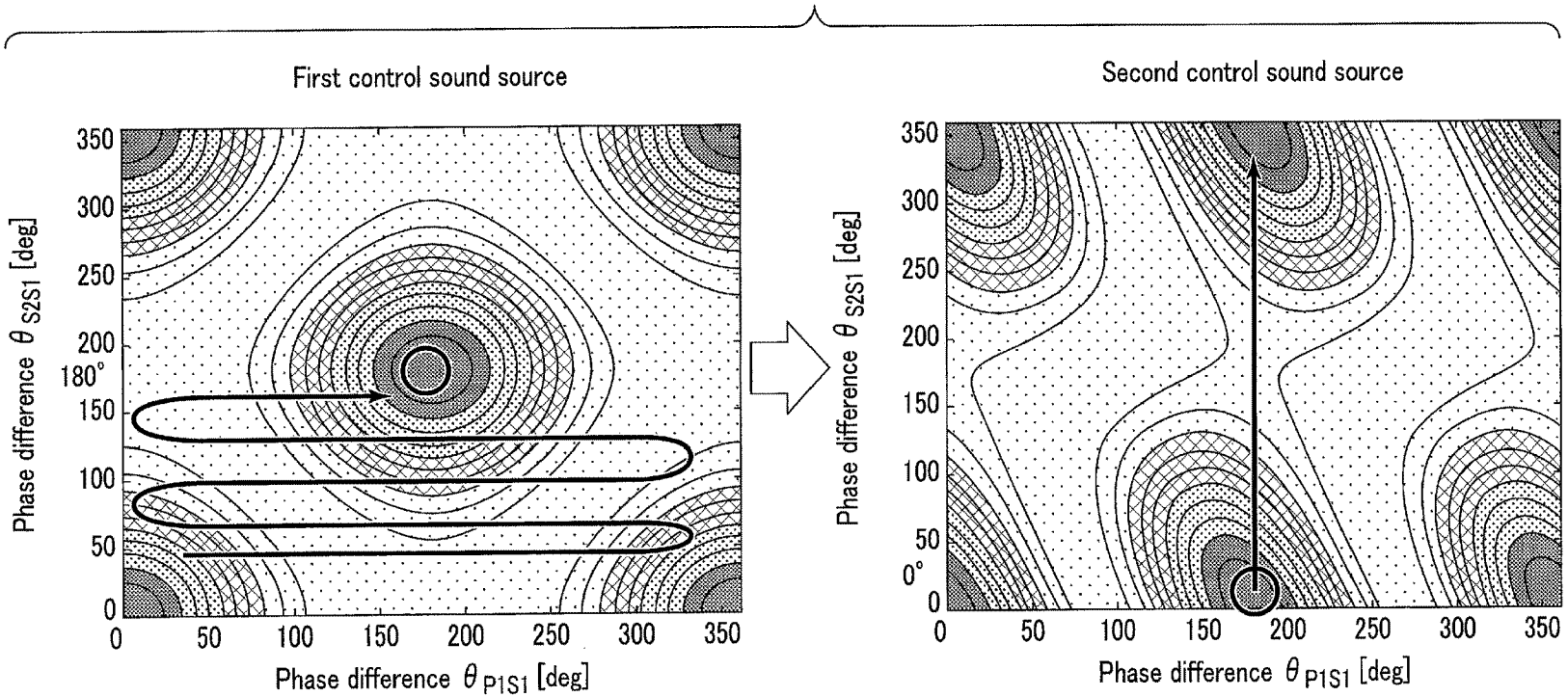
FIG. 48 shows graphs showing the current power spectrum distributions of the first and second control sound sources which are calculated under the (2-1-2)th predictive calculation conditions shown in FIG. 47.

FIG. 29 is a graph showing a total current amplitude distribution in the placement in FIG. 28. The weighting coefficient $\beta$ of a total current amplitude is set to 0.5. As shown in FIG. 29, the phase difference of the first control loudspeaker 15 with respect to the first noise source P1 is decided to be 0° (abscissa), and the phase difference of the second control loudspeaker 21 with respect to the first control loudspeaker 15 is decided to be 0° (ordinate). Accordingly, the phase difference of the first control loudspeaker 15 with respect to the first noise source P1 is decided to be 0° (abscissa)+0° (ordinate)=0°. However, according to the adjustment method exemplified by the second embodiment (to be described later), as shown in FIGS. 47 and 48 (to be described later), in the placement shown in FIG. 28, the correct phase difference of the second control loudspeaker 21 is 180°. Accordingly, this indicates that when the second noise source P2 is arranged outside X13 from the first noise source P1, $\beta=0.5$ cannot be set.

Application Example 1

The first control filter 13 and the second control filter 19 of the noise reduction apparatus 1 according to the first embodiment can be retrofitted to an existing noise reduction apparatus. A noise reduction apparatus according to Application Example 1 of the first embodiment will be described below. Note that in the following description, the same reference numerals denote constituent elements having almost the same functions as those of the first embodiment, and a repetitive description will be made only when required.

Figure 30:
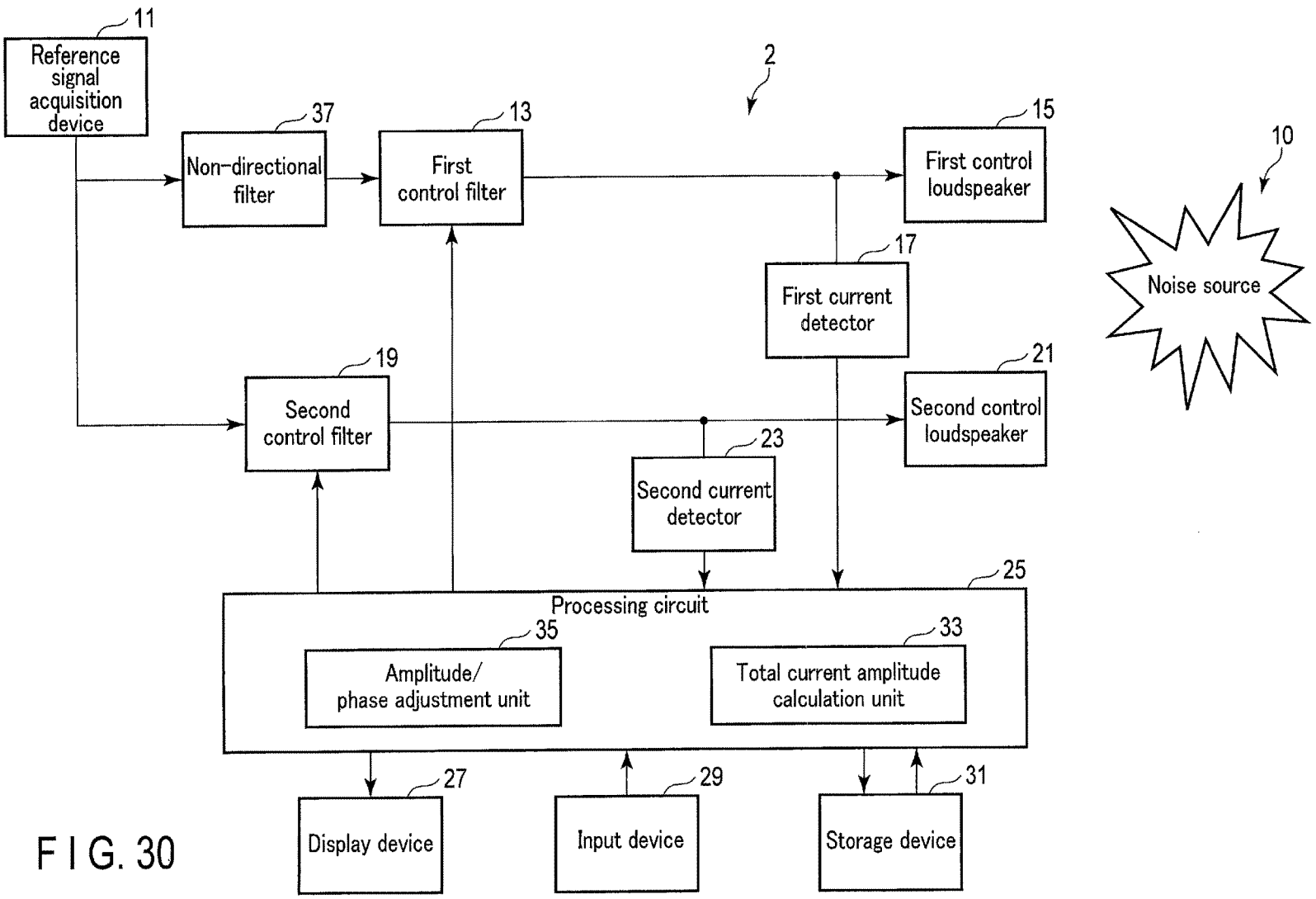
FIG. 30 is a block diagram showing the arrangement of a noise reduction apparatus according to Application Example 1 of the first embodiment.

FIG. 30 shows the arrangement of a noise reduction apparatus 2 according to Application Example 1 of the first embodiment. As shown in FIG. 30, the noise reduction apparatus 2 according to Application Example 1 of the first embodiment includes a non-directional filter 37 in addition to the reference signal acquisition device 11, the first control filter 13, the first control loudspeaker 15, the first current detector 17, the second control filter 19, the second control loudspeaker 21, the second current detector 23, the processing circuit 25, the display device 27, the input device 29, and the storage device 31. Assume that the first control filter 13 and the second control filter 19 are retrofitted to the non-directional filter 37. The non-directional filter 37 is a control filter that generates a control signal for causing the first control loudspeaker 15 to generate a non-directional control sound while the first control filter 13 and the second control filter 19 are not attached.

An operation example of the noise reduction apparatus 2 according to Application Example 1 will be described next.

Figure 31:
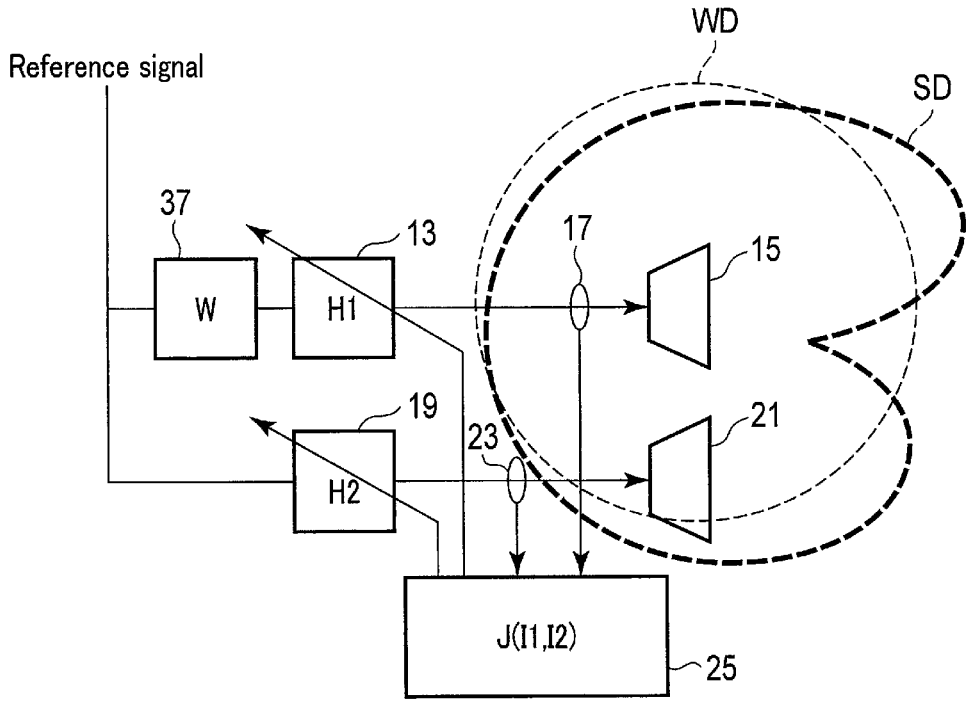
FIG. 31 is a block diagram schematically showing a change in the directivity of a composite control sound before and after the attachment of first and second control filters.

FIG. 31 schematically shows a change in the directivity of a composite control sound before and after the first control filter 13 and the second control filter 19 are attached. As shown in FIG. 31, while the first control filter 13 and the second control filter 19 are not attached, the non-directional filter 37 is attached to the first control loudspeaker 15 in advance. The non-directional filter 37 is provided with a non-directional directivity WD.

As shown in FIG. 31, the first control filter 13 and the second control filter 19 are retrofitted to the non-directional filter 37. The first control filter 13 is provided between the non-directional filter 37 and the first control loudspeaker 15. In this state, as in the first embodiment, the amplitude characteristics and phase characteristics of the first control filter 13 and the second control filter 19 are decided so as to satisfy conditions for the maximization of a total current amplitude. At least one of the amplitude and phase of the first control sound and at least one of the amplitude and phase of the second control sound are optimally adjusted to noise from the noise source 10 by adjusting the first control filter 13 and the second control filter 19 to the decided amplitude characteristics and phase characteristics. This makes a directivity SD of the composite control sound adapt to the directivity of noise.

As described above, according to Application Example 1, the first control filter 13 and the second control filter 19 can be retrofitted to a noise reduction apparatus in operation. Retrofitting the first control filter 13 and the second control filter 19 to the noise reduction apparatus can improve the effect of noise reduction control by the apparatus easily at a low cost.

Note that in the above description, the first control loudspeaker 15 of the noise reduction apparatus in operation is provided with the non-directional filter 37. However, the second control loudspeaker 21 may be provided with the non-directional filter 37 or each of the first control loudspeaker 15 and the second control loudspeaker 21 may be provided with the non-directional filter 37.

Application Example 2

In Application Example 1, a non-directional control filter is attached to the noise reduction apparatus in operation. Assume that in Application Example 2, a control filter having directivity is attached in advance to a noise reduction apparatus in operation. The noise reduction apparatus according to Application Example 2 of the first embodiment will be described below. Note that in the following description, the same reference numerals denote constituent elements having almost the same functions as those of the first embodiment, and a repetitive description will be made only when required.

Figure 32:
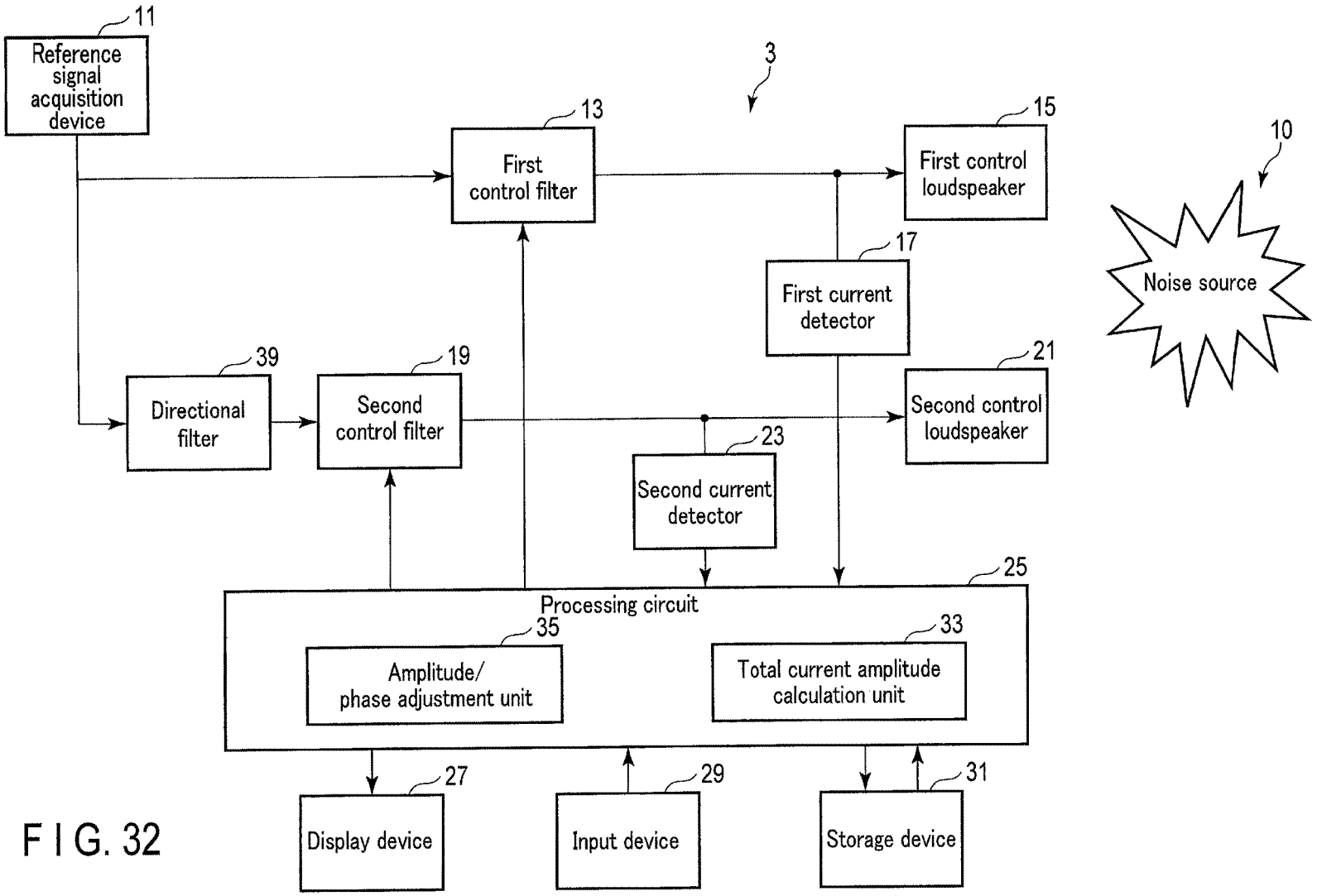
FIG. 32 is a block diagram showing the arrangement of a noise reduction apparatus according to Application Example 2 of the first embodiment.

FIG. 32 shows the arrangement of a noise reduction apparatus 3 according to Application Example 2 of the first embodiment. As shown in FIG. 32, the noise reduction apparatus 3 according to Application Example 2 of the first embodiment includes a directional filter 39 in addition to the reference signal acquisition device 11, the first control filter 13, the first control loudspeaker 15, the first current detector 17, the second control filter 19, the second control loudspeaker 21, the second current detector 23, the processing circuit 25, the display device 27, the input device 29, and the storage device 31. Assume that the first control filter 13 and the second control filter 19 are retrofitted to the directional filter 39.

The directional filter 39 is a control filter that generates a control signal for causing the second control loudspeaker 21 to generate a control sound having a predetermined directivity while the first control filter 13 and the second control filter 19 are not attached to the directional filter 39.

An operation example of the noise reduction apparatus 3 according to Application Example 2 will be described next.

Figure 33:
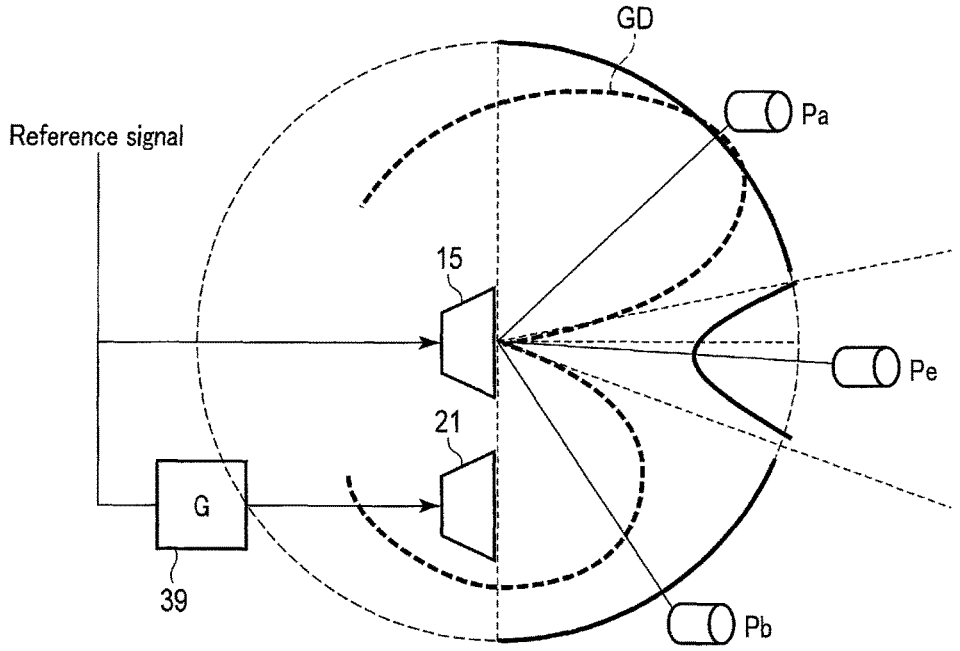
FIG. 33 is a view schematically showing the directivity of a composite control sound before the attachment of the first and second control filters.

FIG. 33 schematically shows the directivity of a composite control sound before the first control filter 13 and the second control filter 19 are attached. As shown in FIG. 33, before the first control filter 13 and the second control filter 19 are attached, the directional filter 39 provides a predetermined directivity GD to a composite control sound. Sound pressures are measured at a plurality of positions equidistant from the first control loudspeaker 15 and different in azimuth angle. For example, the first noise meter is arranged almost in front of (azimuth angle of almost 0°) the first control loudspeaker, and the second and third noise meters are arranged at almost equal intervals in the azimuth angle direction on the two sides of the first noise meter. Let Pe be the sound pressure measured by the first noise meter, Pa is the sound pressure measured by the second noise meter, and Pb is the sound pressure measured by the third noise meter.

As indicated by equations (31) and (32), the amplitude characteristic and phase characteristic of the directional filter 39 are derived, with the ratio of sound pressures on the two sides being α, while the sound pressure Pe is minimized:

$$\alpha = Pb/Pa \tag{31}$$

$$Pe = 0 \tag{32}$$

A volume velocity Qp concerning a noise source and a volume velocity Qs concerning a control sound source are respectively written by equations (33) and (34) given below:

$$Qp = A*Qs \tag{33}$$

$$Qs = (n*Zp/(A*Zp+Zs)) \tag{34}$$

$$A = (n*Zp*Fsw2-m*Fp*Zs)/((m-n)*Fp*Zp)$$

Figure 34:
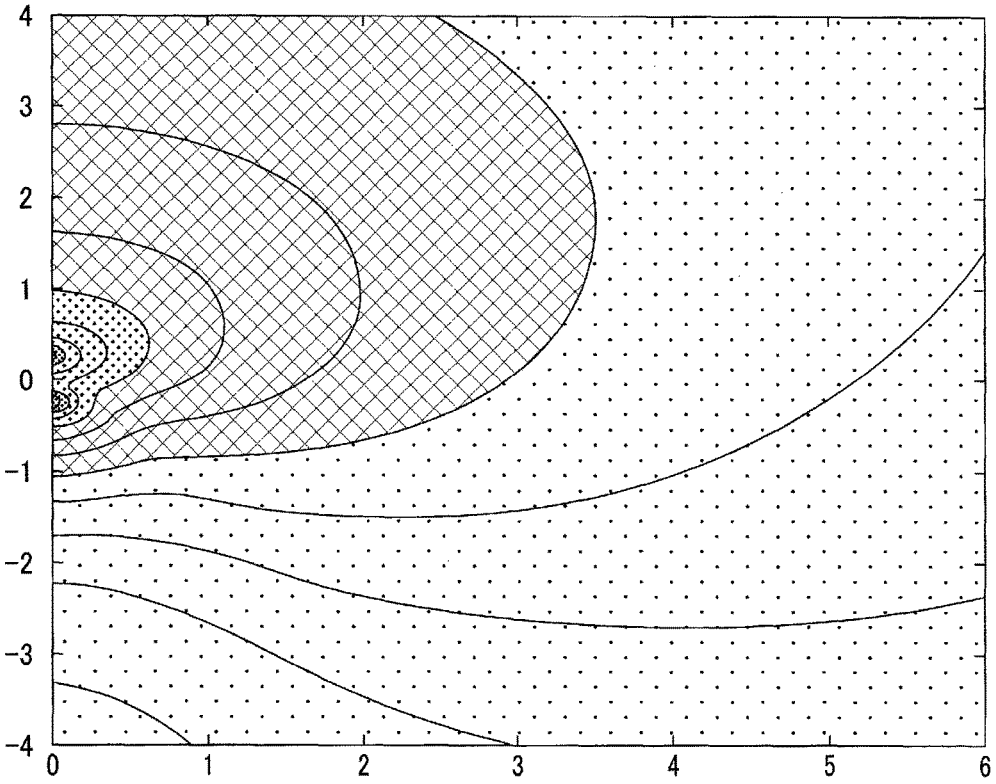
FIG. 34 is a graph showing the sound pressure distribution of a composite control sound generated via a directional filter.

FIG. 34 shows the sound pressure distribution of the composite control sound generated via the directional filter 39 having the amplitude characteristic and phase characteristic derived by the above method. The ordinate and abscissa of FIG. 34 are respectively defined as distances in the azimuth angle direction and distances in the acoustic propagation direction. The amplitude/phase adjustment unit 35 sets the derived amplitude characteristic and phase characteristic for the directional filter 39. The first control filter 13 and the second control filter 19 are retrofitted to the noise reduction apparatus 3, and the amplitudes and phases of control sounds are adjusted by the adjustment method shown in FIG. 6.

Figure 35:
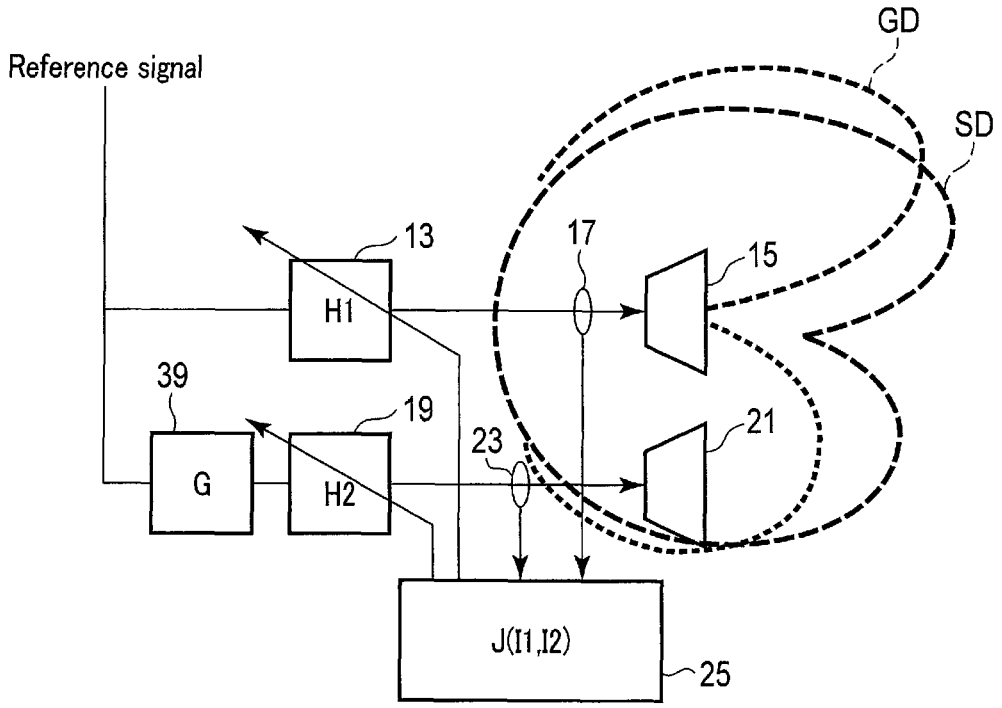
FIG. 35 is a block diagram schematically showing the directivities of composite control sounds before and after the attachment of the first and second control filters.

FIG. 35 schematically shows the directivities of composite control sounds before and after the attachment of the first control filter 13 and the second control filter 19. The amplitude characteristics and phase characteristics of the first control filter 13 and the second control filter 19 are adjusted by the adjustment method shown in FIG. 6. The directivity SD of the composite control sound of the first and second control sounds adapts to the directivity of noise. Retrofitting the first control filter 13 and the second control filter 19 to the directional filter 39 can make the directivity of a composite control sound approach the directivity of a noise source as a final target.

Application Example 3

An example of applying noise reduction according to Application Example 1 of the first embodiment to a rotor blade rotation noise source will be described as Application Example 3. Note that in the following description, the same reference numerals denote constituent elements having almost the same functions as those of Application Example 1 of the first embodiment, and a repetitive description will be made only when required.

Figure 36:
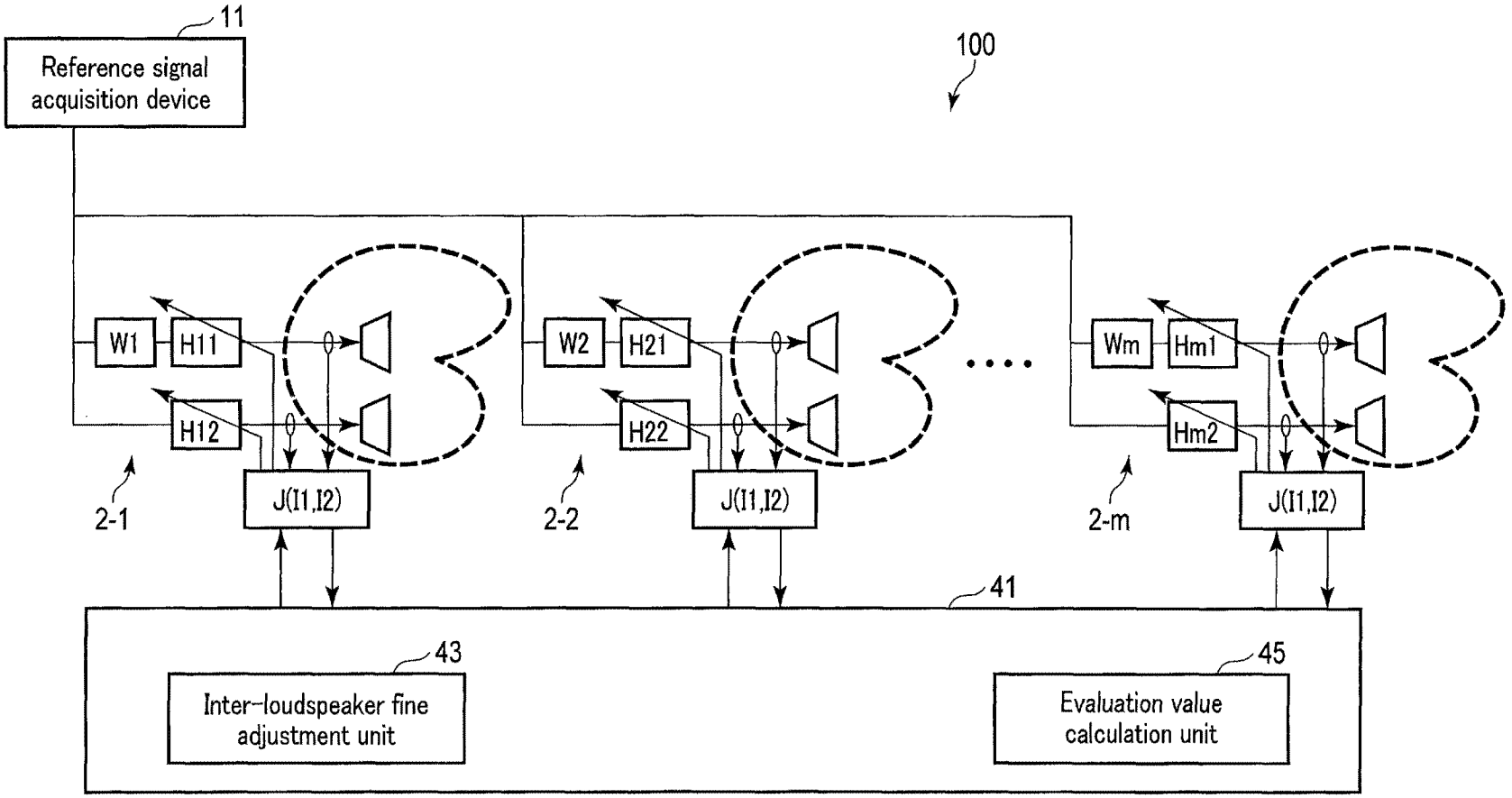
FIG. 36 is a block diagram showing the arrangement of a noise reduction system according to Application Example 3 of the first embodiment.

FIG. 36 shows the arrangement of a noise reduction system 100 according to Application Example 3 of the first embodiment. As shown in FIG. 36, the noise reduction system 100 according to Application Example 3 includes the reference signal acquisition device 11, a plurality of noise reduction apparatuses 2 according to Application Example 2, and a processing circuit 41.

The reference signal acquisition device 11 acquires a reference signal correlating with noise generated from the rotor blade rotation noise source. As the reference signal acquisition device 11 according to Application Example 3, a rotational speed detector such as an encoder provided for the driving system of the rotor blade rotation noise source is used. A reference signal is supplied to the plurality of noise reduction apparatuses 2.

A plurality of noise reduction apparatuses 2-*m* are connected in parallel to the reference signal acquisition device 11. The number m of noise reduction apparatuses 2-*m* is not specifically limited and may be two or more. Each noise reduction apparatus 2-*m* calculates a total current amplitude based on a current detection signal from the first current detector 17 and a current detection signal from the second current detector 23, and supplies a signal concerning the calculated total current amplitude to the processing circuit 41.

The processing circuit 41 controls control sounds generated from the respective noise reduction apparatuses based on the total current amplitudes supplied from the respective noise reduction apparatuses. The processing circuit 25 as a hardware component includes a processor such as a CPU (Central Processing Unit) and a memory such as a RAM (Random Access Memory). The processing circuit 41 implements an inter-loudspeaker fine adjustment unit 43 and an evaluation value calculation unit 45 by executing programs stored in a storage device (not shown). Note that the hardware implementation of the processing circuit 41 is not limited to the above form. For example, the processing circuit 41 may be implemented by a circuit such as an ASIC (Application Specific Integrated Circuit) for implementing the inter-loudspeaker fine adjustment unit 43 and the evaluation value calculation unit 45. The inter-loudspeaker fine adjustment unit 43 and the evaluation value calculation unit 45 may be implemented on a single integrated circuit or may be separately implemented on a plurality of integrated circuits.

The inter-loudspeaker fine adjustment unit 43 adjusts the phases of control sounds generated from the first control loudspeaker 15 and the second control loudspeaker 21 in accordance with the phase shift amounts of the first control loudspeakers 15 and the second control loudspeakers 21 of the respective noise reduction apparatuses 2-*m*.

Based on a plurality of total current amplitudes supplied from the plurality of noise reduction apparatuses 2, the evaluation value calculation unit 45 calculates the evaluation values of the plurality of total current amplitudes. The amplitudes and phases of the first control loudspeakers 15 and the second control loudspeakers 21 of the respective noise reduction apparatuses 2 are adjusted in accordance with the evaluation values.

Figure 37:
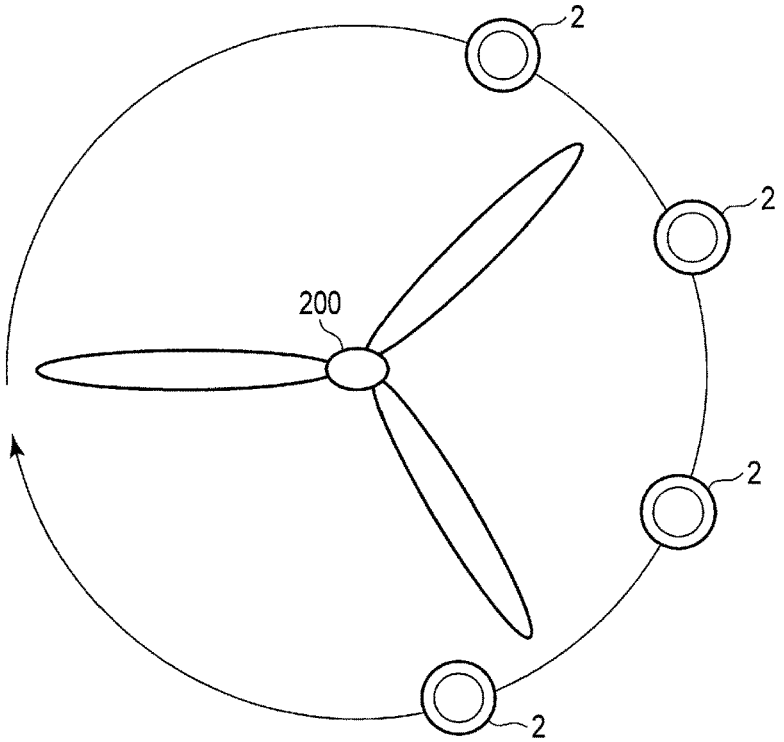
FIG. 37 is a view showing the placement of a plurality of noise reduction apparatuses and a rotor blade rotation noise source.

FIG. 37 shows the placement of the plurality of noise reduction apparatuses 2 and a rotor blade rotation noise source 200. The rotor blade rotation noise source 200 is a rotating blade unit constituted by a plurality of rotor blades. The rotor blade rotation noise source 200 can be expressed by a discrete sound source group (rotating ring sound sources) having a delay time corresponding to a discrete rotational speed. Accordingly, the plurality of noise reduction apparatuses 2 can be expressed as a sound source model having a plurality of control sound source groups discretely arranged around the rotor blade rotation noise source 200.

The first control loudspeaker 15 and the second control loudspeaker 21 included in each noise reduction apparatus 2 are arranged within X13 from the rotor blade rotation noise source 200. Letting B be the number of rotor blades of the rotor blade rotation noise source 200 and x be the reduction target degree of noise, the number of control loudspeakers may be 2Bx+1 or more to reduce the occurrence of spatial alias phenomena based on the difference between the number of rotor blade rotation noise sources and the number of control loudspeakers. In addition, when the rotor blade radius of the rotor blade rotation noise source 200 is a, each control loudspeaker is preferably arranged at a distance as close to the distance a from the rotation center of the rotor blade rotation noise source 200 as possible. Each control loudspeaker is preferably arranged on a circumference at a distance within 2a from the center of the rotor blade rotation noise source 200.

The directions of the first control loudspeaker 15, the second control loudspeaker 21, the first noise source P1, and the second noise source P2 will be described next.

FIGS. 38, 39, 40, and 41 each show an example of the directions of the first control loudspeaker 15, the second control loudspeaker 21, the first noise source P1, and the second noise source P2. As shown in FIGS. 38, 39, 40, and 41, assume that the first noise source P1 and the second noise source P2 are noise sources concerning rotating blade edge noise.

Figure 38:
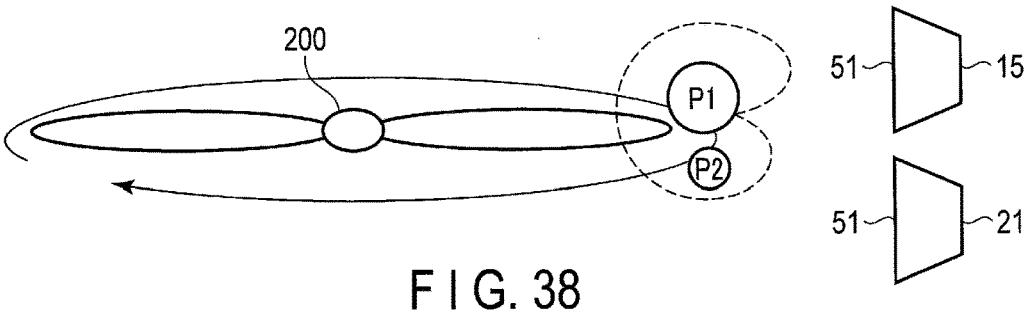
FIG. 38 is a view showing an example of the directions of the first control loudspeaker, second control loudspeaker, first noise source, and second noise source.
Figure 39:
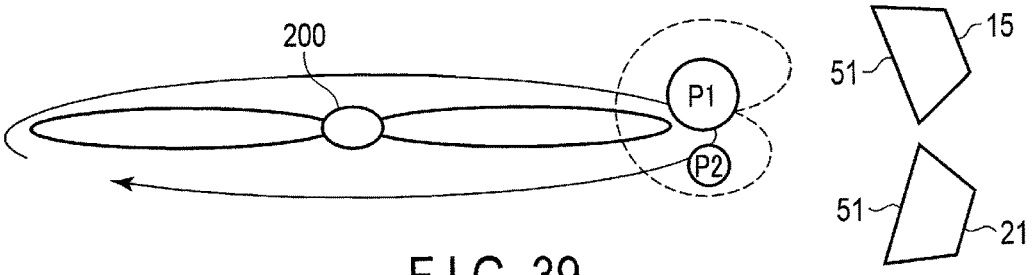
FIG. 39 is a view showing an example of the directions of the first control loudspeaker, second control loudspeaker, first noise source, and second noise source.

As shown in FIGS. 38 and 39, the first control loudspeaker 15 and the second control loudspeaker 21 are preferably arranged with respect to the first noise source P1 and the second noise source P2 such that acoustic radiation surfaces S1 of the first control loudspeaker 15 and the second control loudspeaker 21, from which control sounds are emitted, face the first noise source P1 and the second noise source P2. This can efficiently make control sounds and noise interfere with each other. Note that the acoustic radiation surfaces 51 of the first control loudspeaker 15 and the second control loudspeaker 21 are preferably arranged to be almost parallel to each other as shown in FIG. 38, or the acoustic radiation surfaces 51 of the first control loudspeaker 15 and the second control loudspeaker 21 are preferably arranged to be aimed at one point as shown in FIG. 39.

Figure 40:
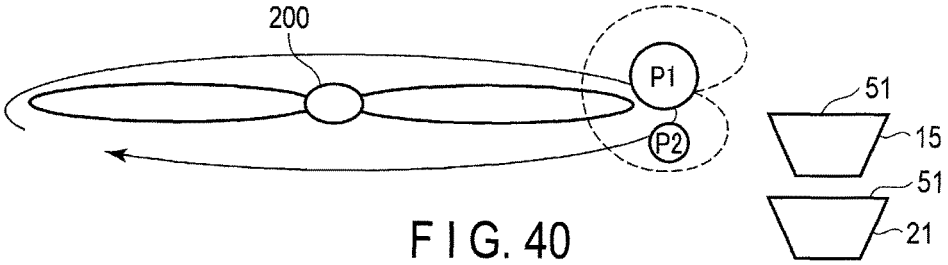
FIG. 40 is a view showing an example of the directions of the first control loudspeaker, second control loudspeaker, first noise source, and second noise source.
Figure 41:
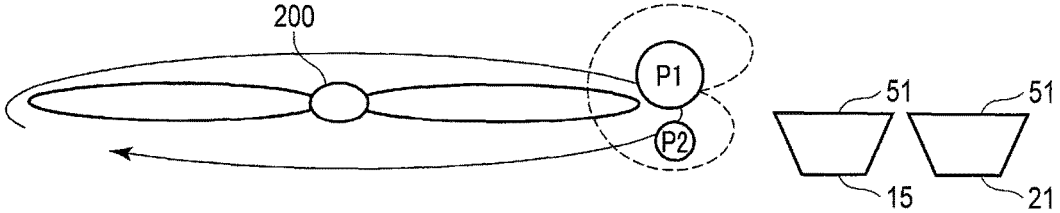
FIG. 41 is a view showing an example of the directions of the first control loudspeaker, second control loudspeaker, first noise source, and second noise source.

As shown in FIGS. 40 and 41, the first control loudspeaker 15 and the second control loudspeaker 21 are preferably arranged with respect to the first noise source and the second noise source such that the acoustic radiation surfaces 51 of the first control loudspeaker 15 and the second control loudspeaker 21 face in the same direction while not being aimed at the first noise source P1 and the second noise source P2. The first control loudspeaker 15 may be arranged in front of the acoustic radiation surface 51 of the second control loudspeaker 21, as shown in FIG. 40, or the first control loudspeaker 15 and the second control loudspeaker 21 may be arranged side by side such that the acoustic radiation surfaces 51 of the first control loudspeaker 15 and the second control loudspeaker 21 are arranged in a line, as shown in FIG. 41.

The windproof jigs of the first control loudspeaker 15 and the second control loudspeaker 21 will be described next. The amplitude/phase adjustment method according to this embodiment uses a technique regarding, as an evaluation function, a back electromotive current generated by an acoustic excitation force applied from a noise source onto the acoustic radiation surfaces of the first control loudspeaker 15 and the second control loudspeaker 21. In order to improve the effect of noise reduction control, it is preferable to bring the first control loudspeaker 15 and the second control loudspeaker 21 as close to a rotor blade as a noise source as possible. However, in the proximate placement, the first control loudspeaker 15 and the second control loudspeaker 21 simultaneously receive the influence of wind, and acoustic excitation force may be canceled by this external force. Accordingly, windproof jigs are attached to the first control loudspeaker 15 and the second control loudspeaker 21.

Figure 42:
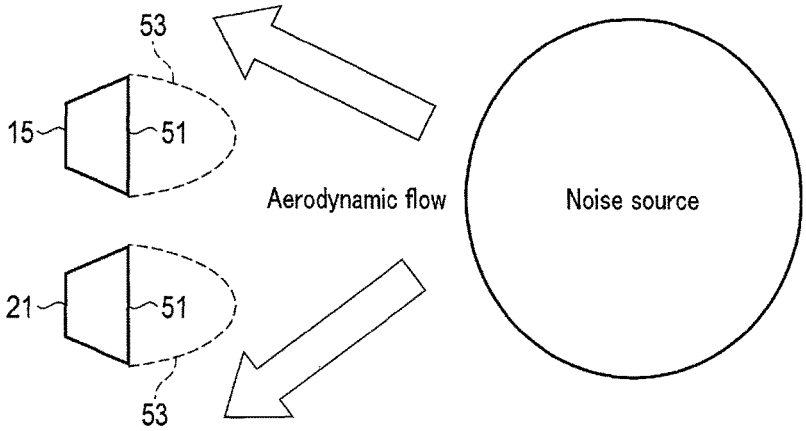
FIG. 42 is a view showing the first and second control loudspeakers to which windproof jigs are attached.

FIG. 42 shows the first control loudspeaker 15 and the second control loudspeaker 21 to which windproof jigs 53 are attached. As shown in FIG. 42, a first windproof jig 53-1 is attached to the first control loudspeaker 15, and a second windproof jig 53-2 is attached to the second control loudspeaker 21. The respective windproof jigs 53 are attached to the first control loudspeakers 15 and 21 so as to cover the acoustic radiation surfaces 51 to prevent them from receiving the influence of aerodynamic force of wind from the noise source. More specifically, as the windproof jig 53, a windproof screen or thin film that transmits only sounds without being influenced by wind.

The arrangement of the noise reduction system 100 according to Application Example 3 is not limited to the arrangement shown in FIG. 36. For example, the processing circuit 25 of each noise reduction apparatus 2-*m* may not be provided with the total current amplitude calculation unit 33. In this case, the processing circuit 41 is preferably provided with the total current amplitude calculation unit 33. The total current amplitude calculation unit 33 of the processing circuit 41 is preferably configured to receive the first and second current detection signals from the respective noise reduction apparatuses 2 and calculate a total current amplitude based on the received first and second current detection signals.

In Application Example 3, each noise reduction apparatus included in the noise reduction system 100 is the same as the noise reduction apparatus according to Application Example 1, which includes the non-directional filter 37. However, this embodiment is not limited to this. Each noise reduction apparatus included in the noise reduction system 100 may be the noise reduction apparatus 3 according to Application Example 2, which includes the directional filter 39, or the noise reduction apparatus 1 according to the first embodiment, which includes neither the non-directional filter 37 nor the directional filter 39. Alternatively, each noise reduction apparatus included in the noise reduction system 100 may be an apparatus obtained by combining at least two types of the noise reduction apparatus 1 according to the first embodiment, the noise reduction apparatus 2 according to Application Example 1, and the noise reduction apparatus according to Application Example 2.

In Application Example 3 in which the plurality of noise reduction apparatuses 2 are arranged around the rotating noise source, the processing circuit 41 is not an essential component. That is, at least one of the amplitude and phase of each of the first control loudspeakers 15 and the second control loudspeakers 21 of each of the noise reduction apparatuses 2 arranged around the rotating noise source may be adjusted by the adjustment method described in the first embodiment.

Second Embodiment

The noise reduction apparatus according to the first embodiment is configured to adjust the amplitudes and phases of the first and second control sounds by simultaneously monitoring the first current detection signal (first back electromotive current) from the first current detector and the second current detection signal (second back electromotive current) from the second current detector. However, this embodiment is not limited to this. A noise reduction apparatus according to the second embodiment is configured to adjust the amplitudes and phases of the first and second control sounds by individually monitoring the first current detection signal (first back electromotive current) from the first current detector and the second current detection signal (second back electromotive current) from the second current detector. The noise reduction apparatus according to the second embodiment will be described below. Note that in the following description, the same reference numerals denote constituent elements having almost the same functions as those of the first embodiment, and a repetitive description will be made only when required. In addition, constituent elements denoted by the same reference numerals can be applied to the respective embodiments described above as the first embodiment, Application Example 1, Application Example 2, and Application Example 3.

Figure 43:
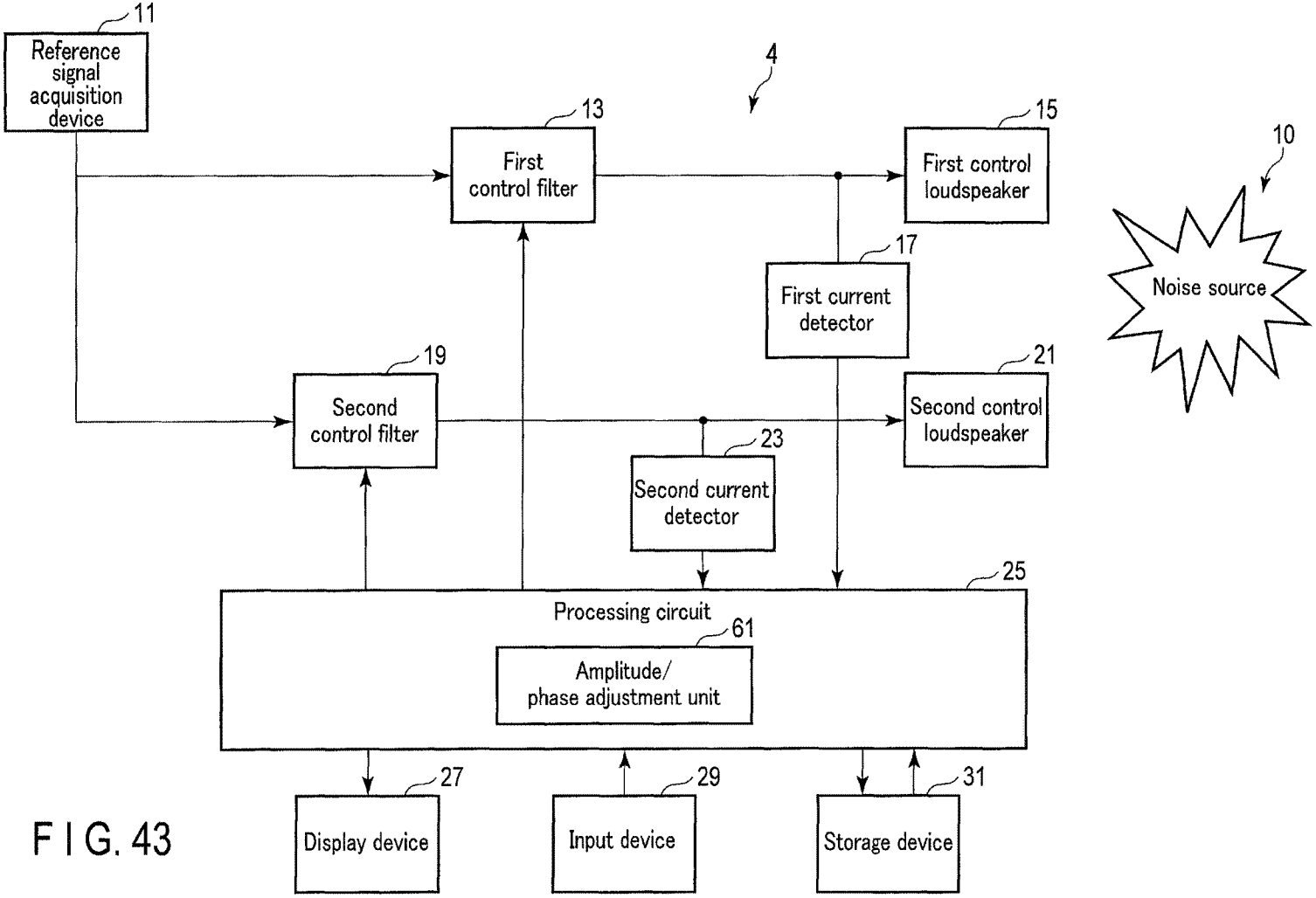
FIG. 43 is a block diagram showing the arrangement of a noise reduction apparatus according to the second embodiment.

FIG. 43 shows the arrangement of a noise reduction apparatus 4 according to the second embodiment. As shown in FIG. 43, the noise reduction apparatus 4 according to the second embodiment includes a reference signal acquisition device 11, a first control filter 13, a first control loudspeaker 15, a first current detector 17, a second control filter 19, a second control loudspeaker 21, a second current detector 23, a processing circuit 25, a display device 27, an input device 29, and a storage device 31.

The processing circuit 25 according to the second embodiment implements an amplitude/phase adjustment unit 61 by executing a program stored in the storage device 31. The amplitude/phase adjustment unit 61 adjusts at least one of the amplitude and phase of the first control sound and at least one of the amplitude and phase of the second control sound such that the first current detection signal (first back electromotive current) from the first current detector 17 and the second current detection signal (second back electromotive current) from the second current detector 23 satisfy maximization conditions. The maximization conditions according to the second embodiment are defined such that the current amplitude of the first current detection signal and the current amplitude of the second current detection signal each take an almost maximum value. In this case, the amplitude/phase adjustment unit 61 adjusts at least one of the amplitude and phase of the first control sound to make the current amplitude of the first current detection signal take an almost maximum value, and adjusts at least one of the amplitude and phase of the second control sound to make the current amplitude of the second current detection signal take an almost maximum value. In other words, the first control filter 13 is adjusted to make the current amplitude of the first current detection signal take an almost maximum value, and the second control filter 19 is adjusted to make the current amplitude of the second current detection signal take an almost maximum value. Adjusting the first control filter 13 and the second control filter 19 makes a composite sound of the first and second control sounds generated from the first and second control loudspeakers 15 and 21 adapt to the directivity of noise. Such control sounds minimize the acoustic power propagating in a noise reduction target space. Accordingly, this reduces noise propagating in the space.

Adjustment processing for the amplitudes and phases of the first control loudspeaker 15 and the second control loudspeaker 21 by the noise reduction apparatus 4 according to the second embodiment will be described next.

Figure 44:
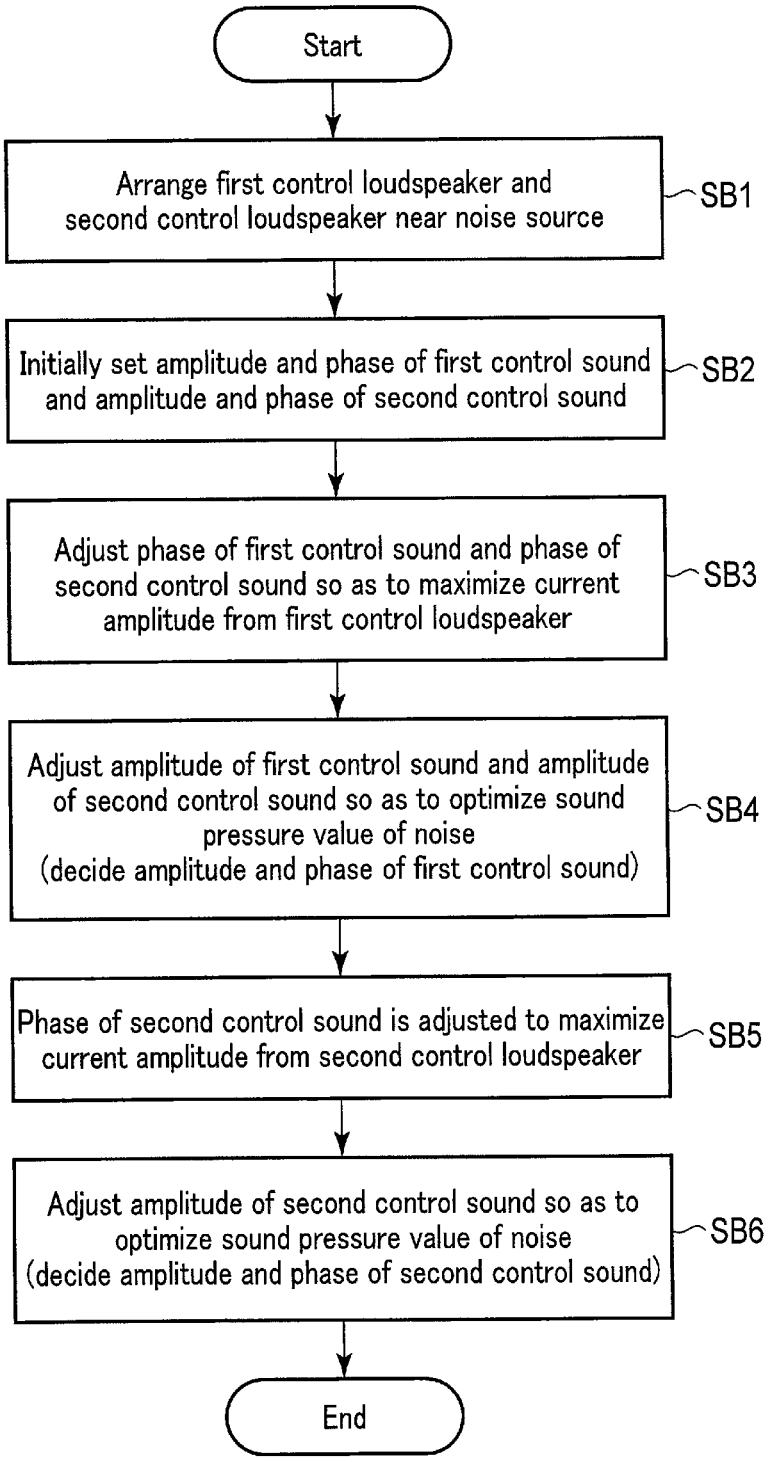
FIG. 44 is a flowchart showing a typical procedure for adjustment processing for the amplitudes and phases of the first and second control sounds by the noise reduction apparatus according to the second embodiment.

FIG. 44 is a flowchart showing a typical procedure for adjustment processing for the amplitudes and phases of the first control sound and the second control sound by the noise reduction apparatus 4 according to the second embodiment. As shown in FIG. 44, first of all, the first control loudspeaker 15 and the second control loudspeaker 21 are arranged near a noise source 10 (step SB1).

When step SB1 is performed, the amplitude/phase adjustment unit 61 initially sets the amplitude and phase of the first control sound and the amplitude and phase of the second control sound (step SB2). In step SB2, the amplitude/phase adjustment unit 61 adjusts the amplitude characteristic of the first control filter 13 and the amplitude characteristic of the second control filter 19 such that the amplitudes of the first and second control sounds almost coincide with the amplitude of the noise source 10. For example, noise meters are respectively provided for the noise source 10, the first control loudspeaker 15, and the second control loudspeaker 21, and the amplitude change amount of the first control filter 13 and the amplitude change amount of the second control filter 19 are adjusted to make the noise levels measured by the respective noise meters almost coincide with each other. When the noise level of the noise source 10 is known, the amplitude change amount of the first control filter 13 and the amplitude change amount of the second control filter 19 may be adjusted to the known value. Note that because the amplitude of the first control sound and the amplitude of the second control sound are strictly adjusted in and after step SB3, adjustment may be performed in step SB2 to such an extent that the sound pressures of sounds from the first control loudspeaker 15 and the second control loudspeaker 21 interfere with the sound pressure of noise from the noise source 10.

When step SB2 is performed, the amplitude/phase adjustment unit 61 adjusts the phase of the first control loudspeaker 15 and the phase of the second control loudspeaker 21 to maximize a current amplitude from the first control loudspeaker 15 (step SB3). In step SB3, the amplitude/phase adjustment unit 61 adjusts the phase of the first control sound and the phase of the second control sound based on reference signals from the reference signal acquisition device 11. A reference signal from the reference signal acquisition device 11 is, for example, a signal detected by a rotational speed detector and associated with the rotational speed of the rotating blade unit mounted on the noise source 10 of the rotating system. Noise contains, for example, a main component (for example, 100 Hz), based on a rotational speed, and its harmonic component (for example, 200 Hz). A phase is adjusted for each component of a noise reduction target. When, for example, the main component is a noise reduction target, the phase of the first control loudspeaker 15 is adjusted with respect to the frequency of the main component. More specifically, first of all, the amplitude/phase adjustment unit 61 adjusts the phase change amount (phase shift amount) of the first control filter 13 so as to change the phase of the first control loudspeaker 15 from 0° to 360°. On the other hand, the amplitude/phase adjustment unit 61 monitors the current amplitude of the first current detection signal for each predetermined phase and searches for a phase in which the current amplitude takes a maximum value. The amplitude/phase adjustment unit 61 adjusts the phase change amount of the first control filter 13 so as to make the phase of the first control sound coincide with the specified phase. The phase change amount of the first control filter 13 is fixed to the adjusted phase change amount.

The amplitude/phase adjustment unit 61 then adjusts the phase change amount (phase shift amount) of the second control filter 19 so as to change the phase of the second control sound from 0° to 360° while the phase change amount of the first control filter 13 is fixed. On the other hand, the amplitude/phase adjustment unit 61 monitors the current amplitude (power spectrum) of the second current detection signal for each predetermined phase to search for a phase in which the current amplitude takes a maximum value. Subsequently, the amplitude/phase adjustment unit 61 adjusts the phase change amount of the second control filter 19 so as to make the phase of the second control sound coincide with the specified phase. The phase change amount of the second control filter 19 is fixed to the adjusted phase change amount.

When step SB3 is performed, the amplitude/phase adjustment unit 61 adjusts the amplitude of the first control sound and the amplitude of the second control sound so as to optimize the sound pressure value of noise (step SB4). In step SB4, the amplitude/phase adjustment unit 61 monitors sound pressure values measured by surrounding auditory sensation or noise meters and adjusts the amplitude characteristic of the first control filter 13 and the amplitude characteristic of the second control filter 19 so as to optimize the sound pressure values while the phase of the first control loudspeaker 15 and the phase of the second control loudspeaker 21 are fixed. For example, the amplitude characteristic of the first control filter 13 and the amplitude characteristic of the second control filter 19 are preferably adjusted so as to minimize sound pressure values. This will finally decide the amplitude and phase of the first control sound.

When step SB4 is performed, the amplitude/phase adjustment unit 61 adjusts the phase of the second control sound so as to maximize a current amplitude from the second control loudspeaker 21 (step SB5). In step SB5, the amplitude/phase adjustment unit 61 adjusts the phase of the second control sound based on a reference signal from the reference signal acquisition device 11. More specifically, first of all, the amplitude/phase adjustment unit 61 adjusts the phase change amount (phase shift amount) of the second control filter 19 so as to change the phase of the second control sound from 0° to 360°. On the other hand, the amplitude/phase adjustment unit 61 monitors the current amplitude of the second current detection signal for each predetermined phase and searches for a phase in which the current amplitude takes a maximum value. Subsequently, the amplitude/phase adjustment unit 61 adjusts the phase change amount of the second control filter 19 such that the phase of the second control sound (the phase of the second control sound with respect to the phase of the first control sound) coincides with a phase with a maximum value. The phase change amount of the second control filter 19 is fixed to the phase change amount.

When step SB5 is performed, the amplitude/phase adjustment unit 61 adjusts the amplitude of the second control sound so as to optimize the sound pressure value of noise (step SB6). In step SB6, the amplitude/phase adjustment unit 61 monitors the sound pressure values measured by the surrounding auditory sensation or noise meters and adjusts the amplitude characteristic of the second control filter 19 so as to optimize sound pressure values while the amplitude of the first control sound and the phase of the second control sound are fixed. For example, the amplitude characteristic of the second control filter 19 is preferably adjusted so as to minimize a sound pressure value. This will finally adjust the amplitude and phase of the second control sound.

When step SB6 is performed, the noise reduction apparatus 4 according to the second embodiment finishes adjusting the amplitudes and phases of the first and second control sounds.

Note that the above adjustment processing can be variously changed. For example, in steps SB3 and SB5, the reference signal acquisition device 11 may detect a driving current signal as a reference signal instead of the rotational speed or rotational frequency of the rotating system noise source 10. It is possible to adjust the phases of the first and second control sounds with respect to the initial phase of a driving current signal. In addition, the reference signal acquisition device 11 may detect a sound pressure signal from a noise meter as a reference signal. It is possible to adjust the phases of the first and second control sounds with respect to the initial phase of a sound pressure signal.

As described above, the noise reduction apparatus according to the second embodiment includes the first control loudspeaker 15, the first current detector 17, the second control loudspeaker 21, the second current detector 23, and the processing circuit 25. The first control loudspeaker 15 generates the first control sound for reducing noise from a noise source. The first current detector 17 receives noise from a noise source and detects the first current flowing from the first control loudspeaker. The second control loudspeaker 21 is provided at a position different from that of the first control loudspeaker and generates the second control sound for reducing noise from the noise source. The second current detector 23 receives noise from the noise source and detects the second current flowing from the second control loudspeaker. The processing circuit 25 adjusts the first control sound and the second control sound such that the first current and the second current satisfy predetermined conditions. More specifically, the amplitude/phase adjustment unit 35 of the processing circuit 25 initially sets the amplitude and phase of the first control sound and the amplitude and phase of the second control sound based on reference signals. The amplitude/phase adjustment unit 35 then decides the amplitude and phase of the first control sound so as to make the current amplitude of the first current take an almost maximum value, and decides the amplitude and phase of the second control sound so as to make the current amplitude of the second current take an almost maximum value while the amplitude and phase of the first control sound are fixed.

With the above arrangement, the noise reduction apparatus 4 according to the second embodiment can decide the amplitude and phase of the first control sound and the amplitude and phase of the second control sound by directly using back electromotive currents without using any total current amplitude. Using no total current amplitude eliminates the necessity to decide a weighting coefficient β and hence can prevent a reduction in noise reduction effect caused by a setting error of the weighting coefficient β.

The control effect of noise reduction control by the noise reduction apparatus 4 according to the second embodiment will be verified. The phase of the first control sound and the phase of the second control sound which are calculated under various types of predictive calculation conditions will be described first.

Figure 45:
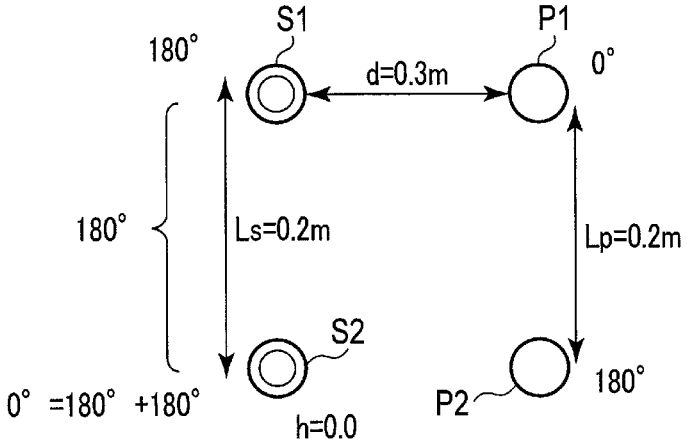
FIG. 45 is a view showing the (2-1-1)th predictive calculation conditions.

FIG. 45 shows the (2-1-1) predictive calculation conditions. As shown in FIG. 45, a distance d between a first noise source P1 and a first control sound source S1 is set to 0.3 m, a distance Ls between the first control sound source S1 and the first control sound source is set to 0.2 m, a shift amount h in the d direction between the first control sound source S1 and a second control sound source S2 is set to 0.0 m, a distance Lp between the first noise source P1 and a second noise source P2 is set to 0.2 m, the initial phase of the first noise source P1 is set to 0°, and the initial phase of the second noise source P2 is set to 180°. Although the initial phases are unknown in an actual operation, the initial phases are set for verification. Note that in the following description, the phase of the first noise source P1 indicates the phase of noise when it is generated from the first noise source P1, and the phase of the second noise source P2 indicates the phase of noise when it is generated from the second noise source P2.

Figure 46:
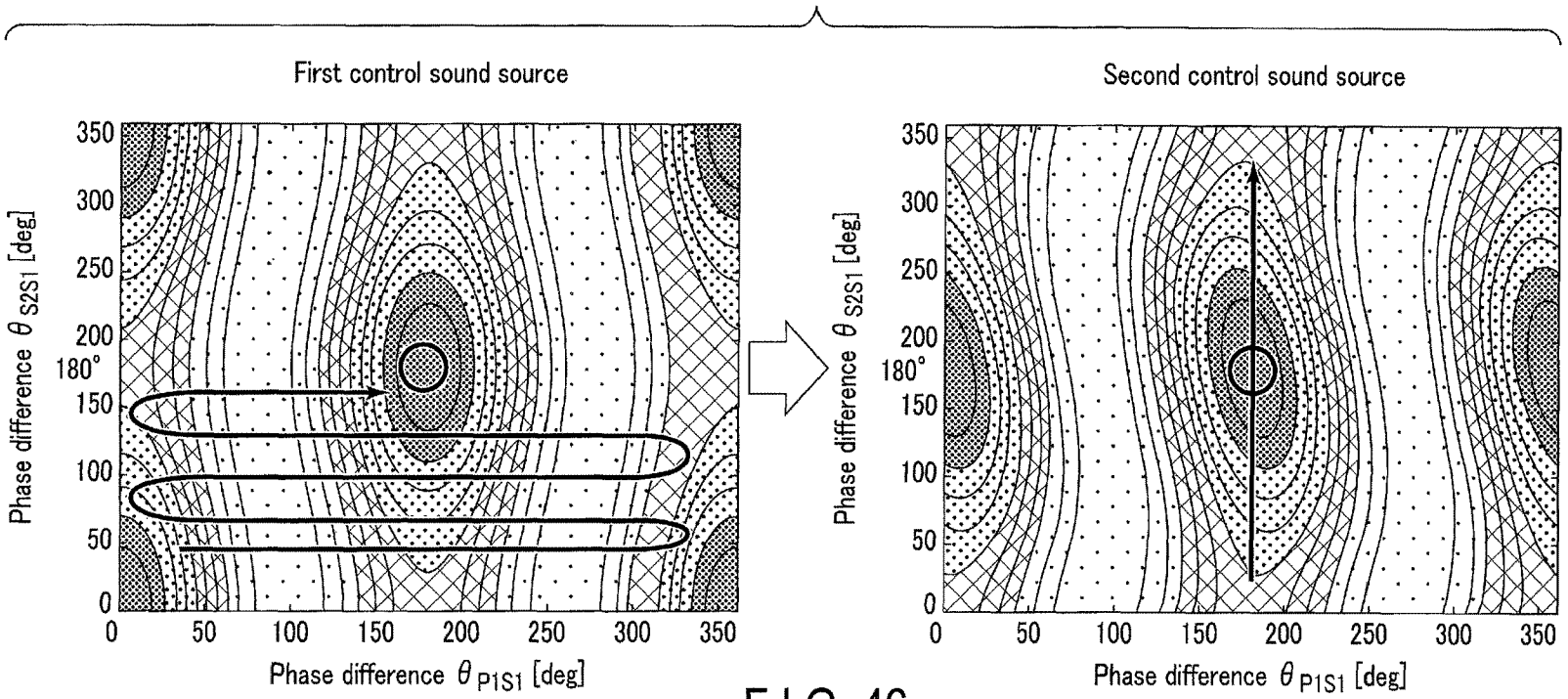
FIG. 46 shows graphs showing the current power spectrum distributions of the first and second control sound sources which are calculated under the (2-1-1)th predictive calculation conditions shown in FIG. 45.

FIG. 46 shows the current power spectrum distributions of the first control sound source and the second control sound source which are calculated under the (2-1-1)th predictive calculation conditions shown in FIG. 45. The left graph of FIG. 46 shows the current power spectrum distribution of the first control sound source. The right graph of FIG. 46 indicates the current power spectrum distribution of the second control sound source. The ordinate and abscissa of each distribution in FIG. 46 are respectively defined as a phase difference $\theta_{S2S1}$ [deg] of the second control sound source with respect to the first control sound source and a phase difference $\theta_{P1S1}$ [deg] of the first control sound source with respect to the first noise source. The arrow superimposed on each distribution in FIG. 46 is an example of a search locus of the phase.

As indicated by the left graph of FIG. 46, a phase in which the current amplitude of the first control sound source is maximized and an amplitude are decided. The phase of the first control sound source with respect to the first noise source is decided to be 180° under the (2-1-1)th predictive calculation conditions. Subsequently, as indicated by the right graph of FIG. 46, a phase in which the current amplitude of the second control sound source is maximized and an amplitude are decided. The phase of the second control sound source with respect to the first control sound source is decided to be 0° under the (2-1-1)th predictive calculation conditions. With respect to the phases of the first noise source and the second noise source (phase of first noise source, phase of second noise source)=(0, 180) having an opposite phase relationship, the phases of the first control sound source and the second control sound source (phase of first control sound source, phase of second control sound source) having an opposite phase relationship are decided to be (180, 0).

FIG. 47 shows the (2-1-2)th predictive calculation conditions. As shown in FIG. 47, the distance d is set to 0.3 m, the distance Ls is set to 0.2 m, the shift amount h is set to 0.0 m, the distance Lp is set to 0.8 m, the initial phase of the first noise source is set to 0°, and the initial phase of the second noise source is set to 180°.

FIG. 48 shows the current power spectrum distributions of the first control sound source and the second control sound source which are calculated under the (2-1-2)th predictive calculation conditions shown in FIG. 47. As indicated by the left graph of FIG. 48, the phase of the first control sound source with respect to the first noise source is decided to be 180°. As indicated by the right graph of FIG. 48, the phase of the second control sound source with respect to the first control sound source is decided to be 180°. With respect to (phase of first noise source, phase of second noise source)=(0, 180), (phase of first control sound source, phase of second control sound source)=(180, 180) is decided. This is because, since the second noise source is distant from an interference distance, the first noise source and the second noise source are regarded as a single noise source with a phase of 0° by the first control sound source and the second control sound source.

Figure 49:
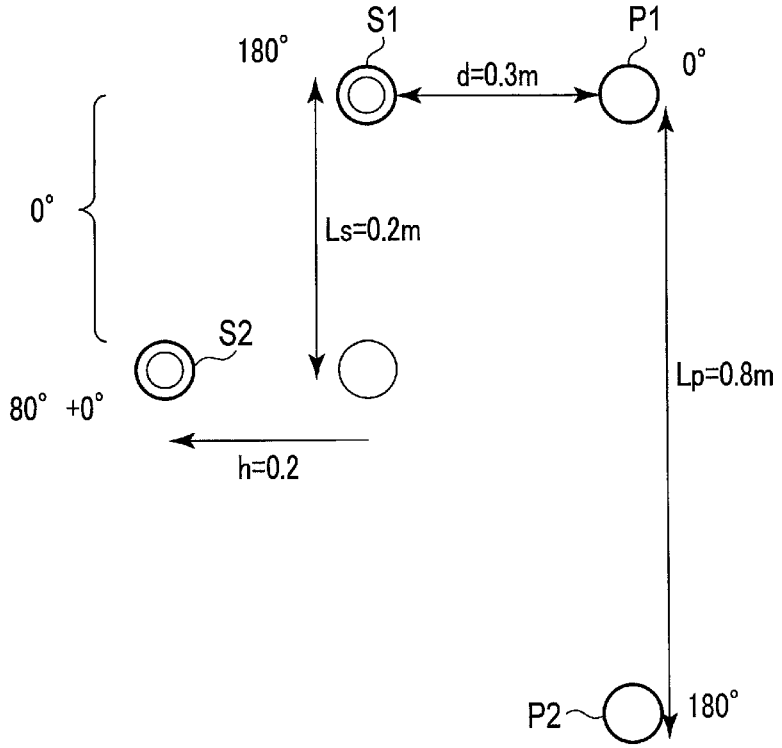
FIG. 49 is a view showing the (2-1-3)th predictive calculation conditions.

FIG. 49 shows the (2-1-3)th predictive calculation conditions. As shown in FIG. 49, the distance d is set to 0.3 m, the distance Ls is set to 0.2 m, the shift amount h is set to 0.2 m, the distance Lp is se to 0.8 m, the initial phase of the first noise source is set to 0°, and the initial phase of the second noise source is set to 180°. With regard to the shift amount h, a direction to approach the noise sources P1 and P2 is defined as a −direction, and a direction to separate from them is defined as a + direction.

Figure 50:
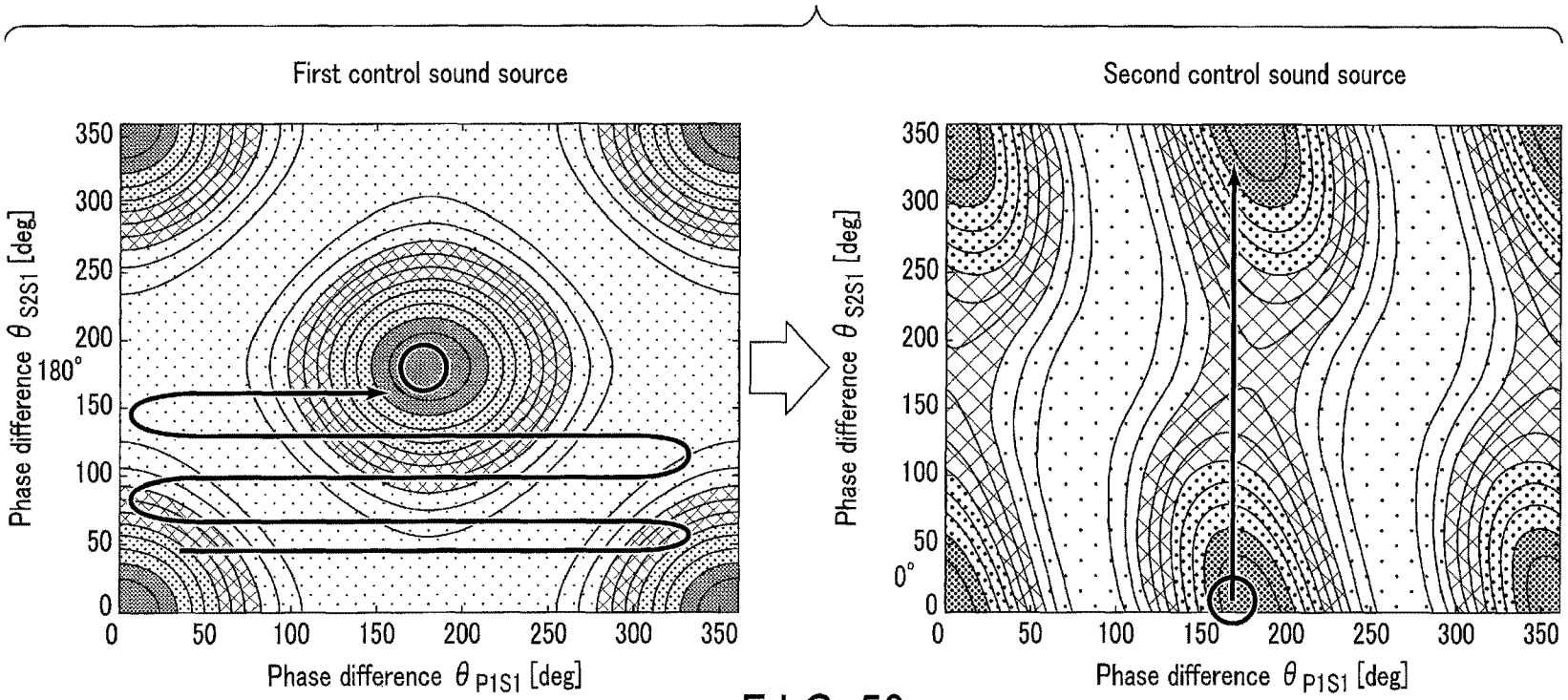
FIG. 50 shows graphs showing the current power spectrum distributions of the first and second control sound sources which are calculated under the (2-1-3)th predictive calculation conditions shown in FIG. 49.

FIG. 50 shows the current power spectrum distributions of the first control sound source and the second control sound source which are calculated under the (2-1-3)th predictive calculation conditions shown in FIG. 49. As indicated by the left graph of FIG. 50, the phase of the first control sound source with respect to the first noise source is decided to be 180°. As indicated by the right graph of FIG. 50, the phase of the second control sound source with respect to the first control sound source is decided to be 180°. With respect to (phase of first noise source, phase of second noise source)=(0, 180), (phase of first control sound source, phase of second control sound source)=(180, 180) is decided. This is because, since the second noise source is distant from an interference distance, the first noise source and the second noise source are regarded as a single noise source with a phase of 0° by the first control sound source and the second control sound source.

Figure 51:
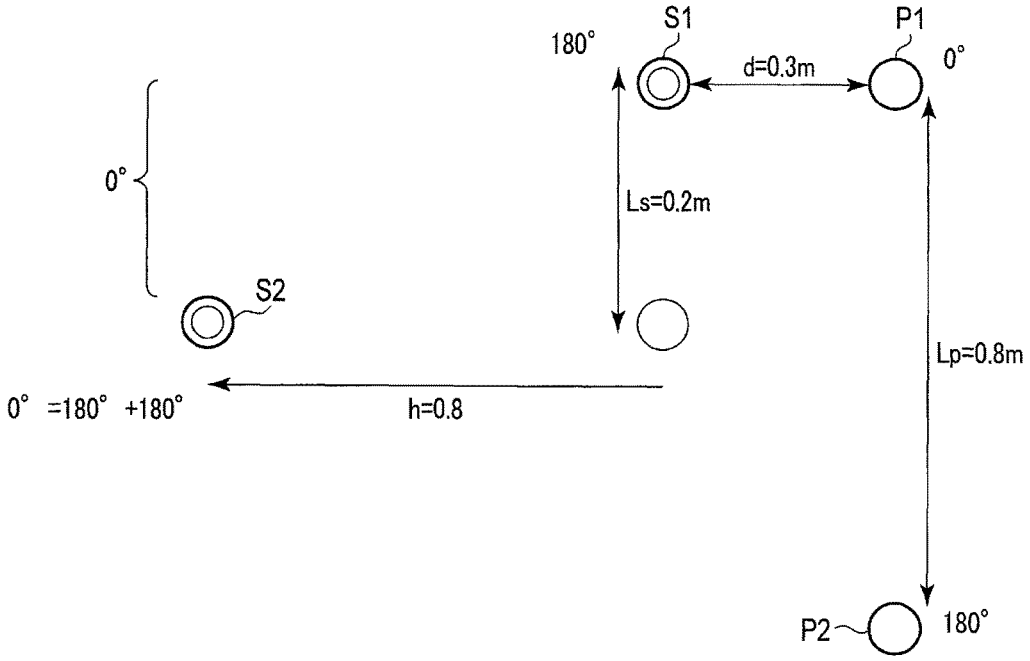
FIG. 51 is a view showing the (2-1-4)th predictive calculation conditions.

FIG. 51 shows the (2-1-4)th predictive calculation conditions. As shown in FIG. 51, the distance d is set to 0.3 m, the distance Ls is set to 0.2 m, the shift amount h is set to 0.8 m, the distance Lp is se to 0.8 m, the initial phase of the first noise source is set to 0°, and the initial phase of the second noise source is set to 180°.

Figure 52:
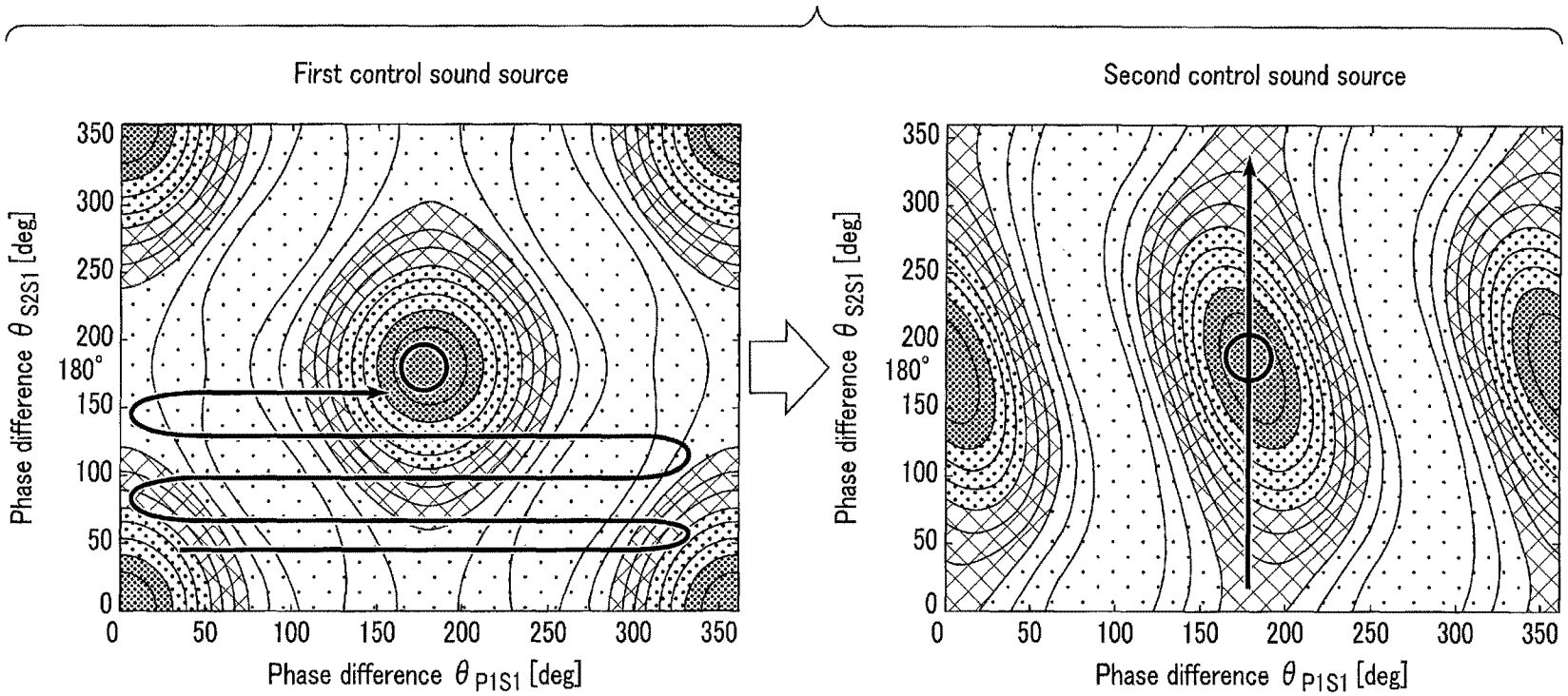
FIG. 52 shows graphs showing the current power spectrum distributions of the first and second control sound sources which are calculated under the (2-1-4)th predictive calculation conditions shown in FIG. 51.

FIG. 52 shows the current power spectrum distributions of the first control sound source and the second control sound source which are calculated under the (2-1-4)th predictive calculation conditions shown in FIG. 51. As indicated by the left graph of FIG. 52, the phase of the first control sound source with respect to the first noise source is decided to be 180°. As indicated by the right graph of FIG. 52, the phase of the second control sound source with respect to the first control sound source is decided to be 0°. With respect to (phase of first noise source, phase of second noise source)=(0, 180), (phase of first control sound source, phase of second control sound source)=(180, 0) is decided. This is because, since the second noise source is distant from an interference distance and the second control sound source is distant from the first noise source and the second noise source, the first noise source and the second noise source are regarded as a single noise source with a phase of 0° by the first control sound source, and the second control sound source does not contribute to interference.

Figure 53:
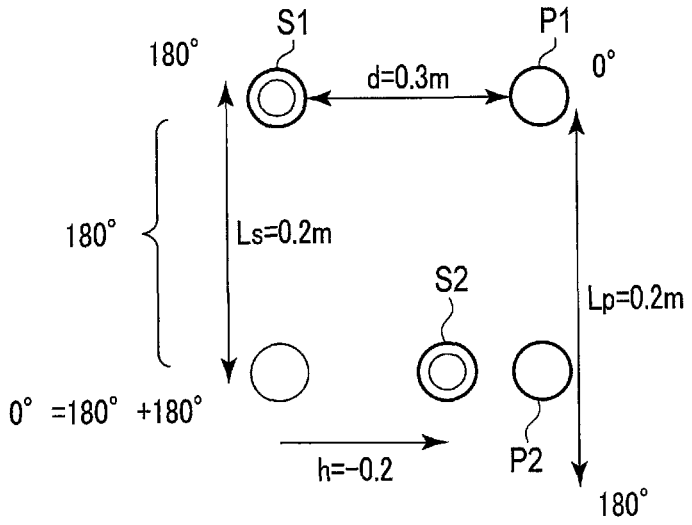
FIG. 53 is a view showing the (2-1-5)th predictive calculation conditions.

FIG. 53 shows the (2-1-5)th predictive calculation conditions. As shown in FIG. 53, the distance d is set to 0.3 m, the distance Ls is set to 0.2 m, the shift amount h is set to −0.2 m, the distance Lp is se to 0.2 m, the initial phase of the first noise source is set to 0°, and the initial phase of the second noise source is set to 180°.

Figure 54:
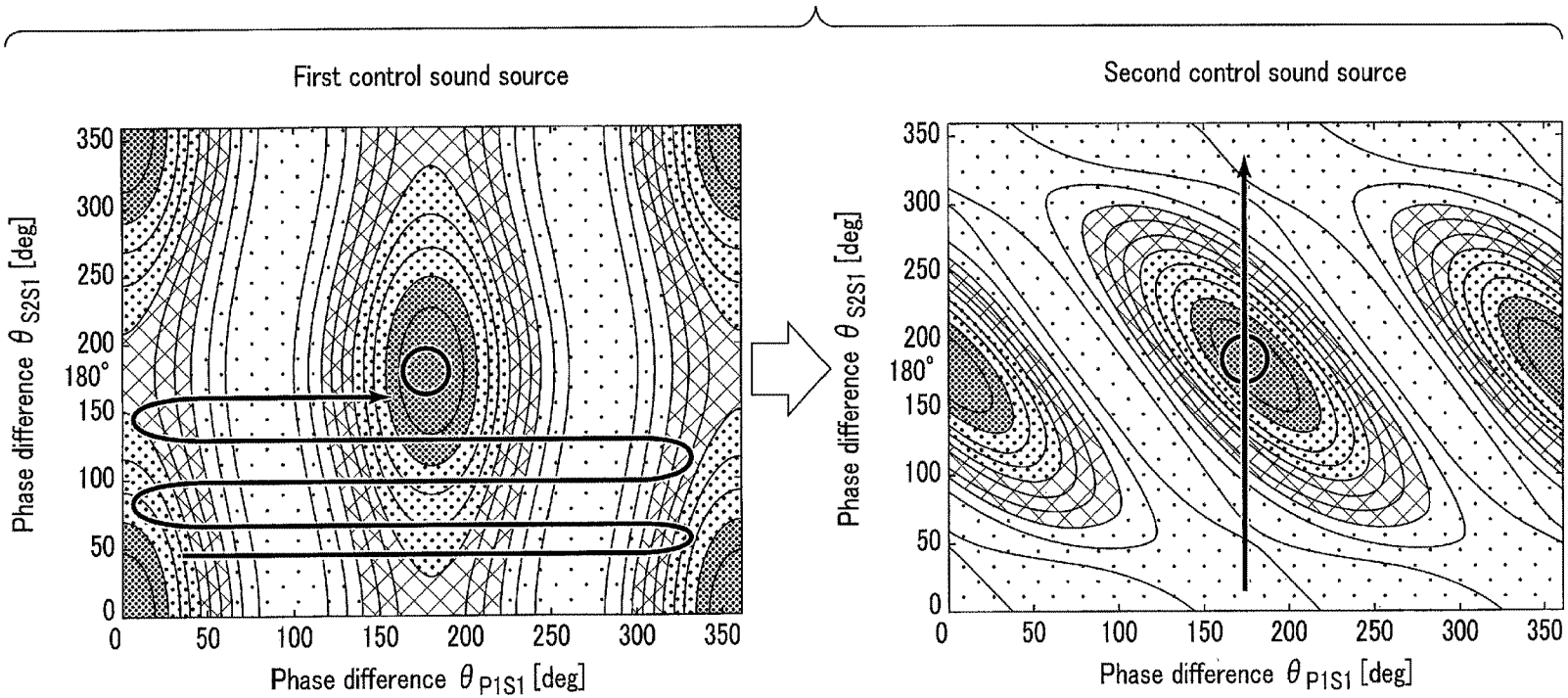
FIG. 54 shows graphs showing the current power spectrum distributions of the first and second control sound sources which are calculated under the (2-1-5)th predictive calculation conditions shown in FIG. 53.

FIG. 54 shows the current power spectrum distributions of the first control sound source and the second control sound source which are calculated under the (2-1-5)th predictive calculation conditions shown in FIG. 53. As indicated by the left graph of FIG. 54, the phase of the first control sound source with respect to the first noise source is decided to be 180°. As indicated by the right graph of FIG. 54, the phase of the second control sound source with respect to the first control sound source is decided to be 0°. That is, with respect to (phase of first noise source, phase of second noise source)=(0, 180), (phase of first control sound source, phase of second control sound source)=(180, 0) is decided. This is because, since the second control sound source is located close to the first noise source and the second noise source, interference easily occurs.

Figure 55:
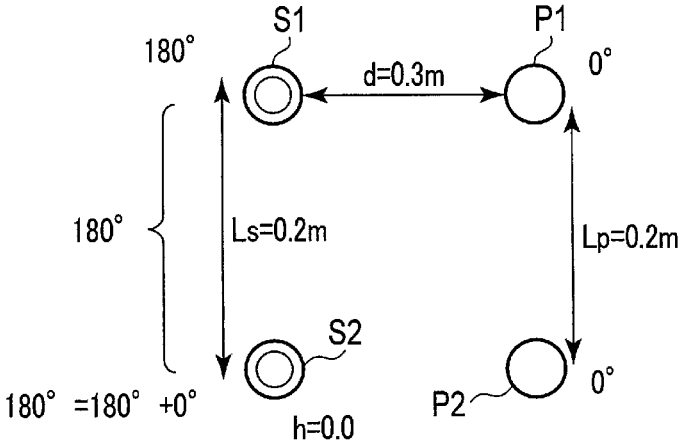
FIG. 55 is a view showing the (2-1-6)th predictive calculation conditions.

FIG. 55 shows the (2-1-6)th predictive calculation conditions. As shown in FIG. 55, the distance d is set to 0.3 m, the distance Ls is set to 0.2 m, the shift amount h is set to 0.0 m, the distance Lp is se to 0.2 m, the initial phase of the first noise source is set to 0°, and the initial phase of the second noise source is set to 0°.

Figure 56:
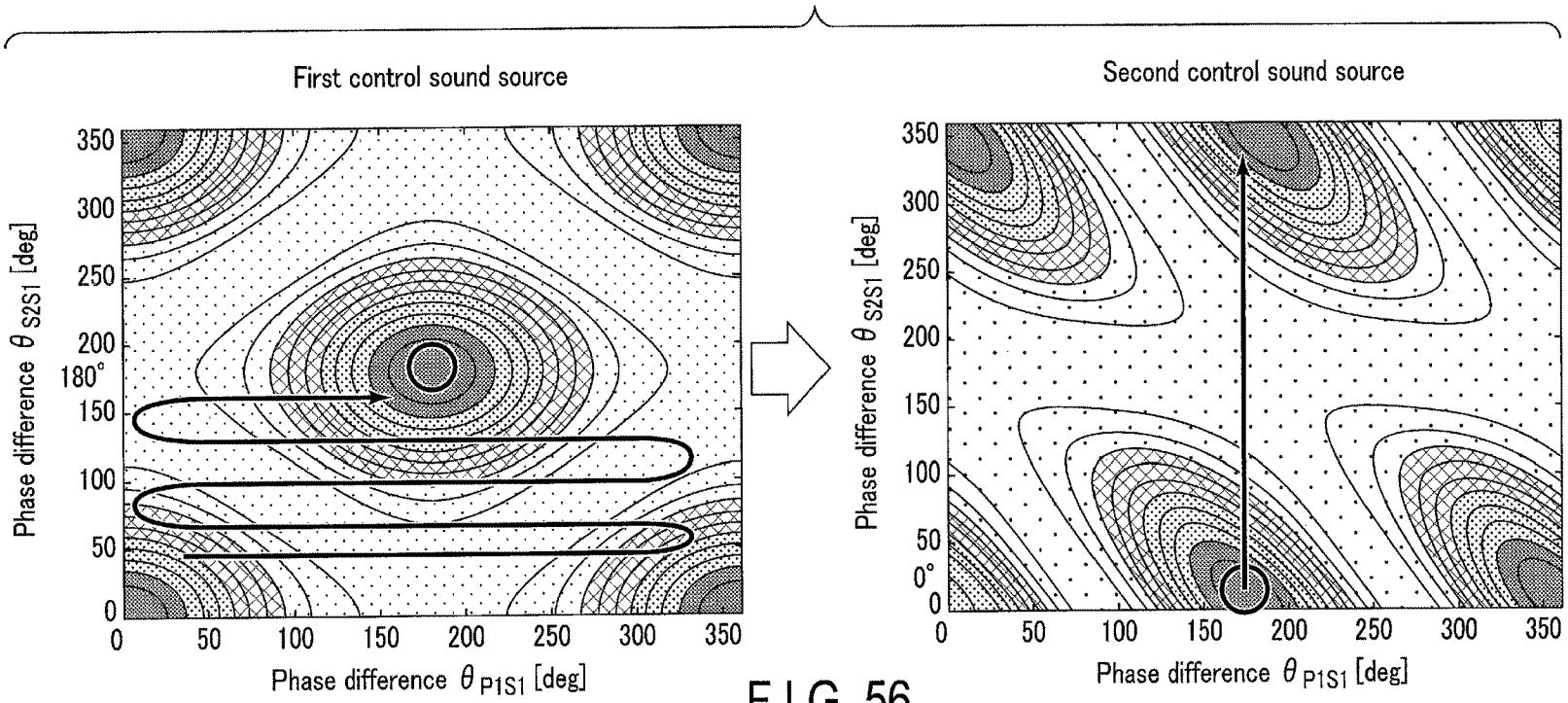
FIG. 56 shows graphs showing the current power spectrum distributions of the first and second control sound sources which are calculated under the (2-1-6)th predictive calculation conditions shown in FIG. 55.

FIG. 56 shows the current power spectrum distributions of the first control sound source and the second control sound source which are calculated under the (2-1-6)th predictive calculation conditions shown in FIG. 55. As indicated by the left graph of FIG. 56, the phase of the first control sound source with respect to the first noise source is decided to be 180°. As indicated by the right graph of FIG. 56, the phase of the second control sound source with respect to the first control sound source is decided to be 180°. That is, with respect to (phase of first noise source, phase of second noise source)=(0, 0), (phase of first control sound source, phase of second control sound source)=(180, 180) is decided.

Figure 57:
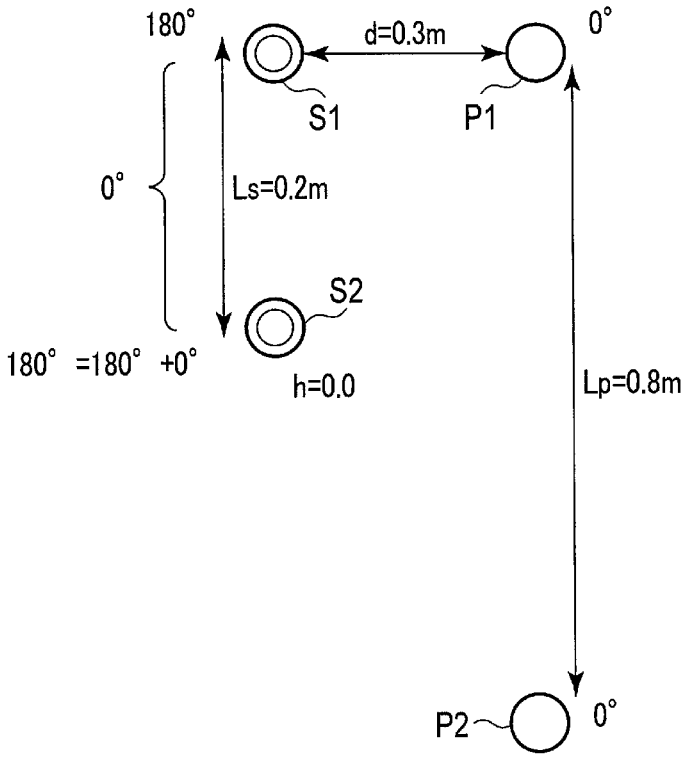
FIG. 57 is a view showing the (2-1-7)th predictive calculation conditions.

FIG. 57 shows the (2-1-7)th predictive calculation conditions. As shown in FIG. 57, the distance d is set to 0.3 m, the distance Ls is set to 0.2 m, the shift amount h is set to 0.0 m, the distance Lp is se to 0.8 m, the initial phase of the first noise source is set to 0°, and the initial phase of the second noise source is set to 0°.

Figure 58:
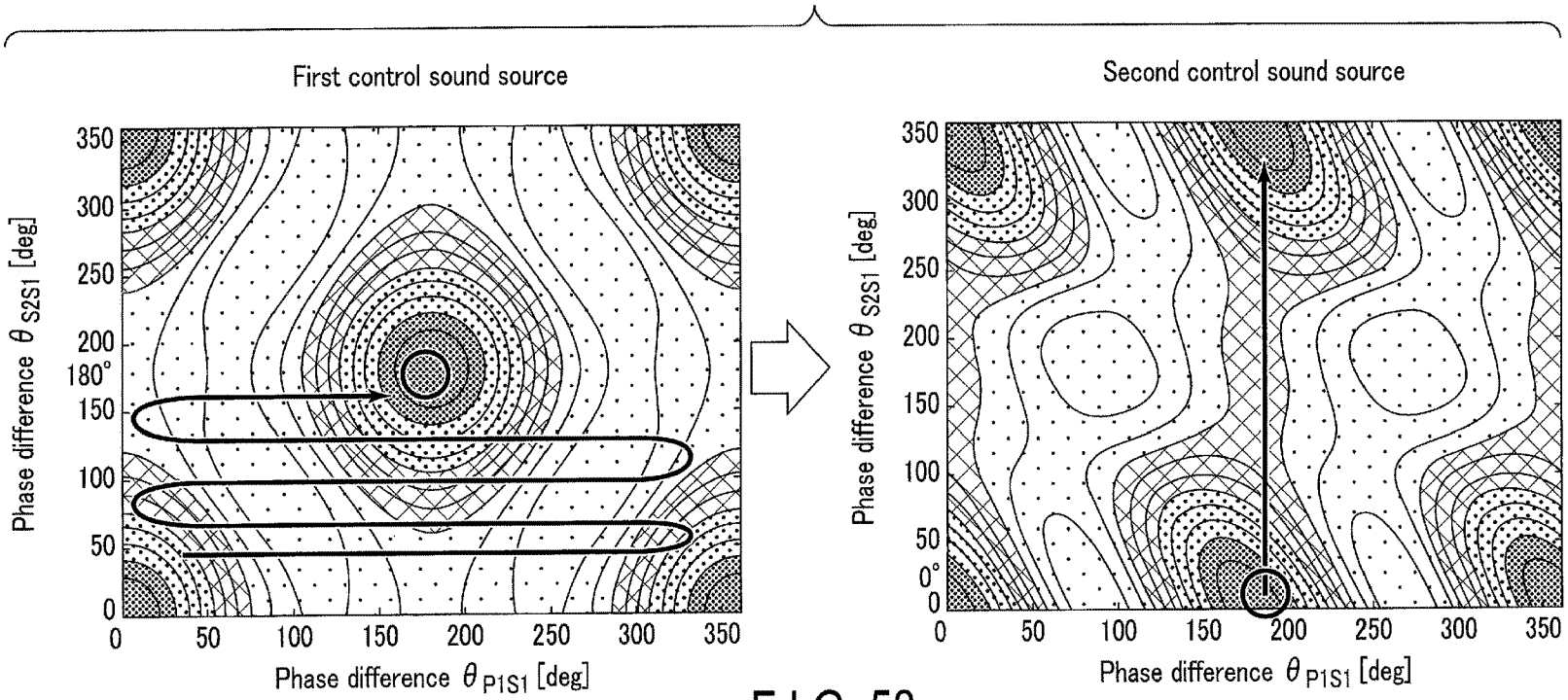
FIG. 58 shows graphs showing the current power spectrum distributions of the first and second control sound sources which are calculated under the (2-1-7)th predictive calculation conditions shown in FIG. 57.

FIG. 58 shows the current power spectrum distributions of the first control sound source and the second control sound source which are calculated under the (2-1-7)th predictive calculation conditions shown in FIG. 57. As indicated by the left graph of FIG. 58, the phase of the first control sound source with respect to the first noise source is decided to be 180°. As indicated by the right graph of FIG. 58, the phase of the second control sound source with respect to the first control sound source is decided to be 180°. That is, with respect to (phase of first noise source, phase of second noise source)=(0, 0), (phase of first control sound source, phase of second control sound source)=(180, 180) is decided. Because the second noise source is distant from an interference distance, there is no influence of the second noise source. This is because the first noise source and the second noise source are regarded as a single noise source with a phase of 0° by the first control sound source and the second sound source.

Figure 59:
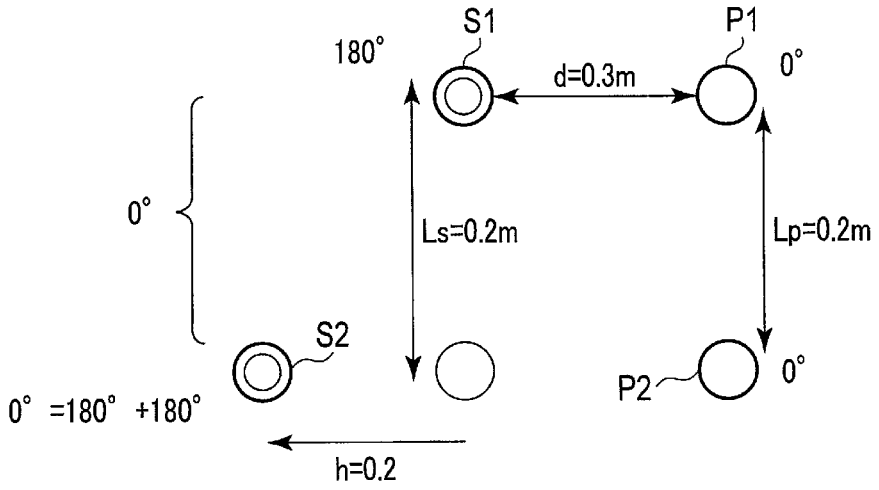
FIG. 59 is a view showing the (2-1-8)th predictive calculation conditions.

FIG. 59 shows the (2-1-8)th predictive calculation conditions. As shown in FIG. 59, the distance d is set to 0.3 m, the distance Ls is set to 0.2 m, the shift amount h is set to 0.2 m, the distance Lp is se to 0.2 m, the initial phase of the first noise source is set to 0°, and the initial phase of the second noise source is set to 0°.

Figure 60:
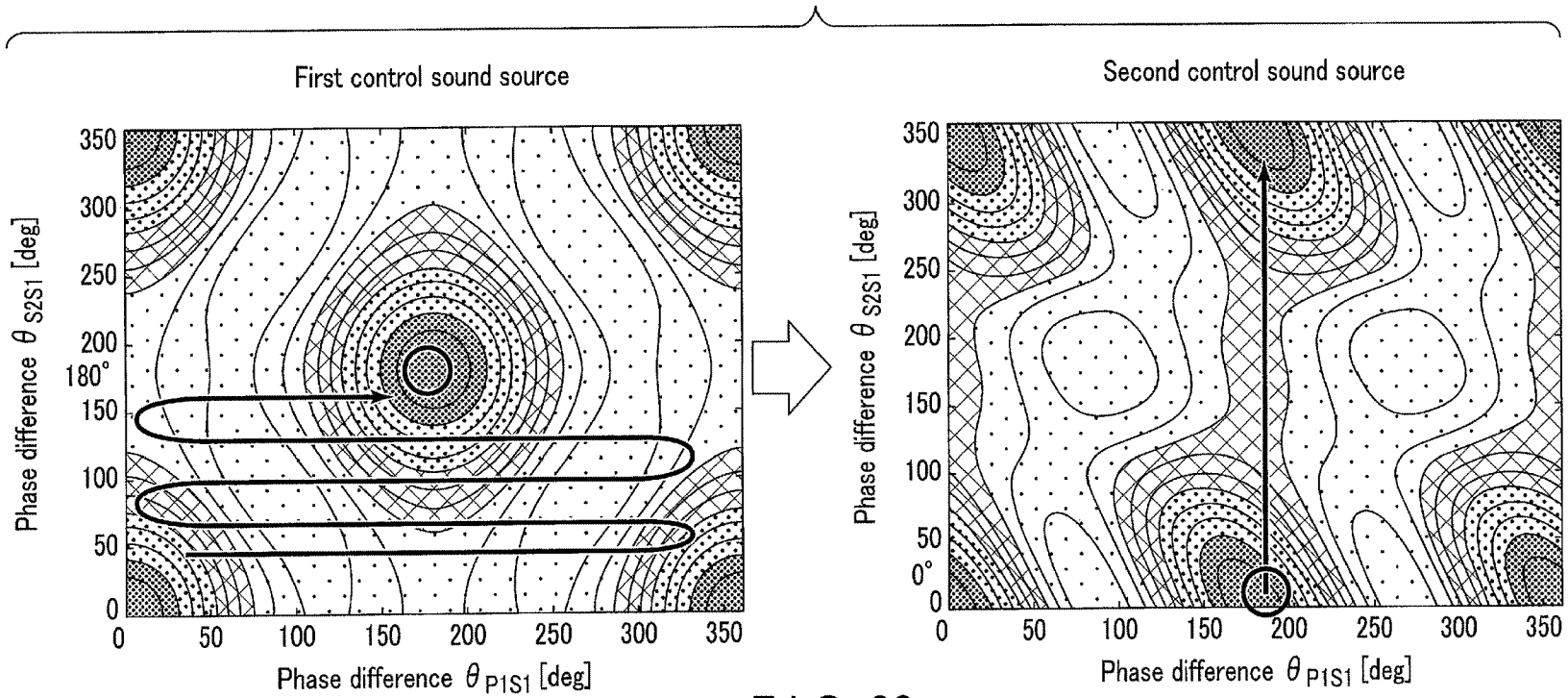
FIG. 60 shows graphs showing the current power spectrum distributions of the first and second control sound sources which are calculated under the (2-1-8)th predictive calculation conditions shown in FIG. 59.

FIG. 60 shows the current power spectrum distributions of the first control sound source and the second control sound source which are calculated under the (2-1-8)th predictive calculation conditions shown in FIG. 59. As indicated by the left graph of FIG. 60, the phase of the first control sound source with respect to the first noise source is decided to be 180°. As indicated by the right graph of FIG. 60, the phase of the second control sound source with respect to the first control sound source is decided to be 180°. That is, with respect to (phase of first noise source, phase of second noise source)=(0, 0), (phase of first control sound source, phase of second control sound source)=(180, 180) is decided. This is because, since the second noise source is distant from an interference distance, the first noise source and the second noise source are regarded as a single noise source with a phase of 0° by the first control sound source and the second control sound source.

Figure 61:
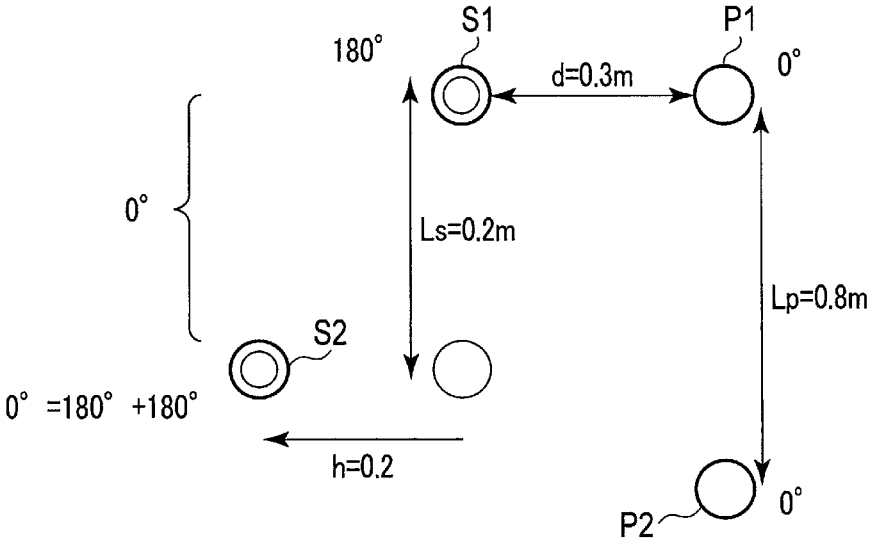
FIG. 61 is a view showing the (2-1-9)th predictive calculation conditions.

FIG. 61 shows the (2-1-9)th predictive calculation conditions. As shown in FIG. 61, the distance d is set to 0.3 m, the distance Ls is set to 0.2 m, the shift amount h is set to 0.2 m, the distance Lp is se to 0.8 m, the initial phase of the first noise source is set to 0°, and the initial phase of the second noise source is set to 0°.

Figure 62:
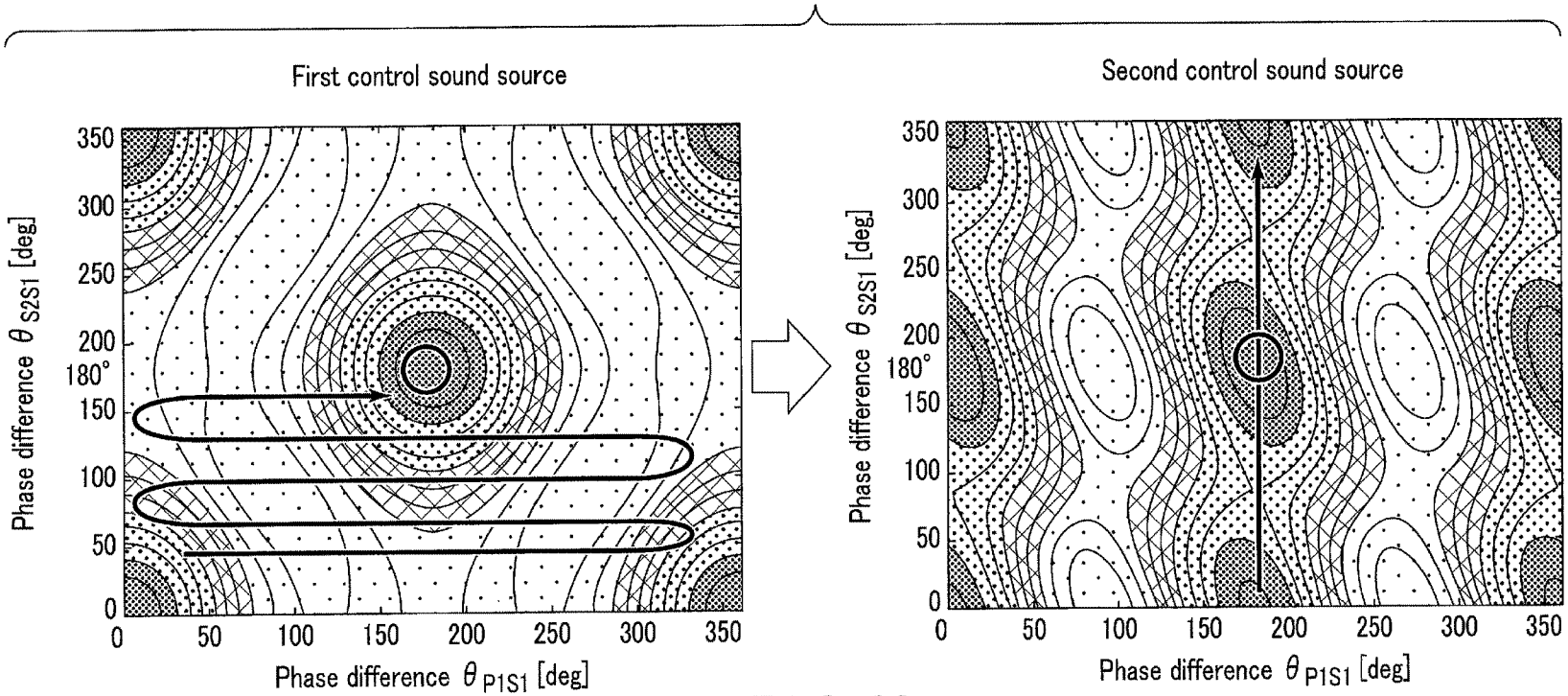
FIG. 62 shows graphs showing the current power spectrum distributions of the first and second control sound sources which are calculated under the (2-1-9)th predictive calculation conditions shown in FIG. 61.

FIG. 62 shows the current power spectrum distributions of the first control sound source and the second control sound source which are calculated under the (2-1-9)th predictive calculation conditions shown in FIG. 61. As indicated by the left graph of FIG. 62, the phase of the first control sound source with respect to the first noise source is decided to be 180°. As indicated by the right graph of FIG. 62, the phase of the second control sound source with respect to the first control sound source is decided to be 0°. That is, with respect to (phase of first noise source, phase of second noise source)=(0, 0), (phase of first control sound source, phase of second control sound source)=(180, 180) is decided. This is because, since the second noise source is distant from an interference distance, the first noise source and the second noise source are regarded as a single noise source with a phase of 0° by the first control sound source and the second control sound source. In addition, this is because, since the second control sound source is distant from the first control sound source, interference deterioration occurs.

Figure 63:
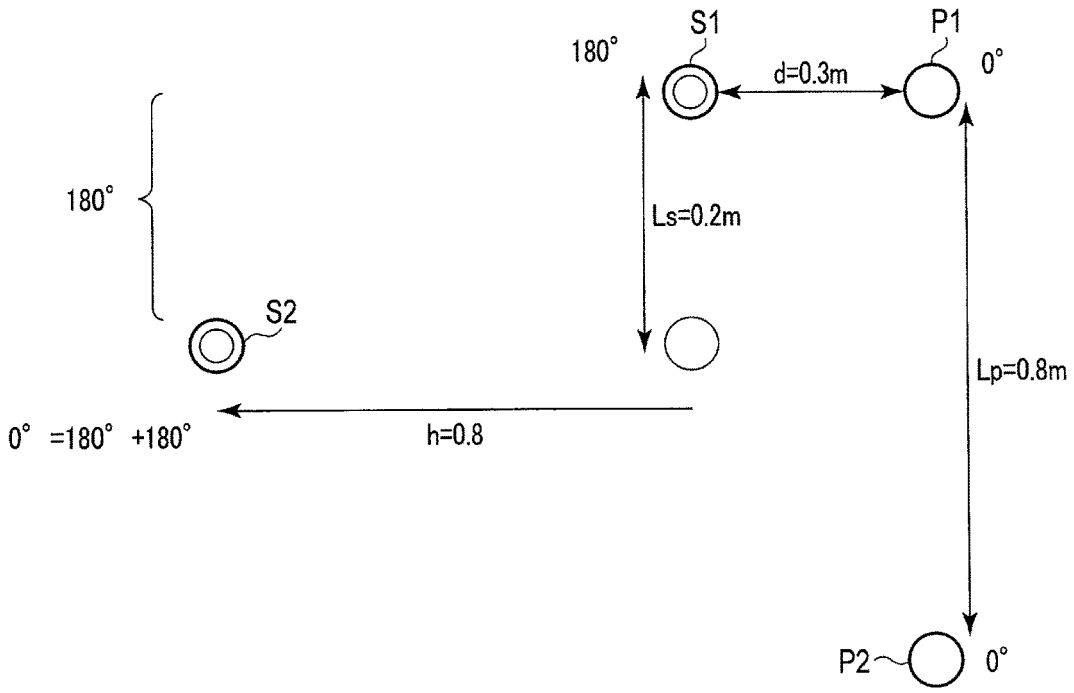
FIG. 63 is a view showing the (2-1-10)th predictive calculation conditions.

FIG. 63 shows the (2-1-10)th predictive calculation conditions. As shown in FIG. 63, the distance d is set to 0.3 m, the distance Ls is set to 0.2 m, the shift amount h is set to 0.8 m, the distance Lp is se to 0.8 m, the initial phase of the first noise source is set to 0°, and the initial phase of the second noise source is set to 0°.

Figure 64:
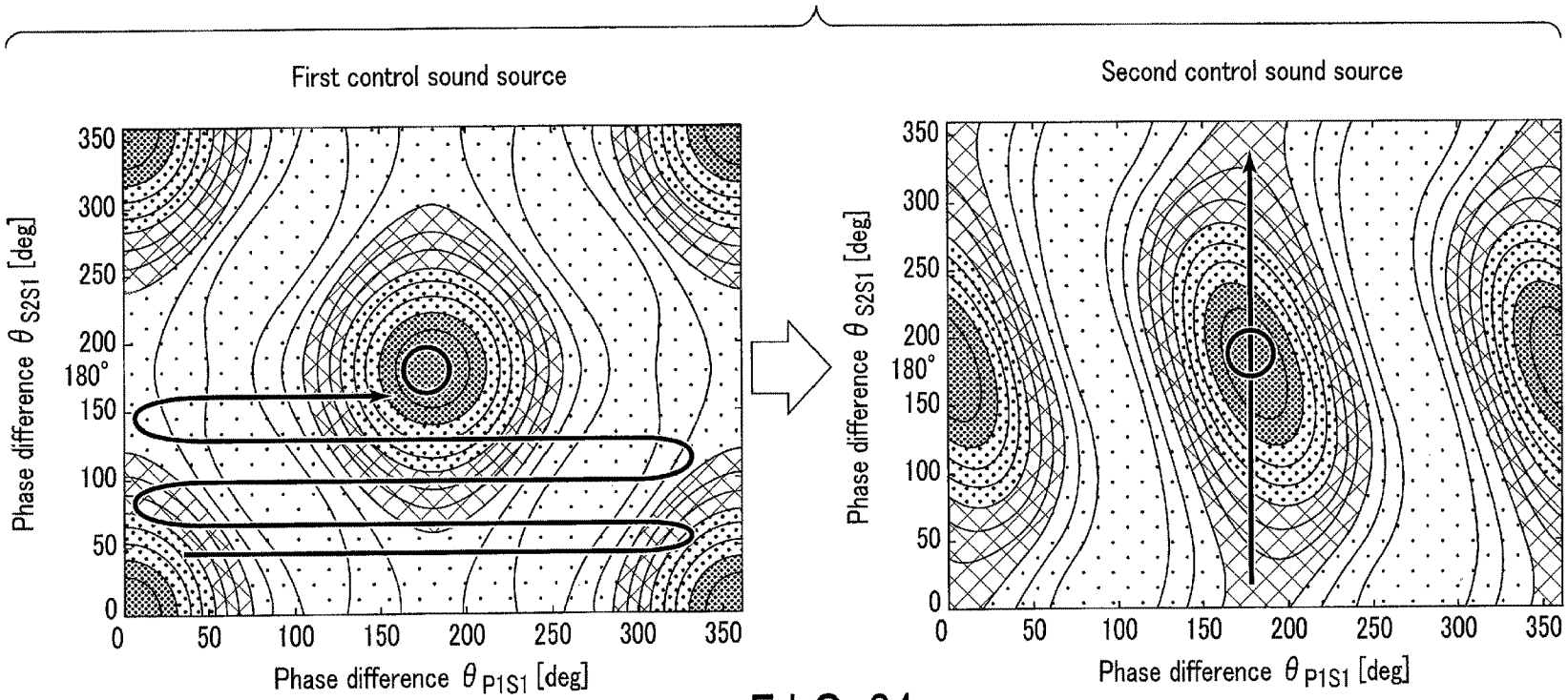
FIG. 64 shows graphs showing the current power spectrum distributions of the first and second control sound sources which are calculated under the (2-1-10)th predictive calculation conditions shown in FIG. 63.

FIG. 64 shows the current power spectrum distributions of the first control sound source and the second control sound source which are calculated under the (2-1-10)th predictive calculation conditions shown in FIG. 63. As indicated by the left graph of FIG. 64, the phase of the first control sound source with respect to the first noise source is decided to be 180°. As indicated by the right graph of FIG. 64, the phase of the second control sound source with respect to the first control sound source is decided to be 0°. That is, with respect to (phase of first noise source, phase of second noise source)=(0, 0), (phase of first control sound source, phase of second control sound source)=(180, 0) is decided. This is because, since the second noise source is distant from an interference distance and the second control sound source, the first noise source and the second noise source are regarded as a single noise source with a phase of 0° by the first control sound source. In addition, this is because, the second control sound source is distant from the first control sound source, the second sound source does not contribute to interference.

Figure 65:
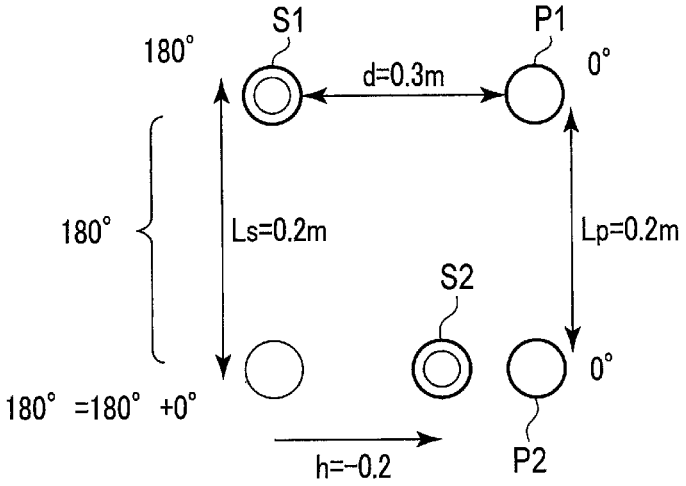
FIG. 65 is a view showing the (2-1-11)th predictive calculation conditions.

FIG. 65 shows the (2-1-11)th predictive calculation conditions. As shown in FIG. 65, the distance d is set to 0.3 m, the distance Ls is set to 0.2 m, the shift amount h is set to −0.2 m, the distance Lp is se to 0.2 m, the initial phase of the first noise source is set to 0°, and the initial phase of the second noise source is set to 0°.

Figure 66:
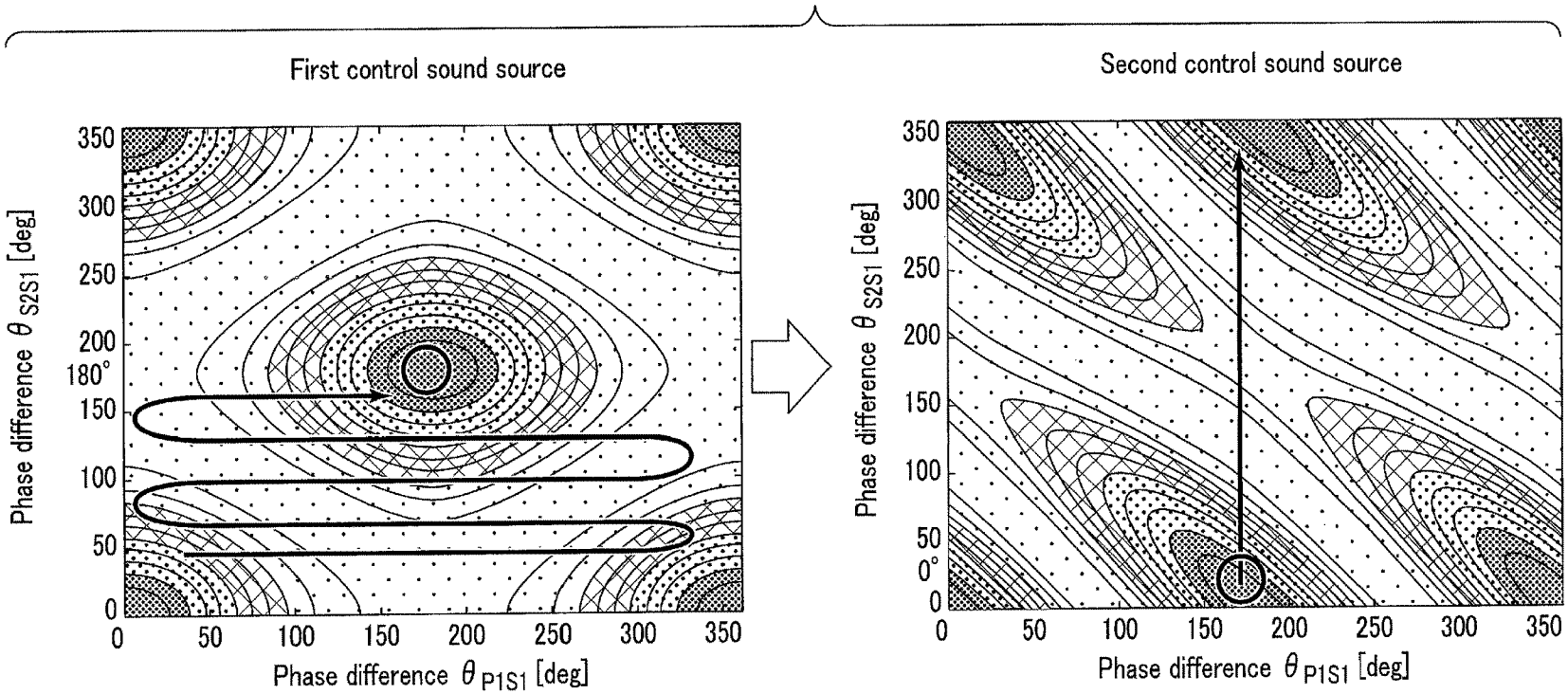
FIG. 66 shows graphs showing the current power spectrum distributions of the first and second control sound sources which are calculated under the (2-1-11)th predictive calculation conditions shown in FIG. 65.

FIG. 66 shows the current power spectrum distributions of the first control sound source and the second control sound source which are calculated under the (2-1-11)th predictive calculation conditions shown in FIG. 65. As indicated by the left graph of FIG. 66, the phase of the first control sound source with respect to the first noise source is decided to be 180°. As indicated by the right graph of FIG. 66, the phase of the second control sound source with respect to the first control sound source is decided to be 180°. That is, with respect to (phase of first noise source, phase of second noise source)=(0, 0), (phase of first control sound source, phase of second control sound source)=(180, 180) is decided. This is because, since the second control sound source is located close to the first noise source and the second noise source, interference easily occurs.

Figure 67:
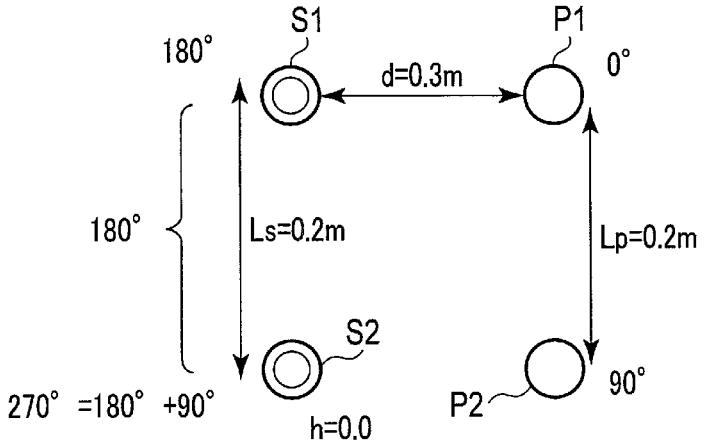
FIG. 67 is a view showing the (2-1-12)th predictive calculation conditions.

FIG. 67 shows the (2-1-12)th predictive calculation conditions. As shown in FIG. 67, the distance d is set to 0.3 m, the distance Ls is set to 0.2 m, the shift amount h is set to 0.0 m, the distance Lp is se to 0.2 m, the initial phase of the first noise source is set to 0°, and the initial phase of the second noise source is set to 90°.

Figure 68:
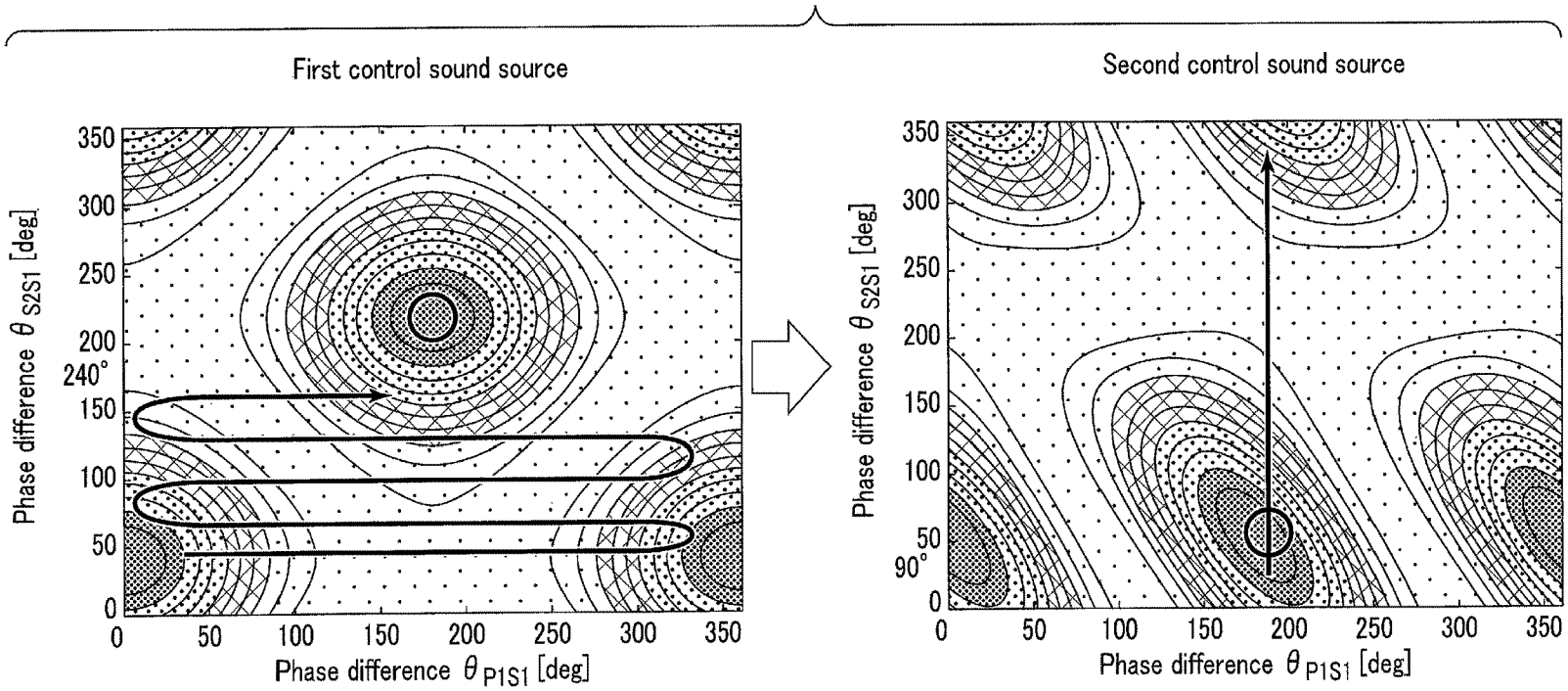
FIG. 68 shows graphs showing the current power spectrum distributions of the first and second control sound sources which are calculated under the (2-1-12)th predictive calculation conditions shown in FIG. 67.

FIG. 68 shows the current power spectrum distributions of the first control sound source and the second control sound source which are calculated under the (2-1-12)th predictive calculation conditions shown in FIG. 67. As indicated by the left graph of FIG. 68, the phase of the first control sound source with respect to the first noise source is decided to be 180°, and the phase of the second control sound source with respect to the first control sound source is decided to be 240°. As indicated by the right graph of FIG. 68, the phase of the second control sound source with respect to the first control sound source is further adjusted and decided to be 90°, and is decided to be 240°+90°=270°. That is, with respect to (phase of first noise source, phase of second noise source)=(0, 90), which are shifted by 90° from each other, (phase of first control sound source, phase of second control sound source)=(180, 270) is decided.

Figure 69:
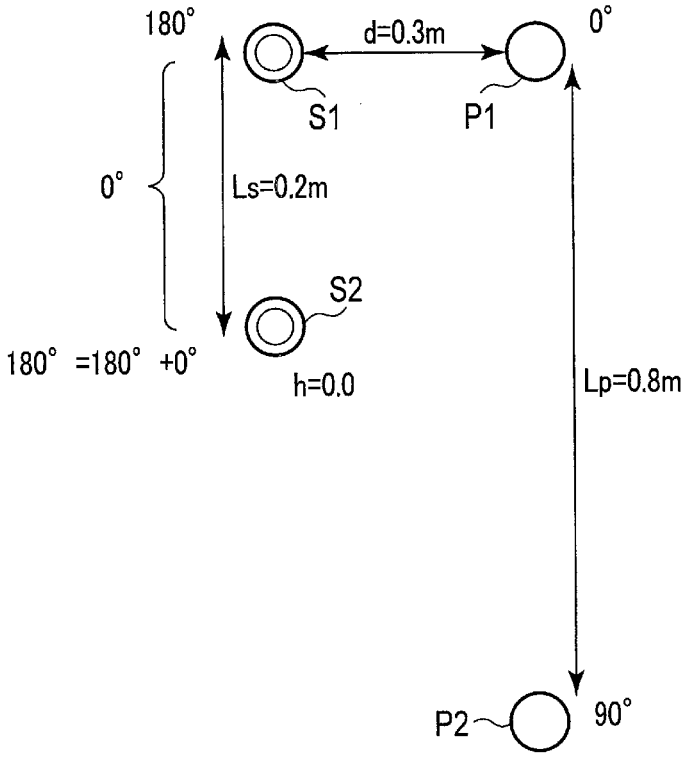
FIG. 69 is a view showing the (2-1-13)th predictive calculation conditions.

FIG. 69 shows the (2-1-13)th predictive calculation conditions. As shown in FIG. 69, the distance d is set to 0.3 m, the distance Ls is set to 0.2 m, the shift amount h is set to 0.0 m, the distance Lp is se to 0.8 m, the initial phase of the first noise source is set to 0°, and the initial phase of the second noise source is set to 90°.

Figure 70:
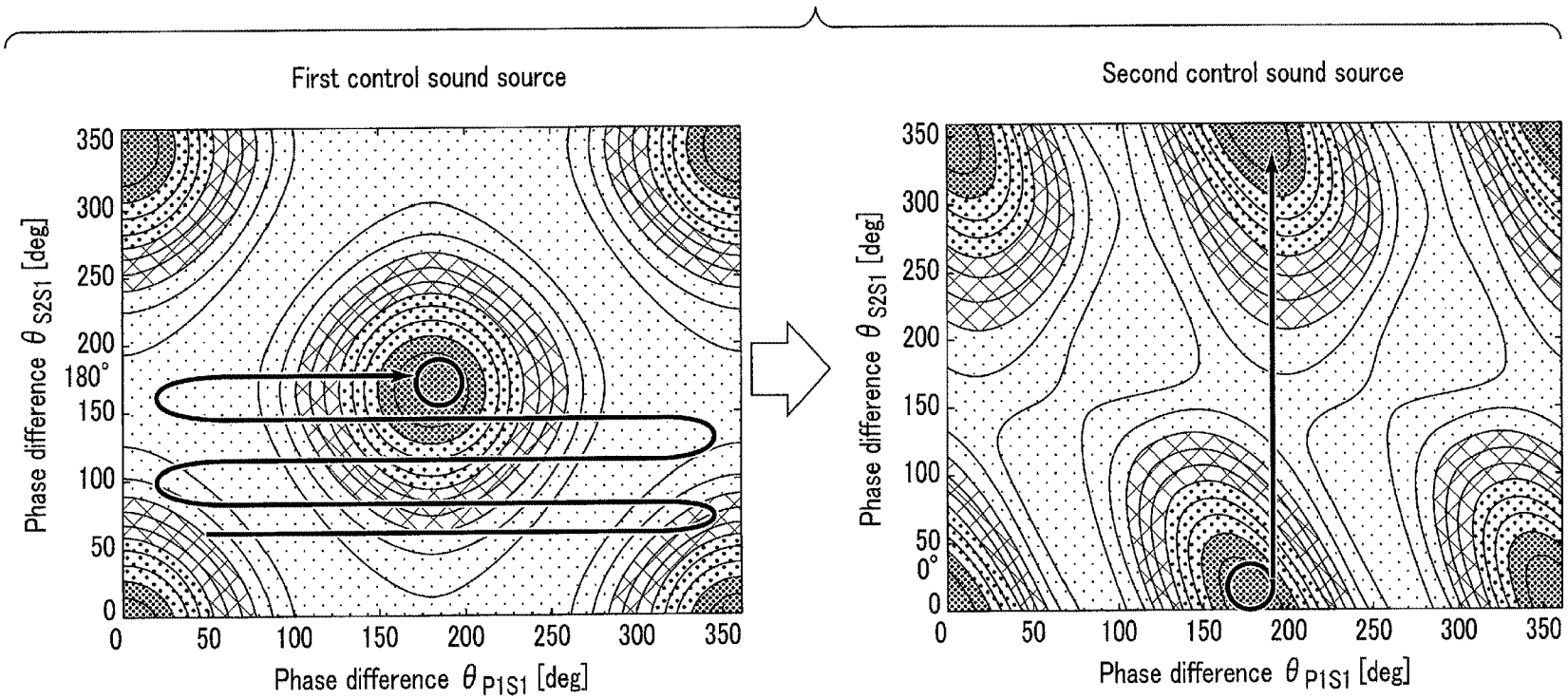
FIG. 70 shows graphs showing the current power spectrum distributions of the first and second control sound sources which are calculated under the (2-1-13)th predictive calculation conditions shown in FIG. 69.

FIG. 70 shows the current power spectrum distributions of the first control sound source and the second control sound source which are calculated under the (2-1-13)th predictive calculation conditions shown in FIG. 69. As indicated by the left graph of FIG. 70, the phase of the first control sound source with respect to the first noise source is decided to be 180°. As indicated by the right graph of FIG. 70, the phase of the second control sound source with respect to the first control sound source is decided to be 0°. That is, with respect to (phase of first noise source, phase of second noise source)=(0, 90), (phase of first control sound source, phase of second control sound source)=(180, 180) is decided. This is because, since the second noise source is distant from an interference distance, the second noise source has no influence on the first control sound source and the second control sound source.

Changes in current power spectrum distribution with changes in the distance Lp under various predictive calculation conditions will be described next.

Figure 71:
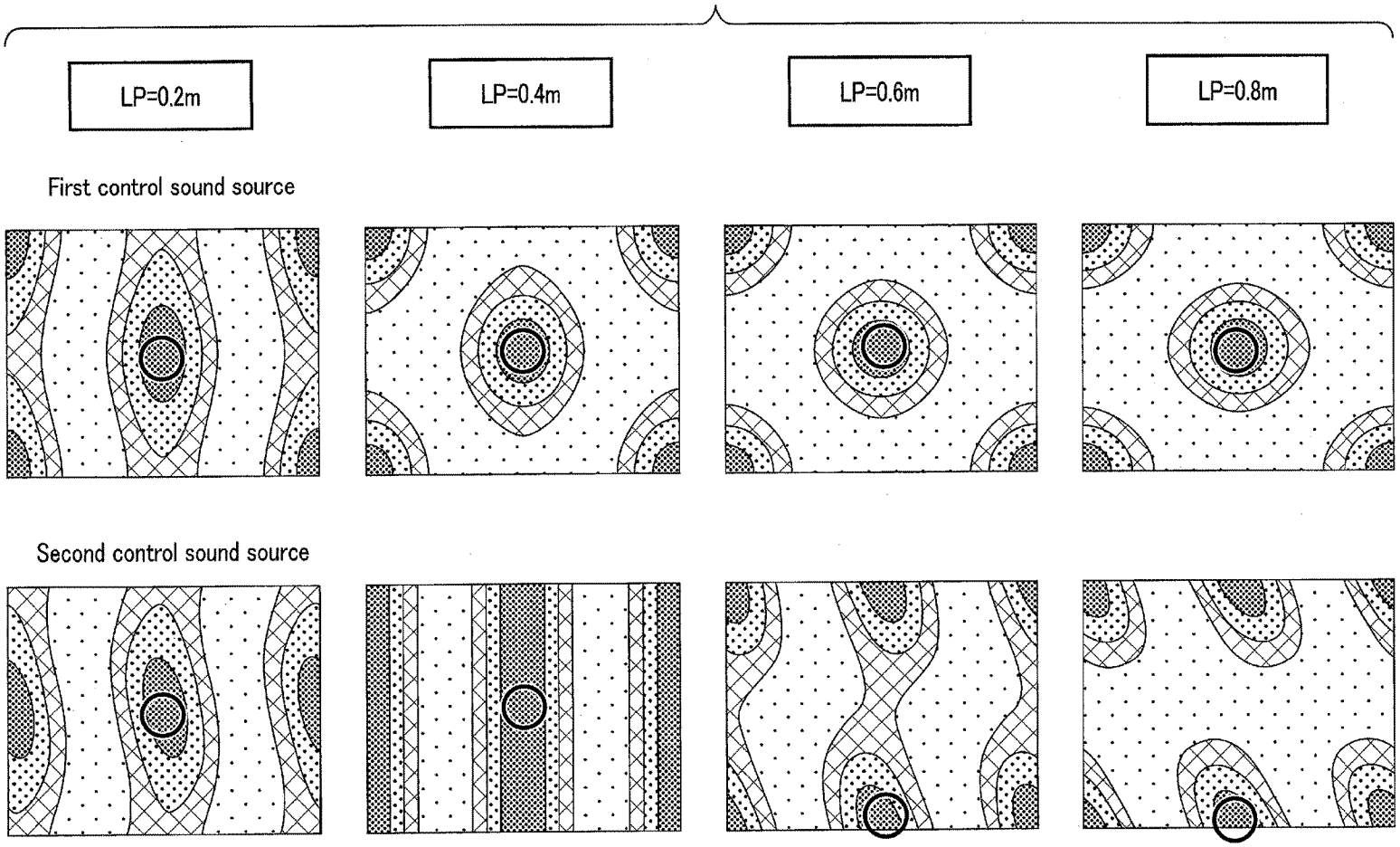
FIG. 71 is a view showing a change in current power spectrum distribution calculated under the (2-2-1)th predictive calculation conditions.

FIG. 71 shows a change in current power spectrum distribution calculated under the (2-2-1)th predictive calculation conditions. According to the (2-2-1)th predictive calculation conditions, the distance d is 0.3 m, the distance Ls is 0.2 m, the shift amount h is 0.0 m, the initial phase of the first noise source is 0°, the initial phase of the second noise source is 180°, the frequency of noise is 200 Hz.

The upper graphs of FIG. 71 each show the current power spectrum distribution of the first control sound source. The lower graphs of FIG. 71 each show the current power spectrum distribution of the second control sound source. FIG. 71 obviously indicates that while Lp changes from 0.4 m to 0.6 m, the phase difference (the phase difference of the second control sound source with respect to the first control sound source) corresponding to the maximum value of a current power spectrum concerning the second control sound source changes from 180° to 0°. This is because, as the first noise source separates from the first control sound source and the second control sound source, the second noise source has less influence on the first control sound source and the second control sound source.

Figure 72:
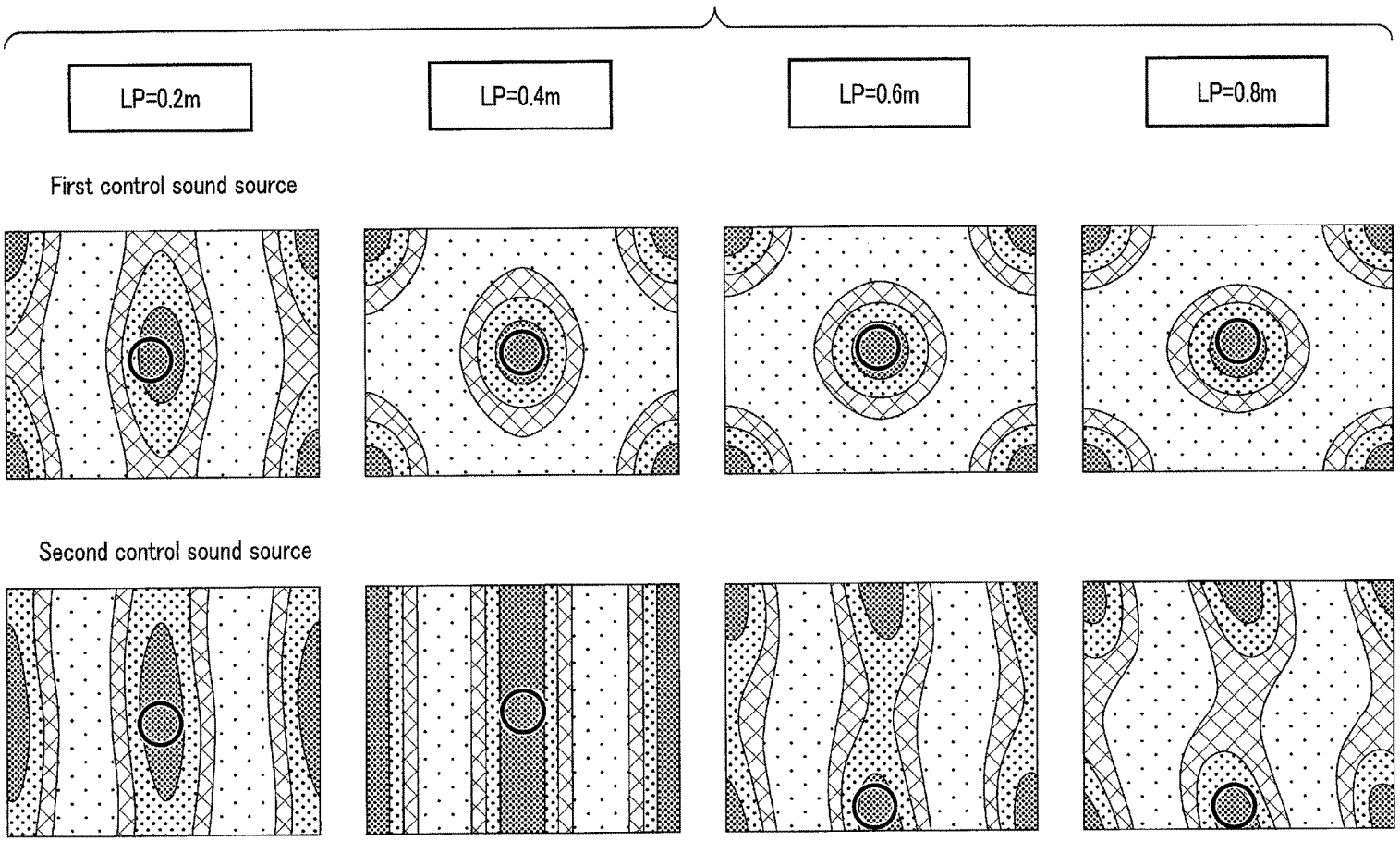
FIG. 72 is a view showing a change in current power spectrum distribution calculated under the (2-2-2)th predictive calculation conditions.

FIG. 72 shows a change in current power spectrum distribution calculated under the (2-2-2)th predictive calculation conditions. According to the (2-2-2)th predictive calculation conditions, the distance d is 0.3 m, the distance Ls is 0.2 m, the shift amount h is 0.2 m, the initial phase of the first noise source is 0°, the initial phase of the second noise source is 180°, the frequency of noise is 200 Hz.

FIG. 72 obviously indicates that while Lp changes from 0.4 m to 0.6 m, the phase difference (the phase difference of the second control sound source with respect to the first control sound source) corresponding to the maximum value of a current power spectrum concerning the second control sound source changes from 180° to 0°. This is because, as the first noise source separates from the first control sound source and the second control sound source, the second noise source has less influence on the first control sound source and the second control sound source.

Figure 73:
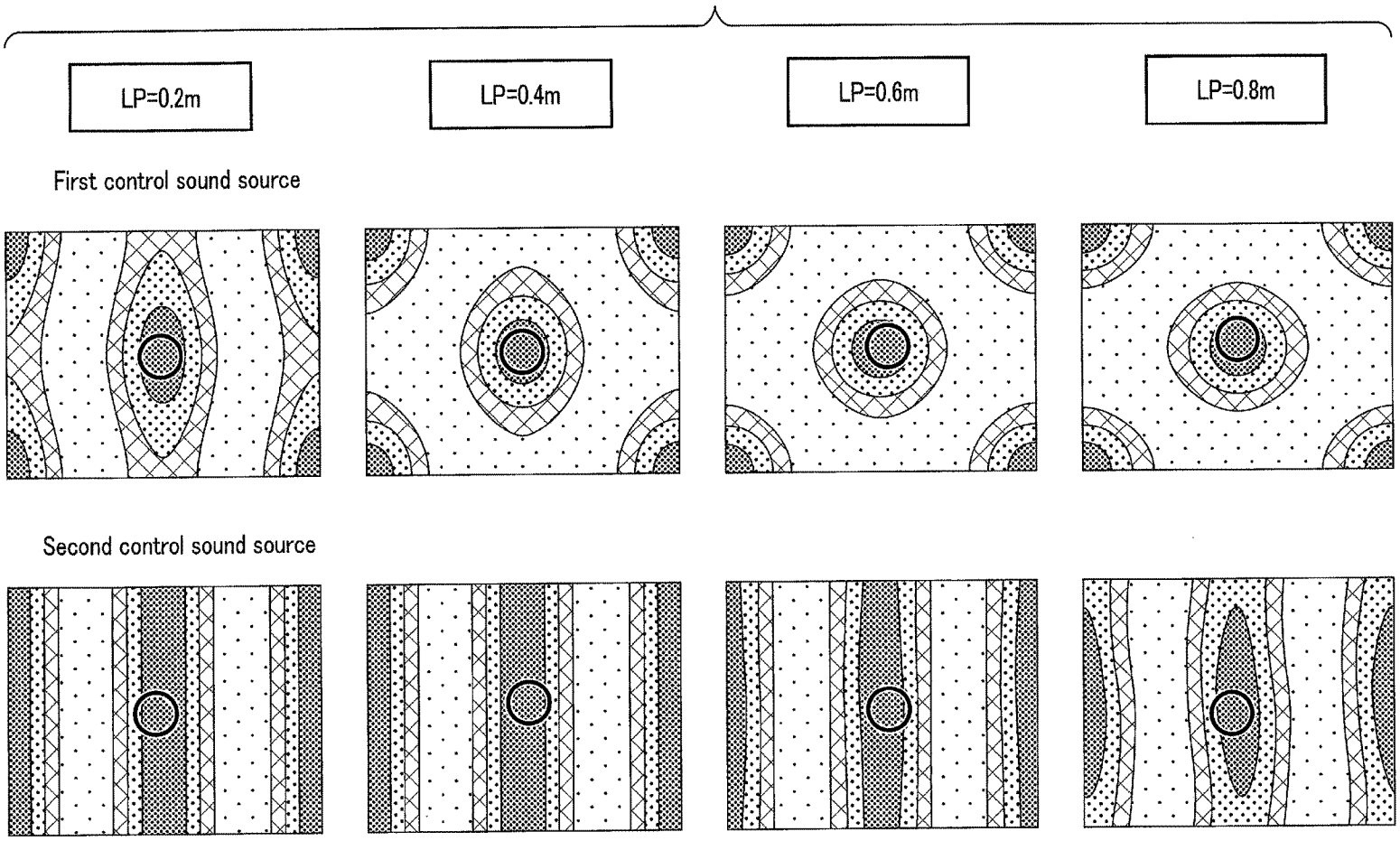
FIG. 73 is a view showing a change in current power spectrum distribution calculated under the (2-2-3)th predictive calculation conditions.

FIG. 73 shows a change in current power spectrum distribution calculated under the (2-2-3)th predictive calculation conditions. According to the (2-2-3)th predictive calculation conditions, the distance d is 0.3 m, the distance Ls is 0.2 m, the shift amount h is 0.8 m, the initial phase of the first noise source is 0°, the initial phase of the second noise source is 180°, the frequency of noise is 200 Hz.

FIG. 73 obviously indicates that even if Lp changes, the phase difference (the phase difference of the second control sound source with respect to the first control sound source) corresponding to the maximum value of the current power spectrum concerning the second control sound source remains constant at 180°. This is because, since the second control sound source separates from the first control sound source, the second control sound source does not contribute to interference.

Figure 74:
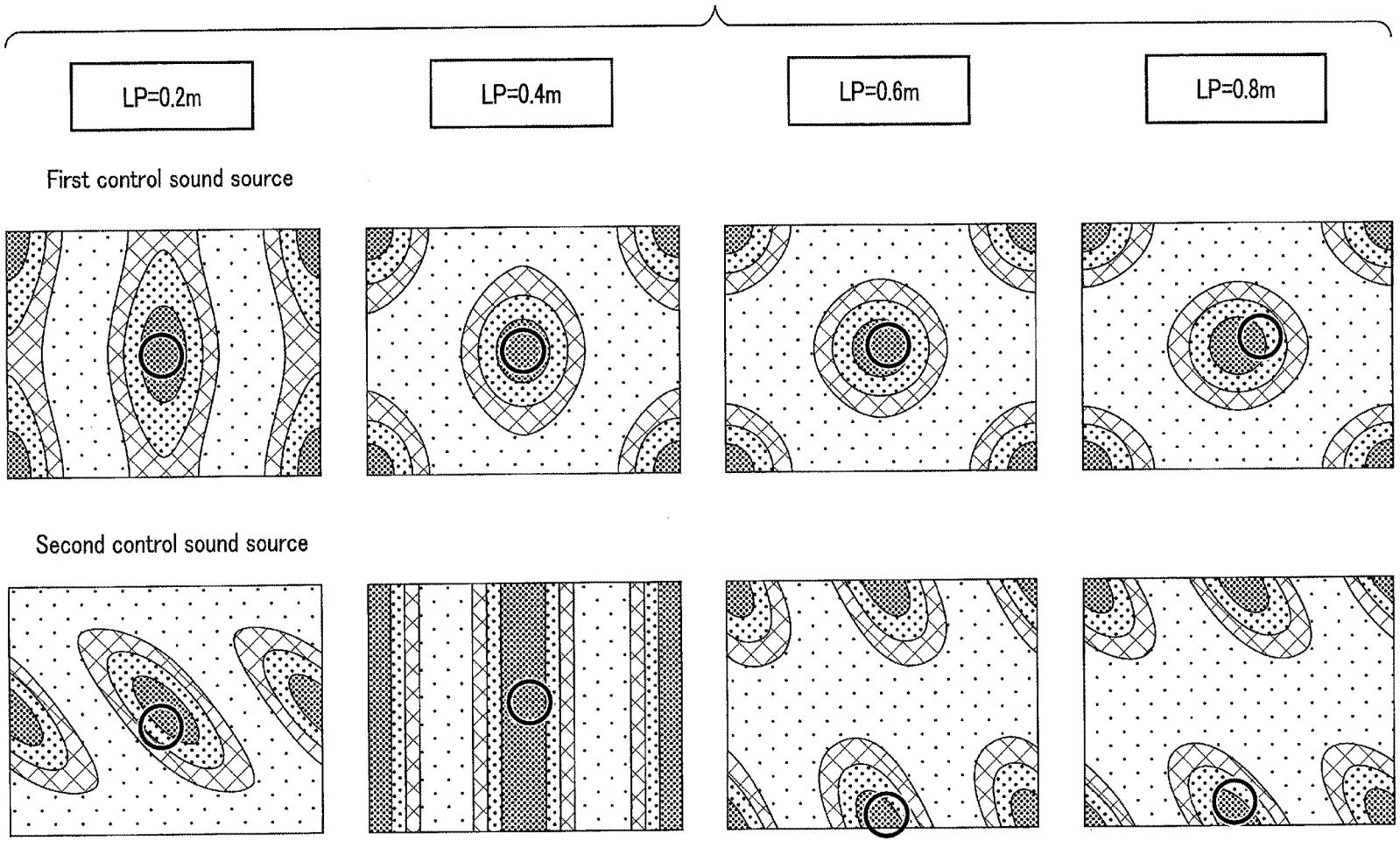
FIG. 74 is a view showing a change in current power spectrum distribution calculated under the (2-2-4)th predictive calculation conditions.

FIG. 74 shows a change in current power spectrum distribution calculated under the (2-2-4)th predictive calculation conditions. According to the (2-2-4)th predictive calculation conditions, the distance d is 0.3 m, the distance Ls is 0.2 m, the shift amount h is −0.2 m, the initial phase of the first noise source is 0°, the initial phase of the second noise source is 180°, the frequency of noise is 200 Hz.

FIG. 74 obviously indicates that while Lp changes from 0.4 m to 0.6 m, the phase difference (the phase difference of the second control sound source with respect to the first control sound source) corresponding to the maximum value of a current power spectrum concerning the second control sound source changes from 180° to 0°. This is because, as the first noise source separates from the first control sound source and the second control sound source, the second noise source has less influence on the first control sound source and the second control sound source.

Figure 75:
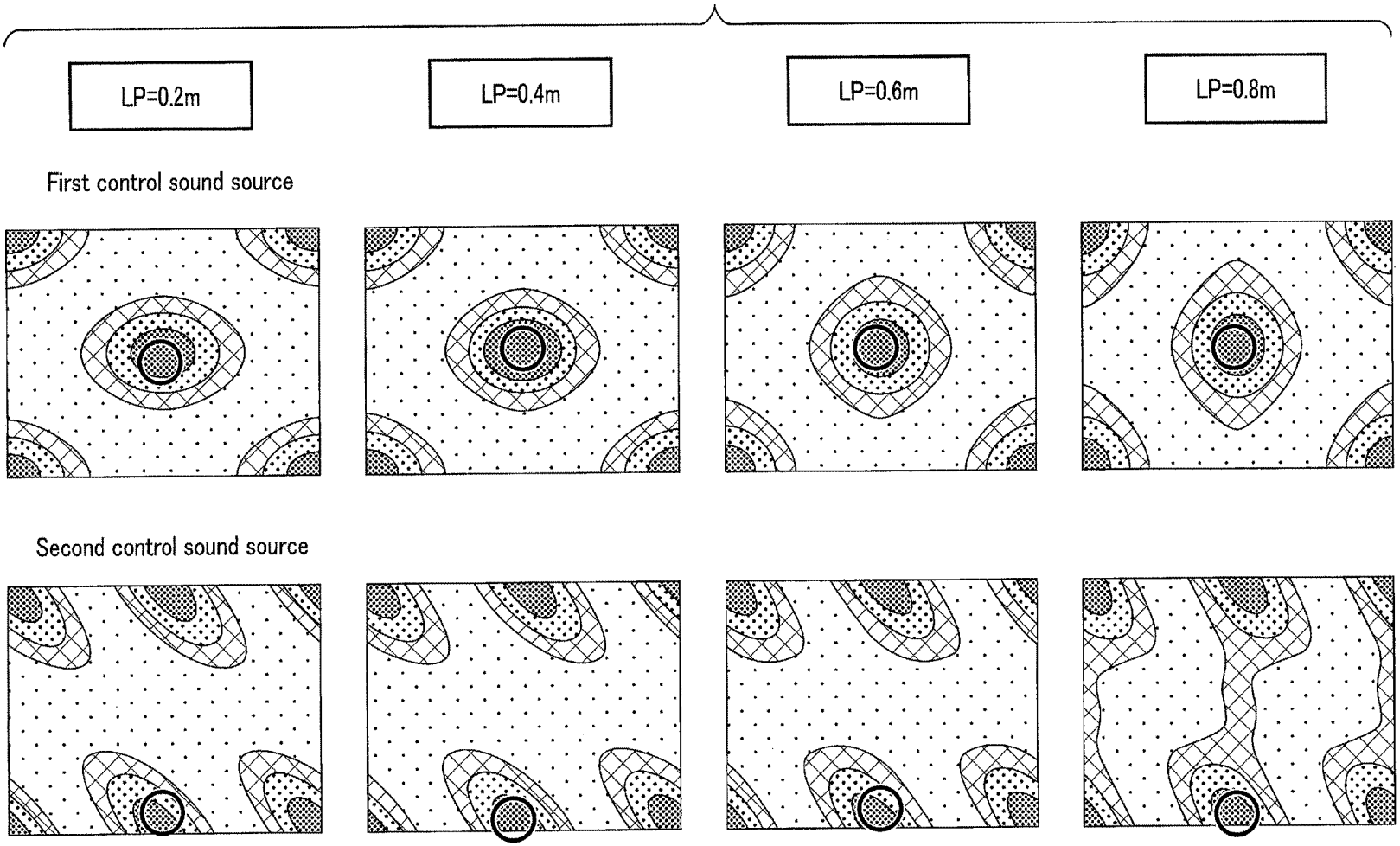
FIG. 75 is a view showing a change in current power spectrum distribution calculated under the (2-2-5)th predictive calculation conditions.

FIG. 75 shows a change in current power spectrum distribution calculated under the (2-2-5)th predictive calculation conditions. According to the (2-2-5)th predictive calculation conditions, the distance d is 0.3 m, the distance Ls is 0.2 m, the shift amount h is 0.0 m, the initial phase of the first noise source is 0°, the initial phase of the second noise source is 0°, the frequency of noise is 200 Hz.

FIG. 75 obviously indicates that even if Lp changes, the phase difference (the phase difference of the second control sound source with respect to the first control sound source) corresponding to the maximum value of the current power spectrum concerning the second control sound source remains constant at 0°.

Figure 76:
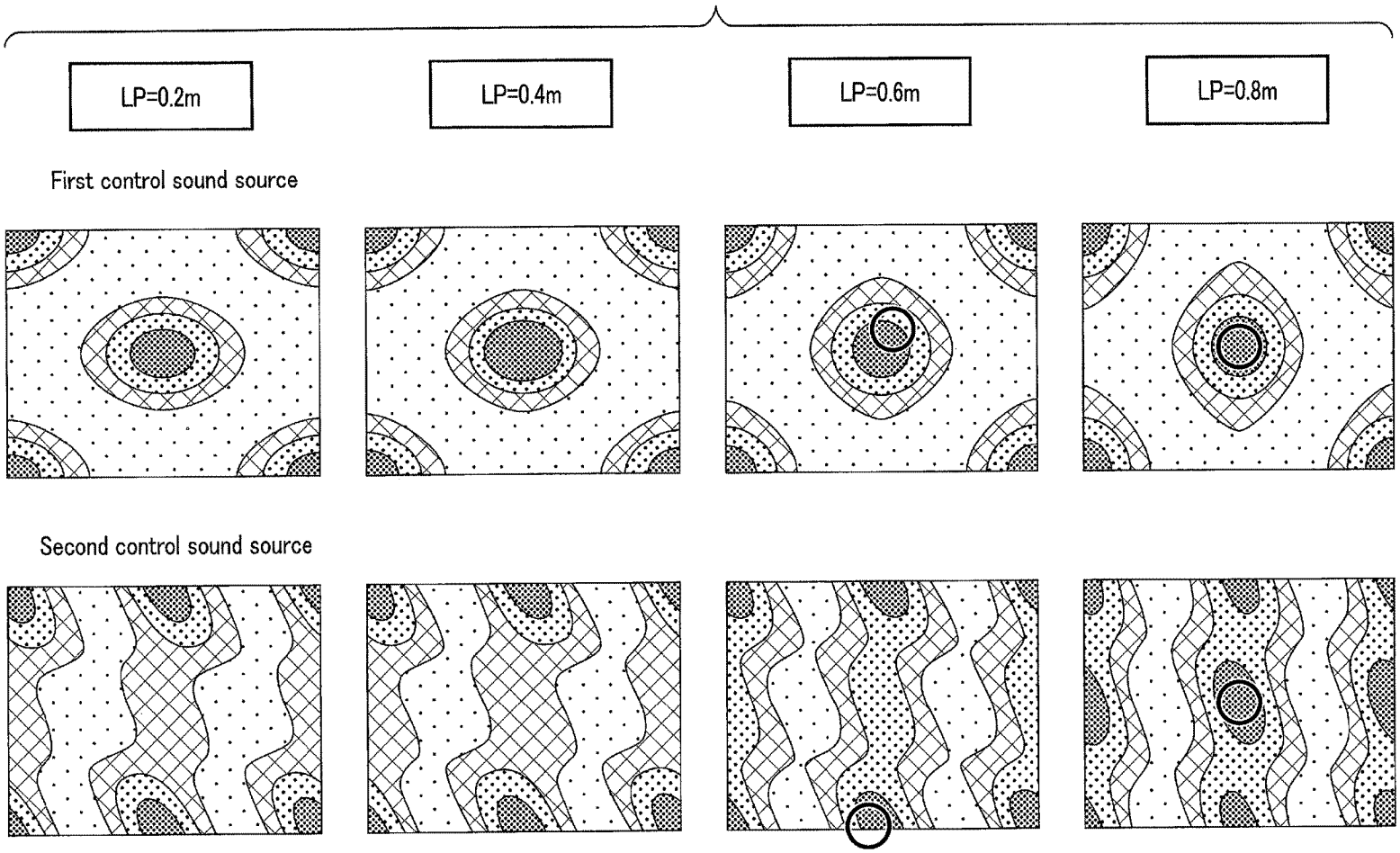
FIG. 76 is a view showing a change in current power spectrum distribution calculated under the (2-2-6)th predictive calculation conditions.

FIG. 76 shows a change in current power spectrum distribution calculated under the (2-2-6)th predictive calculation conditions. According to the (2-2-6)th predictive calculation conditions, the distance d is 0.3 m, the distance Ls is 0.2 m, the shift amount h is 0.2 m, the initial phase of the first noise source is 0°, the initial phase of the second noise source is 0°, the frequency of noise is 200 Hz.

FIG. 76 obviously indicates that while Lp changes from 0.6 m to 0.8 m, the phase difference (the phase difference of the second control sound source with respect to the first control sound source) corresponding to the maximum value of a current power spectrum concerning the second control sound source changes from 180° to 0°. This is because, as the first noise source separates from the first control sound source and the second control sound source, the second noise source has less influence on the first control sound source and the second control sound source.

Figure 77:
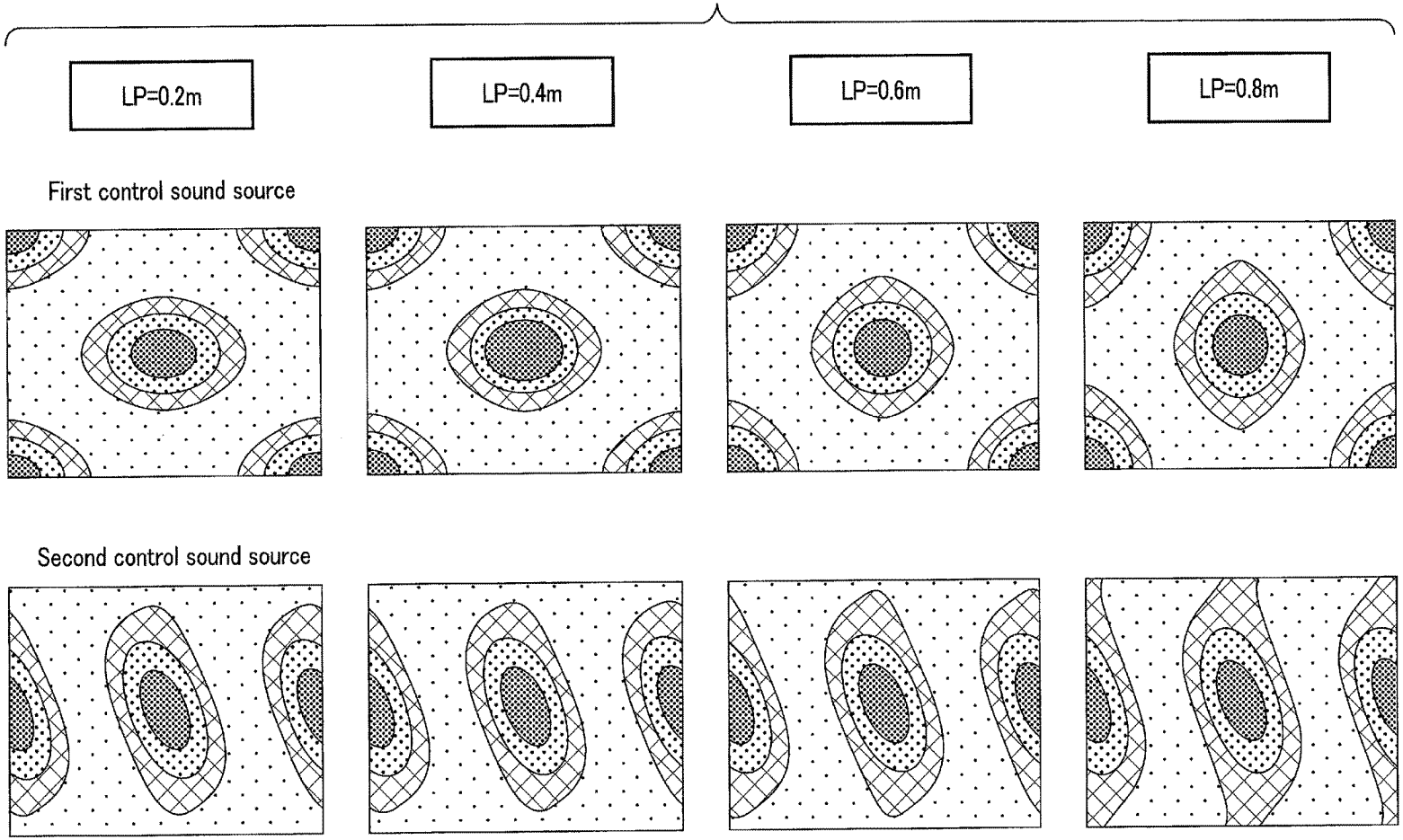
FIG. 77 is a view showing a change in current power spectrum distribution calculated under the (2-2-7)th predictive calculation conditions.

FIG. 77 shows a change in current power spectrum distribution calculated under the (2-2-7)th predictive calculation conditions. According to the (2-2-7)th predictive calculation conditions, the distance d is 0.3 m, the distance Ls is 0.2 m, the shift amount h is 0.8 m, the initial phase of the first noise source is 0°, the initial phase of the second noise source is 0°, the frequency of noise is 200 Hz.

FIG. 77 obviously indicates that even if Lp changes, the phase difference (the phase difference of the second control sound source with respect to the first control sound source) corresponding to the maximum value of the current power spectrum concerning the second control sound source remains constant at 180°.

Figure 78:
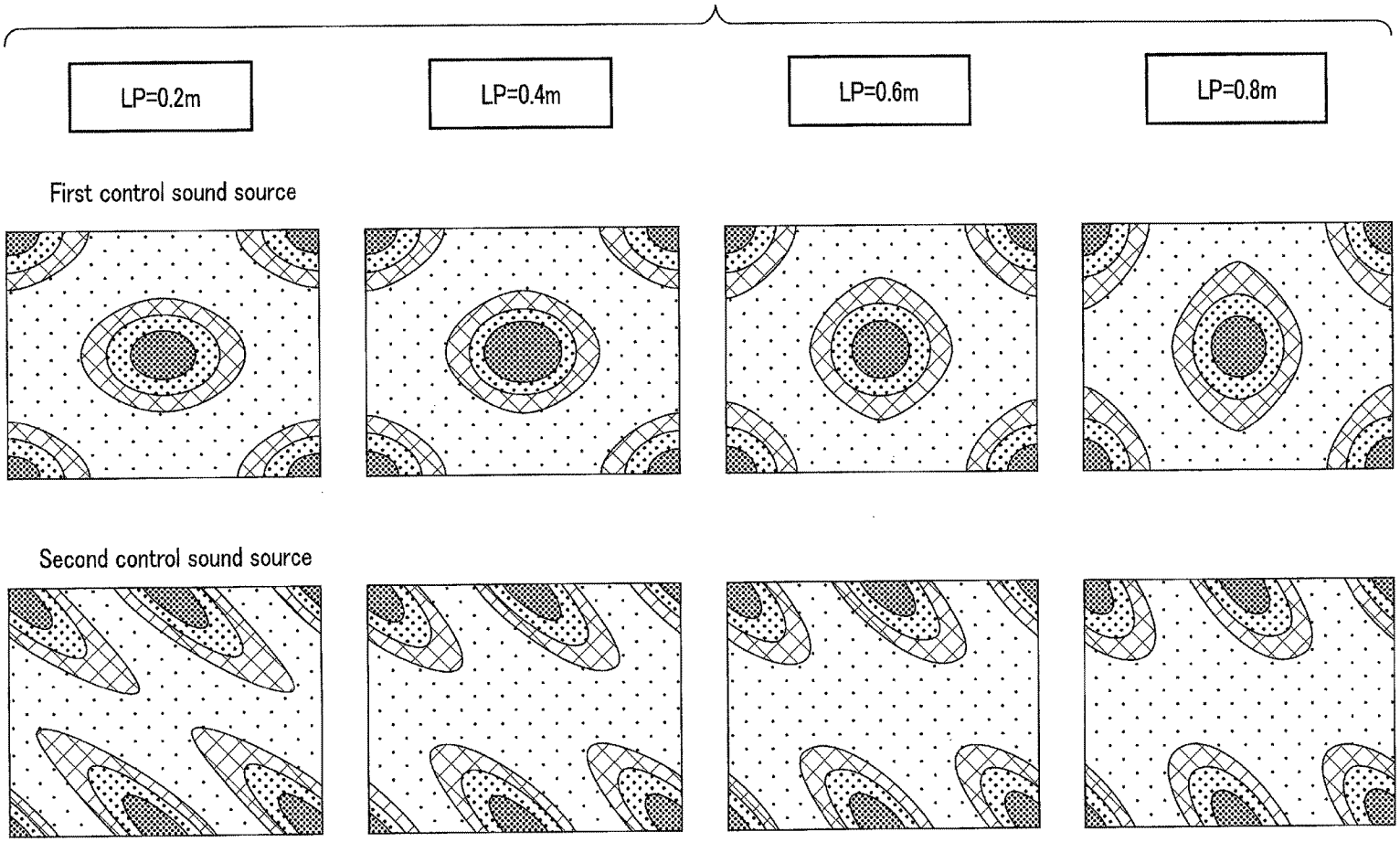
FIG. 78 is a view showing a change in current power spectrum distribution calculated under the (2-2-8)th predictive calculation conditions.

FIG. 78 shows a change in current power spectrum distribution calculated under the (2-2-8)th predictive calculation conditions. According to the (2-2-8)th predictive calculation conditions, the distance d is 0.3 m, the distance Ls is 0.2 m, the shift amount h is −0.2 m, the initial phase of the first noise source is 0°, the initial phase of the second noise source is 180°, the frequency of noise is 200 Hz.

FIG. 78 obviously indicates that even if Lp changes, the phase difference (the phase difference of the second control sound source with respect to the first control sound source) corresponding to the maximum value of the current power spectrum concerning the second control sound source remains constant at 0°.

Figure 79:
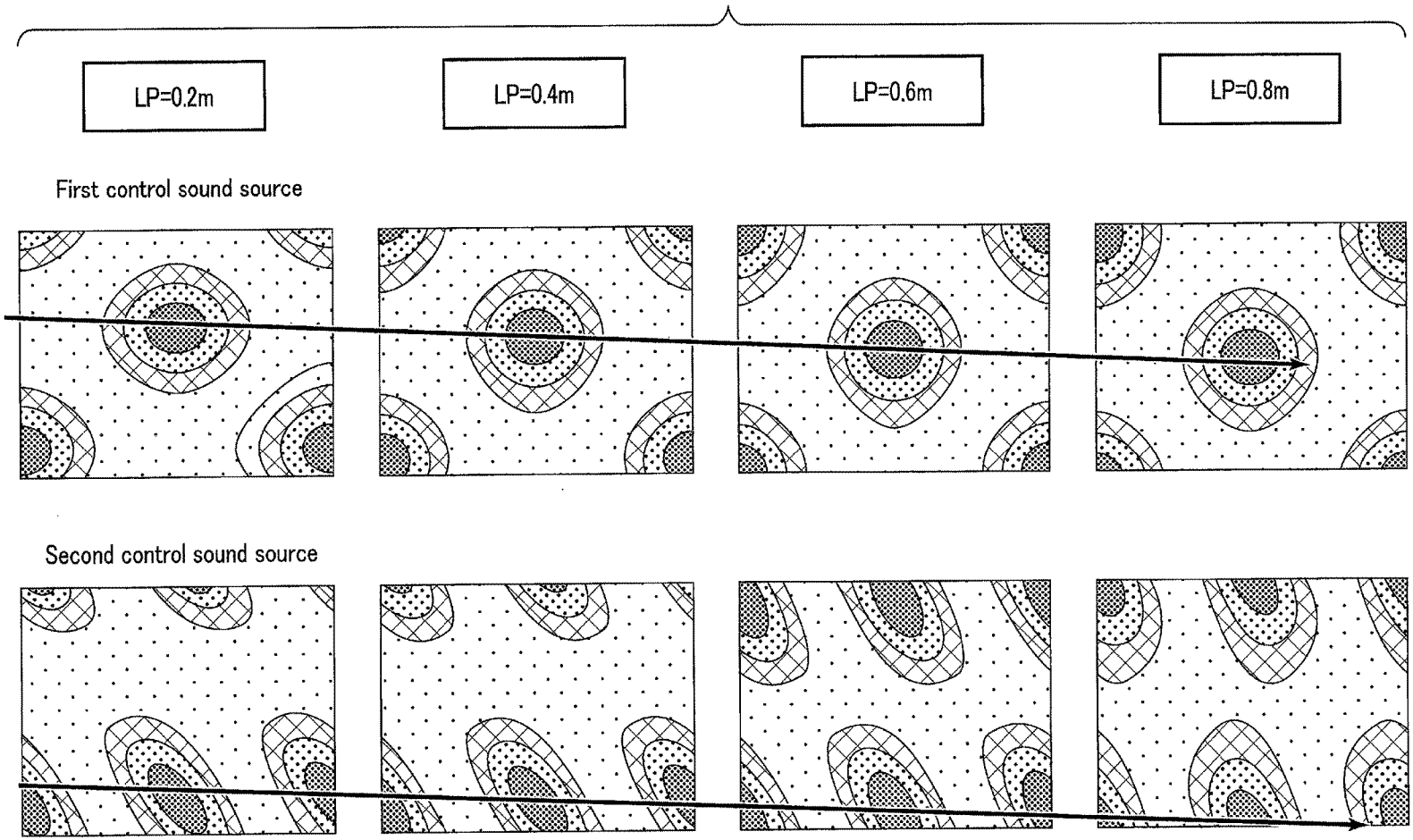
FIG. 79 is a view showing a change in current power spectrum distribution calculated under the (2-2-9)th predictive calculation conditions.

FIG. 79 shows a change in current power spectrum distribution calculated under the (2-2-9)th predictive calculation conditions. According to the (2-2-9)th predictive calculation conditions, the distance d is 0.3 m, the distance Ls is 0.2 m, the shift amount h is 0.0 m, the initial phase of the first noise source is 0°, the initial phase of the second noise source is 90°, the frequency of noise is 200 Hz.

As shown in FIG. 79, as Lp increases, the phase difference (the phase difference of the second control sound source with respect to the first control sound source) corresponding to the maximum value of a current power spectrum concerning the first control sound source changes from 240° to 180°, and the phase difference (the phase difference of the second control sound source with respect to the first control sound source) corresponding to the maximum value of a current power spectrum concerning the second control sound source changes from 60° to 0°. This is because, as the second noise source separates, the second noise source has less influence on the first control sound source and the second control sound source.

As described above, according to the second embodiment, it is obvious that the phase of each of the first and second control sounds is properly set to allow the directivity of the composite control sound of the first and second control sounds to automatically follow unknown noise directivity.

The noise reduction apparatus according to at least one of the embodiments described above includes the two loudspeaker systems. However, this embodiment is not limited to this. That is, the noise reduction apparatus according to the embodiment may include three or more loudspeaker systems. It is conceivable that as the number of control loudspeakers increases, the acoustic power reduction effect will improve. In the case of a rotating system noise source, a plurality of control loudspeakers are preferably arranged at equal intervals on the same circumference centered on the rotation center.

According to at least one embodiment described above, a noise reduction apparatus that can improve the noise reduction control effect with respect to noise having a unknown directivity characteristic can be provided.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A noise reduction apparatus comprising:

a first control sound source configured to generate a first control sound for reducing noise from a noise source;

a first current detector configured to detect a first current flowing from the first control sound source upon receiving the noise from the noise source;

a second control sound source provided at a position different from a position of the first control sound source and configured to generate a second control sound for reducing the noise from the noise source;

a second current detector configured to detect a second current flowing from the second control sound source upon receiving the noise from the noise source;

a processing circuit configured to adjust the first control sound and the second control sound so as to make the first current and the second current satisfy a predetermined condition;

an acquisition device configured to generate a reference noise signal based on the noise from the noise source;

a first control filter configured to adjust at least one of an amplitude and a phase of the reference noise signal and generate a first control signal supplied to the first control sound source; and a second control filter configured to adjust at least one of an amplitude and a phase of the reference noise signal and generate a second control signal supplied to the second control sound source, wherein the processing circuit adjusts the first control filter and the second control filter so as to make the first current and the second current satisfy the predetermined condition.

2. The noise reduction apparatus of claim 1, further comprising:

an additional filter provided for at least one of the first control sound source and the second control sound source and configured to give a predetermined directivity characteristic to a control sound generated from at least one of the first control sound source and the second control sound source, wherein the first control filter and the second control filter are incorporated in a noise reduction system including the first control sound source, the second control sound source, and the additional filter.

3. The noise reduction apparatus of claim 1, wherein the predetermined condition is defined to make an amplitude of the first current and an amplitude of the second current individually take substantially maximum values, and the processing circuit sequentially decides an amplitude and a phase of the first control sound and an amplitude and a phase of the second control sound.

4. The noise reduction apparatus of claim 3, wherein the processing circuit initially sets an amplitude and a phase of the first control sound and an amplitude and a phase of the second control sound based on the reference noise signal, decides an amplitude and a phase of the first control sound so as to maximize an amplitude of the first current, and decides an amplitude and a phase of the second control sound so as to maximize an amplitude of the second current while the amplitude and the phase of the first control sound are fixed.

5. The noise reduction apparatus of claim 1, wherein the first control sound source and the second control sound source are arranged within a distance of substantially ⅓ of a wavelength of noise from the noise source from the noise source.

6. The noise reduction apparatus of claim 1, wherein the predetermined condition is defined to make a total current amplitude take a maximum value based on the amplitude of the first current and the amplitude of the second current, and the processing circuit adjusts at least one of the amplitude and the phase of the first control sound and at least one of the amplitude and the phase of the second control sound so as to make the total current amplitude take the maximum value.

7. The noise reduction apparatus of claim 6, wherein the processing circuit calculates the total current amplitude by weighting and adding the amplitude of the first current and the amplitude of the second current in accordance with a weighting coefficient, and the weighting coefficient is adjusted based on a frequency of noise generated from the noise source, a position of the noise source, and a distance between the first control sound source and the second control sound source.

8. The noise reduction apparatus of claim 7, wherein the first control sound source and the second control sound source are arranged within a distance of substantially ⅓ of a wavelength of noise from the noise source from the noise source, and the weighting coefficient is 0.5.

9. The noise reduction apparatus of claim 8, wherein the first control sound source and the second control sound source are arranged so as to make control sound radiation surfaces face a noise radiation surface included in the noise source.

10. The noise reduction apparatus of claim 8, wherein the first control sound source and the second control sound source are arranged so as to make control sound radiation surfaces face in substantially the same direction.

11. The noise reduction apparatus of claim 8, wherein the second control sound source comprises a plurality of second control sound sources, and letting B be the number of rotor blades of the noise source that generates noise as a rotating blade unit rotates and x be a noise reduction target degree, the first control sound sources and the second control sound sources each are provided by not less than 2Bx+1.

12. The noise reduction apparatus of claim 8, wherein the second control sound source comprises a plurality of second control sound sources, and the first control sound source and the second control sound source are arranged on a circumference, centered on a rotation center of the noise source that generates noise as a rotating blade unit rotates, within a radius shorter than twice of a radius of a rotor blade of the noise source.

13. The noise reduction apparatus of claim 1, wherein windproof jigs configured to protect acoustic radiation surfaces from aerodynamic force are attached to the first control sound source and the second control sound source.

14. The noise reduction apparatus of claim 1, wherein the processing circuit adjusts at least one of the amplitude and the phase of the first control sound and at least one of the amplitude and the phase of the second control sound so as to make the first current and the second current satisfy the predetermined condition.

* * * * *